US008157094B2

(12) United States Patent
Schiessl

(10) Patent No.: US 8,157,094 B2
(45) Date of Patent: Apr. 17, 2012

(54) CONTAINER APPARATUS AND CONTAINER ASSEMBLY

(75) Inventor: Tuende Schiessl, Stadtbergen (DE)

(73) Assignee: Pro-Jekt S Verwaltungsgesellschaft mbH, Stadtbergen (DE)

( * ) Notice: Subject to any disclaimer, the term of this patent is extended or adjusted under 35 U.S.C. 154(b) by 0 days.

(21) Appl. No.: 12/746,097

(22) PCT Filed: Dec. 19, 2008

(86) PCT No.: PCT/EP2008/010911

§ 371 (c)(1),
(2), (4) Date: Sep. 2, 2010

(87) PCT Pub. No.: WO2009/077204

PCT Pub. Date: Jun. 25, 2009

(65) Prior Publication Data

US 2011/0186458 A1 Aug. 4, 2011

Related U.S. Application Data

(60) Provisional application No. 61/014,873, filed on Dec. 19, 2007.

(51) Int. Cl.
*B65D 73/00* (2006.01)
*B65D 85/00* (2006.01)
*B63H 81/36* (2006.01)

(52) U.S. Cl. ..... 206/457; 206/459.5; 446/73; 446/75; 446/76

(58) Field of Classification Search ..... 206/457, 206/459.5; 446/71–78
See application file for complete search history.

(56) References Cited

U.S. PATENT DOCUMENTS

| | | | |
|---|---|---|---|
| D170,309 | S | 9/1953 | Curtis et al. |
| 3,261,619 | A | 7/1966 | Norgaard, Jr et al. |
| D230,658 | S | 3/1974 | Powell |
| 3,831,832 | A | 8/1974 | Gray |
| D232,812 | S | 9/1974 | Ogle |
| D233,181 | S | 10/1974 | Powell |
| D241,480 | S | 9/1976 | Silver et al. |
| D242,660 | S | 12/1976 | Astle |
| D243,052 | S | 1/1977 | Green |

(Continued)

FOREIGN PATENT DOCUMENTS

DE 3 107 882 9/1982

(Continued)

OTHER PUBLICATIONS

Www.cubi-q.de/das-spiel.html, Sep. 1, 2008, Copyright 2007, 2 pages.

*Primary Examiner* — Bryon Gehman
(74) *Attorney, Agent, or Firm* — Fay Kaplun & Marcin, LLP

(57) ABSTRACT

A container apparatus includes a base plate, a sidewall and at least three wheels. The base plate has a first side and a second side. The sidewall is arranged on the first side of the base plate such that the base plate and the sidewall form a room. This room has an aperture opposite to the base plate the sidewall comprises a mating structure. The mating structure is substantially regularly spaced. The at least three wheels are arranged on the other side of the base plate.

20 Claims, 47 Drawing Sheets

U.S. PATENT DOCUMENTS

| | | | | | |
|---|---|---|---|---|---|
| D246,350 | S | | 11/1977 | Powell | |
| D277,042 | S | | 1/1985 | Carter et al. | |
| D279,039 | S | | 5/1985 | Walden | |
| D286,339 | S | | 10/1986 | van Berne et al. | |
| 4,963,115 | A | | 10/1990 | Stowell et al. | |
| 5,022,527 | A | | 6/1991 | Braeutigam | |
| D341,464 | S | | 11/1993 | Beauchamp | |
| D349,813 | S | | 8/1994 | Schwartzkopf | |
| 5,458,521 | A | | 10/1995 | Todd | |
| D364,272 | S | | 11/1995 | Brightbill | |
| D372,583 | S | | 8/1996 | Brightbill | |
| 5,632,375 | A | * | 5/1997 | Mattikow | 206/457 |
| 5,702,003 | A | * | 12/1997 | Springer | 206/457 |
| D401,067 | S | | 11/1998 | Hampshire | |
| D421,336 | S | | 3/2000 | Demore et al. | |
| D436,253 | S | | 1/2001 | Licari | |
| D466,301 | S | | 12/2002 | Cofy | |
| D478,421 | S | | 8/2003 | Overholt et al. | |
| D504,017 | S | | 4/2005 | Zimmerman | |
| 7,086,555 | B2 | | 8/2006 | Overholt et al. | |
| D533,327 | S | | 12/2006 | McCaskill | |
| 7,681,412 | B1 | * | 3/2010 | Arroyo et al. | 206/457 |
| 2003/0168371 | A1 | * | 9/2003 | Weimer | 206/457 |

FOREIGN PATENT DOCUMENTS

| | | |
|---|---|---|
| EP | 1 350 728 | 10/2003 |
| GB | 2 416 529 | 2/2006 |

* cited by examiner

CONTAINER APPARATUS AND CONTAINER ASSEMBLY

PRIORITY CLAIM

This application claims the benefit of the filing date of U.S. Provisional Patent Application Ser. No. 61/014,873 filed Dec. 19, 2007, the disclosure of which is hereby incorporated herein by reference.

FIELD OF THE INVENTION

The present invention relates to the field of storage facilities. In particular, the invention relates to a container apparatus, a cladding apparatus and a container assembly.

TECHNOLOGICAL BACKGROUND

Parents with little children sometimes prefer that their children play in the living room. The reason for the parents to allow the children to play in the living room may be that the parents can supervise the children, react if the children may need support and help if the children are in danger. While the children are playing the parents can do their own entertainment like reading, telephoning, watching television or chatting.

Children may have access to a lot of toys which they can use for playing. Sometimes they have a specified area in the living room, however while they are playing the possibility exists that the children scatter the toys within the living room. Thus, living rooms sometimes may look like the playground of a kindergarten or a play school.

Some parents don't like toys being spread over the whole living room. For example, if the parents expect visitors the parents may want to present a clean room.

If the toys are stored inside a cupboard or in boxes a reserved space exists. However, this reserved space may not be used while children are playing with their toys. Thus, while the time period the children use the toys, the boxes or cupboard are empty wasting the unused space.

From the content of the document DE 31 07 882 A1 a box is known which can be carried, the box having parallel sides which can be used as an underlay for writing, painting or playing.

However, there may be the need to provide an effective storage facility.

SUMMARY OF THE INVENTION

Thus, according to the present invention a container apparatus, a cladding apparatus and a container assembly are provided.

According to an aspect of the present invention, a container apparatus, a storage device or a box comprises a base plate, a sidewall and at least three wheels, wherein the base plate has a first side and a second side. On the first side of the base plate the sidewall is arranged such that the base plate and the sidewall form a room. The room enclosed by the sidewall and by the base plate has an aperture opposite to the base plate.

The sidewall comprises a mating structure or a mounting structure, which is arranged on the sidewall, wherein the mating structure is substantially regularly arranged, regularly spaced or regularly shaped. The first side may be an upper side and the second side may be an underside.

The at least three wheels are arranged on the second side of the base plate.

According to another aspect of the present invention, a cladding apparatus is provided for substantially amending the shape or for substantially amending the outline of the container apparatus, wherein the cladding apparatus comprises a shaping structure and a mating structure. The shaping structure comprises the mating structure.

The mating structure of the cladding apparatus is regularly arranged, regularly spaced or regularly shaped. The mating structure of the cladding apparatus is configured to be mated with the mating structure of a container apparatus. Thus, the mating structure of the cladding apparatus corresponds to the mating structure of the container apparatus. In particular, the mating structure comprises a plurality of regularly arranged mounting apparatus. The mating structure may be arranged on a panel or on the shaping structure.

The shaping structure is adapted or configured to allow amending the shape of the container apparatus when the cladding apparatus is mated with the container apparatus.

According to yet another aspect of the present invention, a container assembly is provided which comprises a first container apparatus and a second container apparatus, wherein the second container apparatus is positioned over the first container apparatus, such that the base plate of the second container apparatus substantially allows covering the aperture of the first container apparatus.

The base plate of a container apparatus may have a rectangular form and thus, the base plate and the sidewall may form a box. The sidewall may comprise a plurality of plates which perpendicularly abut to another. Alternatively, the sidewall may be made of one piece bended around the base plate. The sidewall may be arranged in a rectangular position on the base plate and the sidewall may follow the form, the shape and the contour of the base plate.

The box may provide a room or a storage space which is adapted to keep items like toys. Toys may be play cards, magic cards, pencils, pearls, rings, chains, dice, electronic devices. Thus, a multi-functional storage apparatus may be provided.

The base plate and/or the sidewall may be made of transparent material, like acryl, plastic or glass. A container apparatus made of transparent material may allow identifying the content which is kept inside the box. Thus, looking for certain toys may be simplified.

Alternatively, the container apparatus may also be made of coloured material. The coloured material may allow to use a colour coding scheme in order to identify the toys which are stored inside a defined container apparatus.

For example, from a pedagogic standpoint it may be useful, not to provide the children with the same toys every day. Therefore, the colour may be chosen according to the day of the week when the children may use a certain toy.

The mating structure of the cladding apparatus may be arranged on the shaping structure of the cladding structure such that the mating structure of the cladding structure can join or engage with the mating structure of the container apparatus. Thus, the mating structure of the container apparatus and the mating structure of the cladding apparatus may be inter-related products and may form a plug and a socket principle.

The regular arrangement of the mating structure may allow distributing the weight of the cladding structure over the whole surface of the sidewall. Thus, a cladding structure may be able to be mounted on the sidewall providing a high stability. Nevertheless, the cladding structure may quickly be removed from the sidewall. Thus, decorating of the container apparatus with the cladding structure may also be conducted by a child.

The at least three wheels may be mounted on the side of the base plate opposite to the side of the base plate, on which the sidewall is mounted. The side on which the three wheels are mounted may be that side of the base plate, which side is faced to the ground when the container apparatus is moved over the ground in a normal operation mode. Thus, the at least three wheels may allow moving the container apparatus over the ground or floor easily. In order to prevent damage of the floor e.g. in a living room the wheels may at least partially be made of soft material like rubber.

Edges on the container apparatus or the cladding apparatus may be trimmed in order to reduce the danger of injury. Furthermore, the material, the construction and the stability of the container apparatus and the cladding apparatus may be chosen such that requirements of corresponding countries are fulfilled to allow the container apparatus and the cladding apparatus to be used as a toy for children of different age. Such regulations may include rules for the material that may be used. E.g. the material for the container may be hardly to be burned or inflamed.

The mating structure of the container apparatus may allow mounting a cladding apparatus comprising a shaping structure like a panel, a three dimensional forming structure or a three-dimensional structure to the container apparatus. The mating structure may be arranged outside of the room on the sidewall. I.e. the mating structure may be able to be accessed from outside of the room. Thus, the mating structure may be arranged on the side of the sidewall facing to an exterior side of the sidewall.

The mating structure of the container apparatus and the mating structure of the cladding structure may comprise a plurality of mounting apparatus or mounting elements such as a pin and an ear, a nail, a bore or a screw. The regular arrangement of the mounting elements of the mating structure may allow manufacturing a plurality of different cladding apparatus which may be connected or engaged onto the same mating structure. The mating structure thus may be seen as an interface between the container apparatus and the cladding apparatus.

A predefined regular grid for the arrangement of the mounting elements of the mating structure may allow manufacturing the cladding apparatus and the container apparatus by different manufacturer. The production for the cladding apparatus may also be standardized and thus manufacturing may be easy and cost-effective.

Such a standardized mating structure with equidistantly arranged mounting elements may allow attaching a plurality of different forms of cladding apparatus to the box. The different forms of cladding apparatus may allow to differently amend the form of the container apparatus.

Thus, the container apparatus itself may be used as a toy. For example an existing box may be retrofit with the regular structure in order to provide a basis for mounting a cladding apparatus.

The cladding apparatus, the shaping apparatus, the panelling apparatus or the facing apparatus may have the shape of a transport facility like an airplane, a car, a ship, a rocket. Alternatively the cladding apparatus may have the form of a building or the form of an animal like an elephant, a horse or a cow. The shaping structure may be a projection or a model of a real existing element. The form of this real existing element may be reduced or scaled down to a form which may reflect the basic elements allowing to recognise the real element. Thus, a car may be modelled by attaching a photo of a side view of a car to a two dimensional panel.

Attaching the cladding apparatus to the container apparatus may allow "face-lifting" of the form or the shape of the pure container apparatus. In other words, the container apparatus may be tuned, pimped or modified. And thus, the children may use the container apparatus and the cladding apparatus for playing. The room provided by the container apparatus may be dimensioned such that a child may sit inside the room.

Thus, it may be seen as a gist of the present invention that the storing device or container apparatus may also be used by a child to play with the container apparatus. Allowing a child to play with the box may provide an effective use of the box. On the one hand the box may be used as a storage facility or a bin. On the other hand the box may be used as a toy in particular as a transport facility, an animal or a building. Therefore, the storage device may not only be used to keep items and toys of the children. The container apparatus may also be integrated in a children's play and the child may toy with the container apparatus.

A plurality of container apparatus may form a building set, which may allow forming different objects like animals, buildings, and transportation means. Alternatively to plastic, the container apparatus, a corresponding lid or a cladding apparatus may be made of paper, carton, card or textile.

A base container apparatus may be formed or shaped as desired by adding parts e.g. made of plastic or by adding a cladding apparatus. The container apparatus may assist to develop the fantasy and the senses of a child.

Furthermore, the container apparatus may prevent a child swallowing small parts. A cladding apparatus may be a wing, a steering-wheel, a horn, a light for a car, a propeller, a frame for pictures, an advertising column, a sail, a train, an airplane, a car, a rocker and a horse Furthermore, the form or shape of the container apparatus and the shape of the cladding apparatus may be manufactured and designed such, that the container apparatus may be a decorative element for a living room. The cladding apparatus may be provided with a hinge and may have a size such that the cladding apparatus is configured to be foldable. The size of the cladding apparatus in a folded state may be such that the folded cladding apparatus may be placed inside the room formed by the sidewall and base plate of the container apparatus.

Furthermore, a stack may be built by putting a plurality of container apparatus on top of each other. Thus, the space which is consumed by the plurality of container apparatus may be limited.

Since the container apparatus comprises at least three wheels, the container apparatus may be used by a child such that a child may sit inside the apparatus and the child be moved over the floor of the living room.

Thus, according to an aspect of the present invention, an indoor playing system and storing system may be provided which allows storing the toys of a child and being used as a toy by a child. Since the boxes or container apparatus may be used by a child the edges, if available, may be trimmed or padded in order to reduce the danger of any injury.

The size and in particular the height of the different container apparatus may be different. E.g. low boxes exist for storing little items like pearls, rings or chains. Furthermore, high container apparatus may exist for storing larger items like the cladding apparatus, a sheet, a cushion or a doll.

The section, the footprint, the layout or the form of the base plate of the container apparatus may be standardized in order to allow a plurality of container apparatus to form a stack in the form of a tower or a container assembly. Thus, a stable tower of boxes may be built.

With the aid of the regular mounting structure or regular mating structure the container apparatus may be decorated with additional ornaments.

According to another exemplary embodiment of the present invention the container apparatus comprises a room which is less than 4 $m^3$. According to another aspect of the invention the room inside the container apparatus is less then 3.375 $m^3$.

Providing a space which may have 1.5 m×1.5 m×1 m or 1.5 m×0.8 m×0.5 m may provide enough space for a child to sit inside. Common measurements for a container apparatus which may be made for a child to sit inside for example are in the range of 0.2 $m^3$ to 1 $m^3$. The area of a base plate for such a container apparatus may have a size of 0.5 m×0.8 m. Furthermore, the height may be selected from the group of heights consisting of 0.32 m, 0.145 m and 0.075 m. The breadth may be 0.58 m and the depth may be 0.38 m. Alternatively, the breadth may be 0.38 m and the depth may be 0.58 m.

According to an exemplary embodiment of the present invention at least two of the at least three wheels are mounted on a shaft or an axis.

An axis may connect two wheels and may provide additional stability for the container apparatus. The wheels may be mounted between a ground and the base plate of the container apparatus. In particular at least two wheels are mounted on the same shaft which allows to substantially equally distribute the weight of the container apparatus to the wheels. Three wheels may be used if a triangular form of the base plate be used. In the case of a rectangular base plate four wheels may be employed.

According to another aspect of the present invention the shaft is made of metal. In order to support the weight of a child sitting inside the container apparatus, an axis made of metal may provide more robustness to be used for playing. The axis may be used to carry a weight in the range of 20 kg to 80 kg. In particular, the shaft may be dimensioned in order to carry a weight in the range of 20 kg to 40 kg or 30 kg to 45 kg.

According to yet another exemplary embodiment of the present invention, the mating structure of the container apparatus comprises at least one magnet.

The magnet may allow mounting different decorating elements like a cladding apparatus to the sidewall of the container apparatus. The mating structure may comprise a plurality of equidistantly spaced magnets. The number, the strength and the size of the magnets may determine how strong the cladding apparatus is attached to the container apparatus. The strength of such a magnet may be selected such allowing a child to remove and to attach the cladding apparatus to the container apparatus. However, the strength of the magnet may be selected such that the cladding apparatus may not be removed by the force of a child.

According to another aspect of the present invention, the mating structure of the container apparatus comprises at least one bore.

A bore which may engage with a corresponding pin may also allow attaching a cladding structure to the sidewall of a container apparatus. The bore may be a through hole, which allows penetrating a screw through the through hole and to fix the screw with a screw nut. Using a screw and a screw nut may provide high stability for attaching a cladding structure to the sidewall. Thus, a screw and a screw nut may allow mounting a cladding structure having a high weight on the sidewalls of the container apparatus.

According to another aspect of the present invention, the at least one bore of the mating structure comprises a thread.

A bore having a thread may allow a screw directly to be screwed inside the sidewall. A thread inside the bore may prevent to have a through hole and thus may provide a plane surface of the sidewall side faced inside the room.

According to yet another aspect of the present invention, the mating structure comprises a snap fit closure or at least part of a snap fit closure.

The other part of the snap fit closure may be mounted on a cladding apparatus or on a cladding apparatus. The part of the snap fit closure of the cladding structure may be mated with the part of the snap fit closure of the container apparatus in order to mount the cladding apparatus on the sidewall of the container apparatus. A snap-fit closure may allow the cladding structure to be quickly mounted on the container apparatus and the cladding structure to be quickly released from the container apparatus.

According to yet another aspect of the present invention, the base plate has a shape selected of the group of shapes consisting of a rectangular shape, a circular shape and a triangular shape.

A circular shape may allow building a tower consisting of a plurality of containers having the form of a tube or an advertising column. Such a circular shape may allow preventing edges which may cause injury to a child.

A container apparatus, having a rectangular shape may have four sides, four side plates or four sidewall plates which have the same length. In a particular embodiment the rectangular container apparatus may have two first sidewalls having the same length and two second sidewalls having the same length. The length of a first sidewall may be different from the length of the second sidewall.

According to another aspect of the present invention, the sidewall of the container apparatus has at least one recess, wherein the at least one recess is configured or adapted to receive at least a portion of a wheel of another container apparatus.

A recess which receives at least a portion of a wheel of another container apparatus may provide a secure mount if a plurality of container apparatus form a stack. The wheel may engage with the sidewall of another container apparatus when the container apparatus are placed one on top of each other. In particular, the wheel engage with a recess in the sidewall. For example, the other container apparatus which may be placed on top of the container apparatus has a double tire, i.e. two wheels which are mounted on an axis in close neighbour ship. The two wheels may provide a small gap in between of the wheels. The gap may have the breath of one of the sidewalls of the container apparatus. This gap may receive an upper end of a sidewall of a container apparatus such that the top of the sidewall may engage with at least one of the wheels and a movement parallel to the base plate may be limited in relation to the two container apparatus.

On top in this context may mean an end of the sidewall which has a larger distance to the base plate than another end of the side wall. In other words, if an other container apparatus may be placed on top of a container apparatus, the other container apparatus is put on an end of the sidewall of the container apparatus such that the base plate of the other container apparatus may substantially cover the aperture of the lower container apparatus. A top end of the sidewall may be an end of the sidewall opposite to the base plate and opposite to the wheels. The base plate of the other container apparatus may be positioned substantially in parallel to the base plate of the container apparatus.

According to another exemplary embodiment of the present invention, the recess is further configured to receive the at least one portion of the at least one wheel of the other container apparatus such that the base plate of the other container apparatus forms a lid, a cover or a cap for the container apparatus.

Therefore, stacking a plurality of container apparatus one on each other may allow closing the aperture of a container apparatus and thus may limit the number of lids which are required in order to cover the apertures of the container apparatus building a stack. By a lid the room which is built inside the container apparatus may be locked to prevent that a child has access to the items which may be stored inside the container apparatus. The lid may also comprise a lock.

According to another aspect of the present invention, the container apparatus has a sidewall comprising a slot, wherein the slot is configured to receive a lid, a cap or a cover.

A lid for the container apparatus may be any plate which has a thickness adapted to fit inside the slot and covering at least a portion of the aperture. The slot may be further configured such that when the lid is received from the slot, the slot allows positioning the lid substantially parallel to the base plate.

The lid may allow closing the room. A lid may prevent the items kept inside the container apparatus to fall outside. In other words, the slot in an upper end of the sidewall and the lid may form a groove and tongue principle in order to securely hold the lid in a substantially parallel position to the base plate. Holes or grooves which may be positioned inside the lid may allow removing the lid from the container apparatus by bending the lid.

According to another aspect of the present invention, the container apparatus has a sidewall comprising a flange, wherein the flange is configured to receive and hold a lid, a cap or a cover.

According to another aspect of the present invention, the container apparatus comprises a lid, wherein the lid has a first size and wherein the aperture has a second size. The size of the lid is adapted to cover at least partially the size of the aperture or the aperture. E.g. the first size is smaller than the second size.

The lid may be received by the slot or flange such that a portion of the aperture is covered by the lid. Thus, the aperture may be partially closed.

The size of the aperture may be an area of the aperture. The size of the lid may be an area of the lid. Covering a portion of the aperture may allow building a surface inside or on top of the container apparatus. A child may use the surface as a seat. The lid in combination with a corresponding cladding apparatus may allow building a container apparatus which has the form or shape of a car, in particular which has in the imagination of a child the form of a car or any other transport facility, animal or building.

According to another aspect of the present invention, the container apparatus has a lid which is positioned in the slot, in the groove or in the flange such that the lid can be moved in parallel to the base plate.

The lid may be moved if the size of the lid is smaller than the size of the aperture.

According to yet another aspect of the present invention, the lid is configured as a seat.

According to a further aspect of the present invention, the container apparatus further comprises a lid which extends at least partially over the sidewall. In contrary to a lid which is mounted in a slot and substantially covering the room of the container apparatus, a lid which extends over the sidewalls may bear on the upper end of the sidewall. The upper end may be positioned opposite to the base plate.

A flange may be arranged on a side of the lid which side in a mounted position of the lid is faced to the base plate. The flange may prevent a movement of the lid which movement extends over the sidewall in parallel to the base plate. Thus, the lid may be securely arranged atop of the sidewall. The arrangement of the flange may have the form of the base plate and in particular the arrangement of the flange may have the form of the aperture of the container apparatus. The flange of the lid may engage with the flange of the sidewall. Thus, the flange may fit inside the aperture such that in a mounted position the flange contacts an inner surface of the sidewall. This contact may limit a sideward movement or drift of the lit on top of the container aperture.

A lid which covers the aperture may be used as a plate of a table or a desk top. Such a plate may be differently formed and for example has the form of a heart, a cloud or a flower.

According to another aspect of the present invention, the lid comprises at least one through hole wherein the through-hole of the lid or the aperture in the lid allows putting an item inside the room through the lid.

Thus, even if the lid is mounted on a top area of the sidewall and thus covering the aperture the through-hole may allow putting items inside the box through the through-hole.

According to another aspect of the present invention, the through-hole in the lid has a shape selected from the group of shapes consisting of a circle, a disk, a star, a triangle and a rectangle.

A child may use the through-holes having such a particular shape to put items having a corresponding shape inside the box. For example, such items may be building bricks having a corresponding form.

According to another aspect of the present invention, the container apparatus further comprises at least one partition wall. The partition wall is arranged inside the room such that the room is divided in at least one sub-room. A sub-room may be a portion of the room separated by a separating structure such as a divider or partition wall.

The partition wall may be removably installed inside a container apparatus and may allow to separate the room in different sub-rooms. A sub-room for example may be used for keeping a first type of items and another sub-room may be used for keeping a second type of items. For example, rings and pearls may be separated by such a partition wall.

According to another aspect of the present invention, the sidewall of the container apparatus further comprises at least one picture frame.

In this context a picture frame may be any type of holder which is adapted or configured to hold a picture like a painting or a photography.

A picture frame may be a picture frame made of glass, a sheet protector or a transparent envelope which may be mounted on the sidewall of the container apparatus. The picture frame may be mounted using the mating structure and may allow to present pictures produced by a child or any other pictures which the child may want to have as a decorative element on the outside surface of the sidewall of the container apparatus. Providing the possibility of putting pictures in picture frames may enhance the creativity of the child. The picture frame may have different sizes for example DIN A4, DIN A5, DIN A6 or any US-legal or US-letter format.

According to another aspect of the present invention, the container apparatus further comprises a board.

In other words, a board may be attached to the container apparatus using the mating structure. In an alternative exemplary embodiment, the sidewall of the container apparatus may be made of material which usually is used for a board. Thus, the sidewall may be the board. A board may be a black board or a white board. A black board may be painted with a chalk. A white board may be painted with an appropriate pencil. Thus, the painting may easily be removed from the side wall.

Having a board installed on the sidewall may allow a child painting the container apparatus and decorating the container apparatus.

According to another aspect of the present invention, the container apparatus comprises a closure element, wherein the closure element is configured to engage with the closure element of another container apparatus.

The container apparatus comprises at least a part of a closure element. Such a closure element or the part of a closure may be engaged with a closure element of another container apparatus. After engaging the parts of the closure elements the container apparatus may be kept in a substantially fixed position in relation to the other container apparatus when a plurality of container apparatus are combined to a stack, to a tower or to a container apparatus assembly. Such a closure element may increase the stability of a tower built of a plurality of container apparatus. The closure element may be arranged on an upper position and/or lower position of the sidewall in order to engage with a corresponding closure from another container apparatus of the container assembly. The stability of the stack may be increased by engaging the wheels of a first box with a recess of a second box.

The aforementioned exemplary embodiments have been described on the basis of a container apparatus, but the features may also apply for the cladding apparatus and the container assembly. In the following further exemplary embodiments of the cladding apparatus will be described. These embodiments apply also for the container apparatus and the container assembly.

According to another aspect of the present invention, the shaping structure of the cladding apparatus is a panel, wherein the panel has a shape selected from the group of shapes consisting of a side view shape of an animal, the side view shape of a transport facility like a car, boat, train, airplane, bus and the side view shape of a building. Thus, the shaping structure may have a side view shape of a transport facility, an animal or a building.

The shape of the container apparatus may be hidden behind the shaping structure. Thus, a container apparatus or a container box may look like a car, a plane, or an animal. In particular, the container apparatus may look like a transport facility, an animal or a building in a side view. The cladding apparatus may decorate the container apparatus. The shaping structure may substantially extend over a cross section of the corresponding container apparatus. In other words, the size of the surface of the shaping structure may be higher than the size of the side wall of a corresponding container apparatus.

Even if a description is made for different side views the cladding apparatus may not be limited thereto. Thus, front or back views of the corresponding elements like transport facilities, animals or buildings are also applicable.

According to another aspect of the present invention, the shaping structure further comprises a three-dimensional forming structure, wherein the three-dimensional forming structure is attachable to the shaping structure. For example, this forming structure may be any ornament like an ear of an animal, a steering wheel, a jet, a propeller, a horn, a turn indicator or any other functional element of a transport facility or of a building.

The horn may provide a sound and the turn indicator may be configured to flash and to provide light signals. The functional element which may form the three-dimensional forming structure may support to give the container apparatus a realistic view. The ornament or three-dimensional forming structure may also be mounted to the cladding apparatus using a regular mating structure.

According to another aspect of the present invention, the cladding apparatus has a shaping structure which may comprise a three-dimensional body or a three-dimensional structure. The three-dimensional structure has at least one form selected from the group of forms consisting of a boat bow, an airplane bow, a car bow, a boat aft, a boat stern, a helicopter tail, an airplane tail and an airplane wing. Such a three-dimensional structure may provide a shape for the container apparatus, which may substantially look realistic. The three-dimensional structure may also comprise a three-dimensional forming structure.

The three-dimensional structure and in particular the boat bow, the airplane bow and the car bow provide a storage room covered by a flap which may be opened to put items inside the three-dimensional body. Thus, the child may put a suitcase inside the room covered by the flap or inside a luggage compartment.

According to another aspect of the present invention, the cladding apparatus comprises a shaping structure which is a rod. The rod may be used to mount a sheet on the rod and may allow building a tent or a cave. Furthermore, the rod may allow mounting a sail on the container apparatus in order to build or to model the shape of a sail boat taking the container apparatus as a basis.

According to another aspect of the present invention, the cladding apparatus, the attachment apparatus, mounting apparatus, casing apparatus, panelling apparatus or skin has a mating structure which is configured to substantially fit to the size of at least a portion of the sidewall of the container apparatus.

By fitting the cladding apparatus or by fitting a portion of the cladding apparatus to a size of the container apparatus may allow preventing discontinuities between the cladding structure and the container apparatus. Thus a realistic view or shape may be provided and the shape of the container apparatus may be hidden behind the cladding apparatus.

According to another aspect of the present invention, the shaping structure of the cladding apparatus further comprises a skid. The skid may be mounted on the mating structure and be supported by engaging with at least one of the wheels in order to allow forming a sledge or a rocker. For example, with the appropriate cladding apparatus the container apparatus may form a rocking horse.

In the following further exemplary embodiments of the container assembly will be described. These embodiments apply also for the container apparatus and the cladding apparatus.

According to another aspect of the present invention, the container assembly further comprises a platform structure, wherein the platform structure comprises a sidewall. The sidewall of the platform structure has substantially the same shape as the base plate of the first container apparatus and the sidewall of the platform structure has at least one recess. The at least one recess of the platform structure's sidewall is configured to receive at least the portion of a wheel of the first container apparatus and the first container apparatus is positioned over the platform structure. A platform structure may extend over the form of the base plate of one of the first and second container apparatus in order to provide stable platform structure or base. A stable base may allow building a tower or a stack of a plurality of container apparatus. In order to increase the stability of the stack which may be built upon the platform, the sidewall of the platform may comprise a closure corresponding to the closure of a container apparatus.

According to another aspect of the present invention, the container assembly further comprises a cladding structure, wherein the mating structure of the cladding structure is mated with at least one mating structure selected from the group of the mating structure of the first container apparatus and the mating structure of the second apparatus.

Furthermore, a table may be built, wherein the table may comprise a platform structure, a first container apparatus, a second container apparatus and a lid. The lid may extend over the sidewall of both container apparatus. The lid may form a desk top.

The cladding apparatus and the container apparatus may be made of one piece. For example the cladding apparatus may be cut out of a plate.

Furthermore, according to an aspect of the present invention, a method is provided, comprising mating a mating structure of a container apparatus with the mating structure of the cladding structure in order to amend the shape of the container apparatus. The amended shape of the container apparatus may allow a child using the container apparatus as a toy.

Furthermore, a method may be provided for arranging a regular mating structure to a container apparatus and/or to a cladding structure, in order to mount the cladding structure to the container apparatus by mating the mating structure of the container apparatus with the mating structure of the cladding apparatus.

These and other aspects of the present invention will become apparent from and elucidated with reference to the embodiments described hereinafter.

BRIEF DESCRIPTION OF THE DRAWINGS

Exemplary embodiments of the present invention will be described in the following, with reference to the following drawings.

DETAILED DESCRIPTION OF EXEMPLARY EMBODIMENTS

Figure 1:
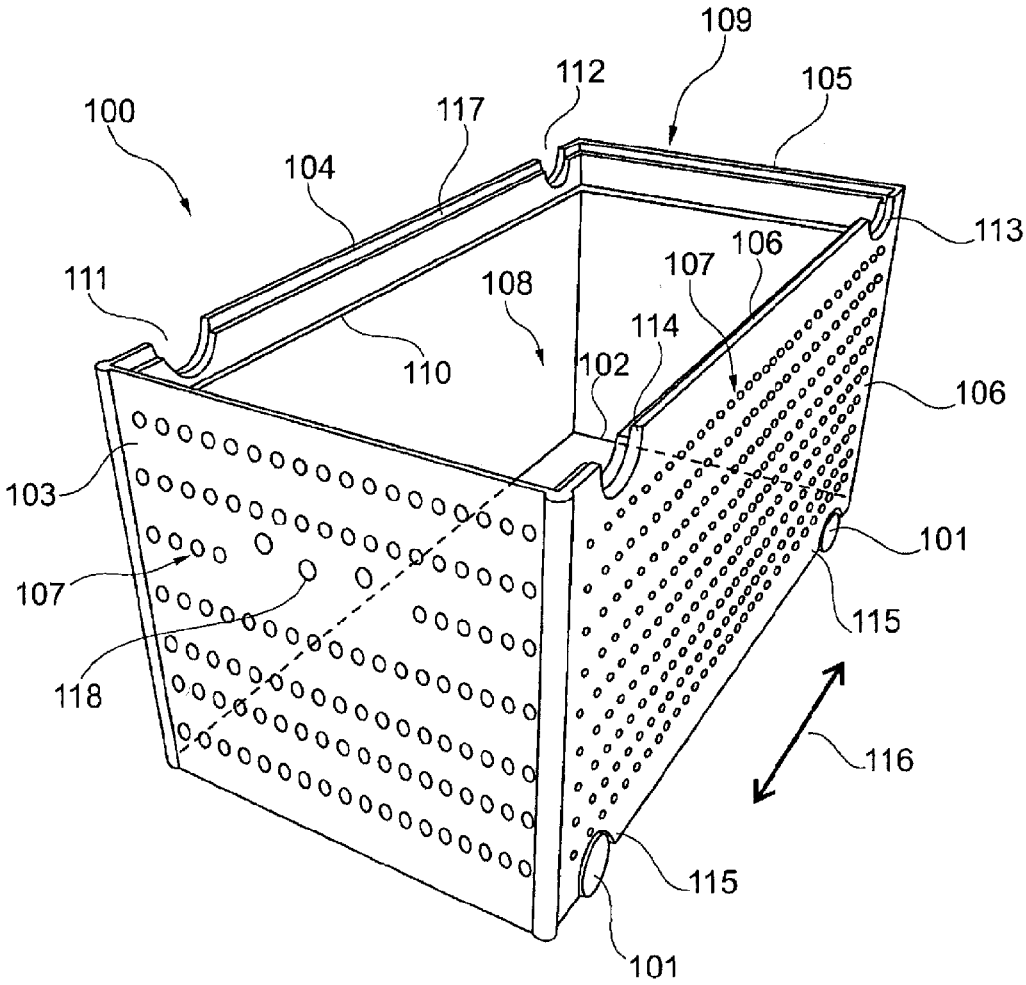
FIG. 1 shows a perspective view of a container apparatus according to an exemplary embodiment of the present invention.

The illustration in the drawings is schematic. In different drawings similar or identical elements are provided with the same reference numerals.

FIG. 1 shows a perspective view of a container apparatus 100 according to an exemplary embodiment of the present invention. The container apparatus 100 comprises four wheels 101, wherein in FIG. 1 only two wheels are visible. The container apparatus 100 further comprises a base plate 102 and a front sidewall 103, a right sidewall 104, a back sidewall 105 and a left sidewall 106. Each sidewall 103, 104, 105, 106 comprises the regular mating structure 107. The regular mating structure 107 may be interrupted by handholds 118, which in an exemplary embodiment are formed by grooves. The grooves are arranged on a circle and the size of the grooves may correspond to the size of human fingers in order to allow carrying the box 100.

The base plate 102 may be visible through the sidewall 103, 104, 105, 106 since the whole container apparatus is made of transparent material.

In FIG. 1 a rectangular base plate 102 is shown and thus, the container apparatus has the form of a rectangular box. The container apparatus 100 is made of one piece. However, the container apparatus may be made of a plurality of pieces which may be glued or welded together. In particular the base plate 102, the front sidewall 103, the right sidewall 104, the left sidewall 106 and the back sidewall 105 are made of one piece. The base plate 102 may has a circular, oval or polygonal shape.

The front sidewall 103 and the back sidewall 105 have the substantially the same dimensions and are positioned opposite to each other. Also the left sidewall 106 and the right sidewall 104 are symmetrically mounted on the upper side of the base plate 102. The upper side of the base plate 102 is the side, which is opposite to the side of the base plate, on which side the wheels 101 are mounted.

The sidewalls 103, 104, 105 and 106 form the room 108 which has an aperture 109. The form of the aperture 109 corresponds to the form of the base plate 102. The aperture 109 can be covered by a lid not shown in FIG. 1, wherein the lid is mounted in a substantially parallel position to the base plate 102 in a slot 110. The lid may be mounted on a flange 117, formed on an upper end of each sidewall 103, 104, 105, 106. Alternatively, the lid may be mounted in a slot 110.

The slot 110 is arranged on an inner side of the sidewall 103, 104, 105, 106. Inner side in this context means a side of the sidewall 103, 104, 105, 106 which is faced to the room 108. Furthermore, the container apparatus has four recesses 111, 112, 113, 114 wherein the recesses substantially have the form of a wheel 101. Thus, the recesses 111, 112, 113, 114 allow to receive at least a portion of a wheel 101 of another container apparatus which may be positioned on the top of the container apparatus 100. The top of the container apparatus 100 may be the side of the sidewalls 103, 104, 105, 106 opposite to the side of the sidewalls 103, 104, 105, 106 which side is connected to the base plate 102. The recesses 111, 112, 113 and 114 are arranged on the top side of the sidewalls 103, 104, 105, 106.

The recesses 111, 112, 113, 114 also are positioned opposite and aligned with the wheels 101 of the container apparatus 100. The sidewalls 103, 104, 105, 106 furthermore have recesses 115 for the wheels 101, which recesses 115 are also aligned with the top recesses 111, 112, 113, 114. The recesses 115 may form a fender.

The container apparatus 100 may be moved by the wheels 101 in a forward and backward direction indicated with arrow 116. The wheels 101 have a shaft or axis which is not shown in FIG. 1. Such a shaft may allow a child to sit inside the room 108 of the container apparatus for being moved with the container apparatus. The child is not shown in FIG. 1.

Figure 2:
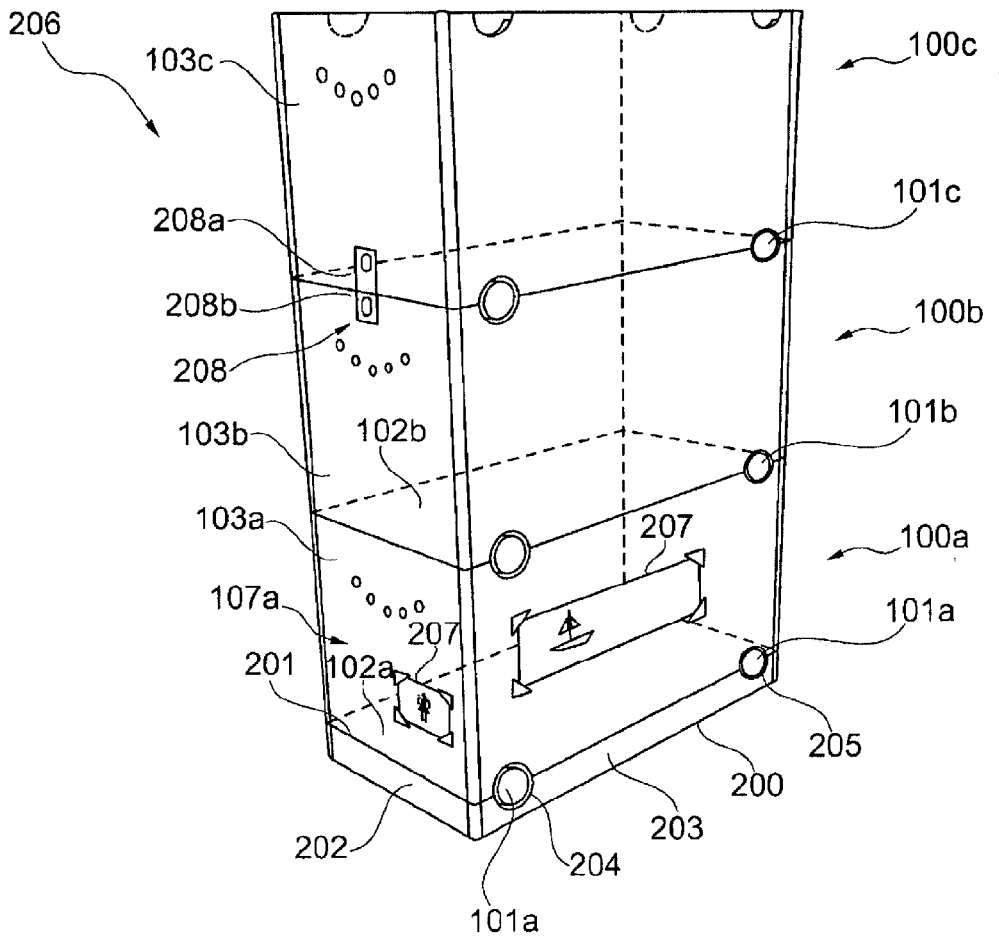
FIG. 2 shows a container assembly of a plurality of container apparatuses according to an exemplary embodiment of the present invention.

FIG. 2 shows a container assembly 206 comprising a plurality of container apparatus 100*a*, 100*b*, 100*c* according to an exemplary embodiment of the present invention.

In FIG. 2 the platform structure 200 is shown which forms the basis 200 for building the container assembly 206 by mounting the container apparatus 100*a*, 100*b*, 100*c* on the surface 201 of the sidewall 202. The platform 200 has the sidewalls 202 and 203 which are aligned with the shape of the base plate 102*a* of the first container 100*a*. Furthermore, the platform 200 comprises on an upper side recess 204, 205 for receiving at least a portion of the wheels 101*a* of the first container apparatus 100*a*. The upper side recess 204, 205 is comparable to the recess 111, 112, 113, 114 in the container apparatus 100. The platform 200 in a mounted state prevents moving of the container assembly 206 over the ground.

The first container apparatus 100*a* is positioned above the platform structure 200. The wheels 101*a* of the first container apparatus 100*a* are engaged with the sidewall 203 of the platform structure 200 in order to base a stable fundament for the container assembly 206 or tower 206.

Furthermore, FIG. 2 shows picture frames 207 of different size. The picture frames 207 are mated with the regular mating structure of the first container apparatus 100*a*. Picture frames 207 are holders which are adapted or configured to keep photos and to be mated with the mating structure 107*a* of the container apparatus 100*a*.

Even if in FIG. 2 the container apparatus 100*a*, 100*b*, 100*c* are shown of the same height, the height of the different container apparatus 100*a*, 100*b*, 100*c* may be different. The wheels 101*a*, 101*b*, 101*c* are aligned to each other. Thus, the tower 206 may form a stable construction.

In order to increase the stability on the sidewalls 103*b*, 103*c* the closure 208 is shown, which fixes the third container apparatus 100*c* on top of the second container apparatus 100*b*. The closure element 208 comprises a first portion 208*a* and a second portion 208*b* which engage to each other and which can be released in order to access the room of the container apparatus 100*b*. Even if only the closure element 208 is shown in FIG. 2 on the front walls 103*c*, 103*b* of the second and the third container apparatus 100*b*, 100*c*, every sidewall of a container apparatus 100*a*, 100*b*, 100*c* may comprise at least one of such a closure element.

The base plate 102*b* in the mounted position forms a lid for the aperture of the first container apparatus 100*a*.

Forming such a tower 206 comprising a plurality of container apparatus 100*a*, 100*b*, 100*c* and a platform 200 provides space on the sidewalls 103, 104, 105, 106, 203, for fixing pictures of the children thereon. Thus, decoration or a decorative element can be built. Such a decorative element may be installed in the living room for showing the pictures of the children.

The pictures can easily be removed and exchanged if new pictures are produced. The picture frames 207 may not have to be removed.

The tower 206 may provide enough stability in order to allow a child to sit on the top of the tower. Thus, a simulation of an airplane while flowing may be made. The stack 206 may also be covered by a lid on the highest container apparatus 100*c*. The lid is not shown in FIG. 2.

The highest container apparatus 100*c* is the container apparatus having the largest distance from the platform 200.

Figure 3:
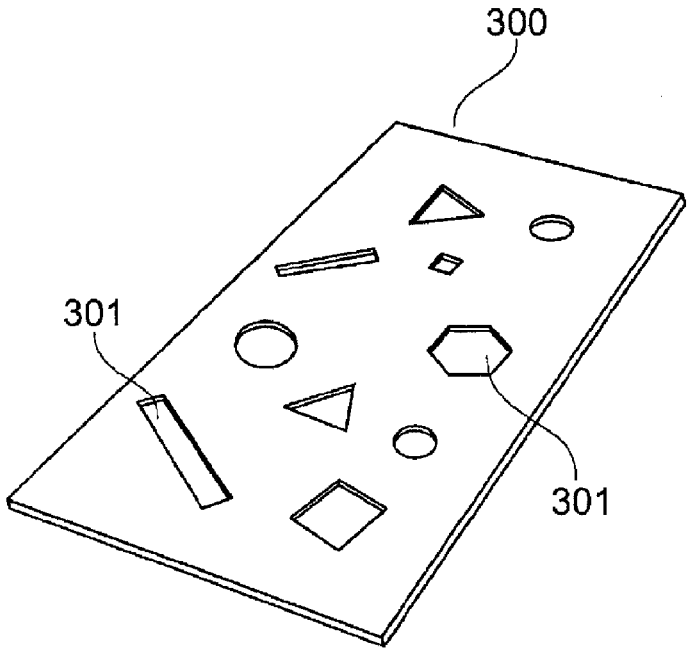
FIG. 3 shows a first lid for a container apparatus according to an exemplary embodiment of the present invention.

FIG. 3 shows a first lid 300 for a container apparatus 100, 100*a*, 100*b*, 100*c* according to an exemplary embodiment of the present invention. Each container apparatus 100 or box 100 may have a lid 300 which may be made of acryl, of plastic or of any transparent material that allows seeing the content of the box without having to open the box. The lid 300 comprises through holes 301 of different forms allowing putting items having the corresponding form inside the box when the lid 300 covers one of the container apparatus 100. The lid 300 is mounted on a container apparatus 100 by engaging with the slot 110 of a container apparatus 100. The lid 300 in FIG. 3 is shown having through holes. However, the lid 300 may also have a solid body, which is filled with material.

Figure 4:
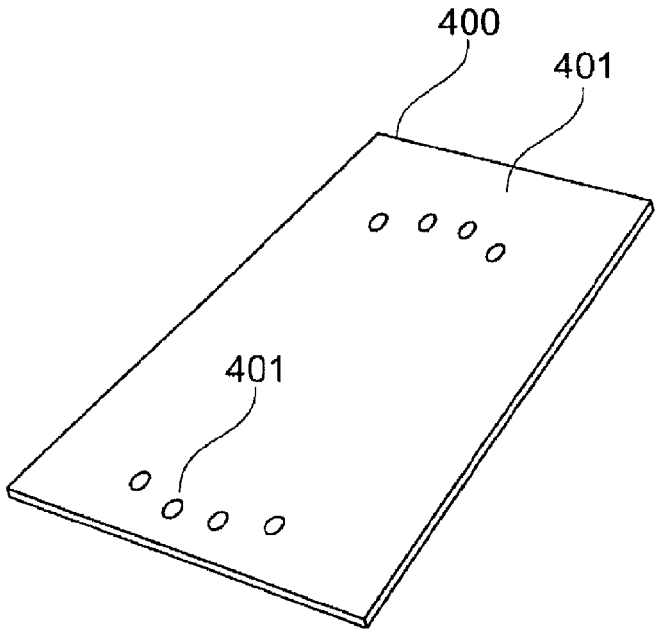
FIG. 4 shows a second lid for a container apparatus according to an exemplary embodiment of the present invention.

FIG. 4 shows a second lid 400 for a container apparatus 100 according to an exemplary embodiment of the present invention. The lid 400 comprises a plurality of grooves 401 or holes 401 which are positioned in the form of a half circle on two ends of the lid 400. The grooves 401 allow removing the lid from the box 100. For removing the lid 300, 400 from the aperture 109 of the container apparatus 100 the lid 300, 400 may have to be bended. The lid 300, 400 may be made of material having different colours in order to indicate the content of an individual container apparatus 100.

Figure 5:
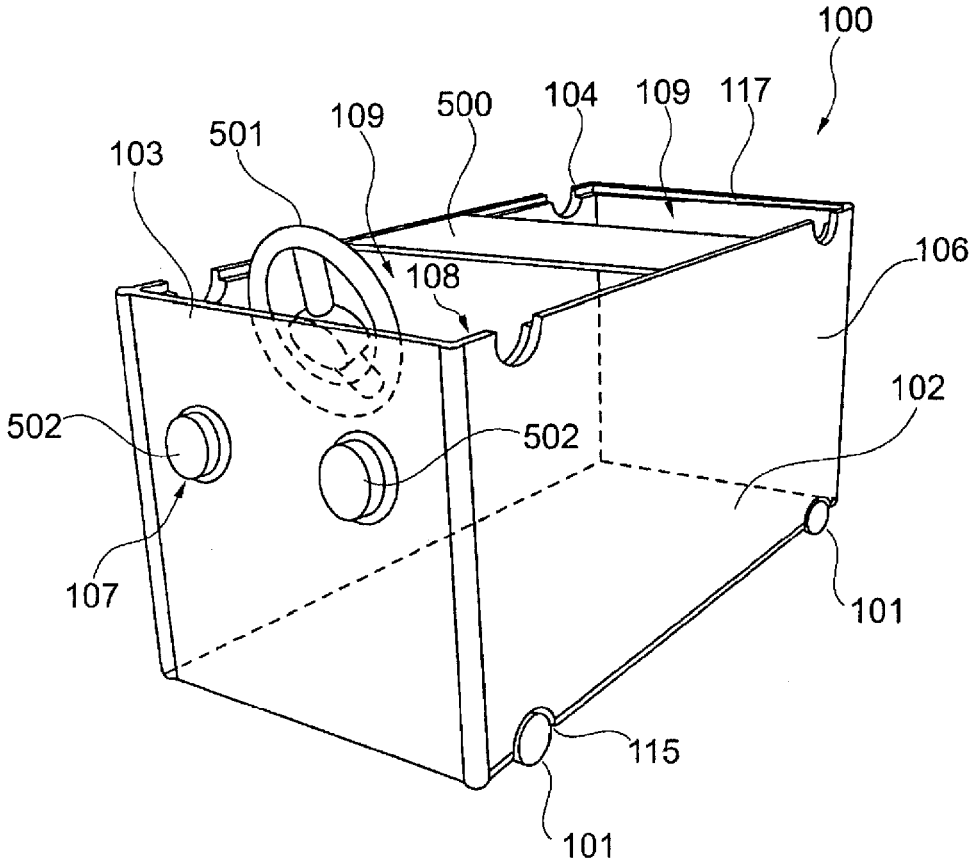
FIG. 5 shows a container apparatus comprising a lid and a steering wheel wherein the lid partially covers the aperture of the container apparatus according to an exemplary embodiment of the present invention.

FIG. 5 shows a container apparatus 100 comprising a lid 500 and a steering wheel 501 wherein the lid 500 partially covers the aperture 108 of the container apparatus 100. The lid 500 is mounted on the flange 117 of the longer sidewall 104, 106. Alternatively, the lid 500 is engaged in the slot 110 (not shown in FIG. 5) on the longer sidewalls 104, 106. Since the sidewalls 104, 106 are longer than the breath of the lid 500 covers partially the aperture 109. Thus, the lid 500 forms a seat on which a child can sit. The child may place the feet in an uncovered portion of the aperture 109 and the child may be moved by moving the container apparatus 100.

In order to increase the stability of the seat 500 a bearing or bracket for supporting the seat may be mounted between the base plate 102 of the container apparatus 100 and the seat 500. The bearing is not shown in FIG. 5. Such a bearing my be a divider for the room 108.

Furthermore, FIG. 5 shows the steering wheel 501 which is a three-dimensional forming structure arranged on a panel or shaping structure. The steering wheel 501 is engaged with the mating structure of the steering wheel to the mating structure 107 of the front sidewall 103. The mating structure 107 of the front sidewall 103 is arranged on an inner surface and on an outer surface of the front sidewall 103. The form of the mating structure 107 of the sidewall may be adapted to the form of the cladding apparatus 501, 502, in particular to the mating structure of the cladding apparatus. Thus, in FIG. 5 the mating structure 107 is covered by the cladding apparatus and the mating structure 107 is not visible.

Furthermore, an other cladding apparatus 502 which forms a flashing indicator is mounted on the regular mating structure 107 of the front sidewall 103. The cladding apparatus 501, 502 may be put in the room 108 of the container apparatus 100 after using the cladding apparatus 501, 502. For putting the cladding apparatus 501, 502 inside the room 108 the cladding apparatus is released from the mating structure 107. The cladding apparatus may comprise a hinge in order to fold the cladding apparatus.

Figure 6:
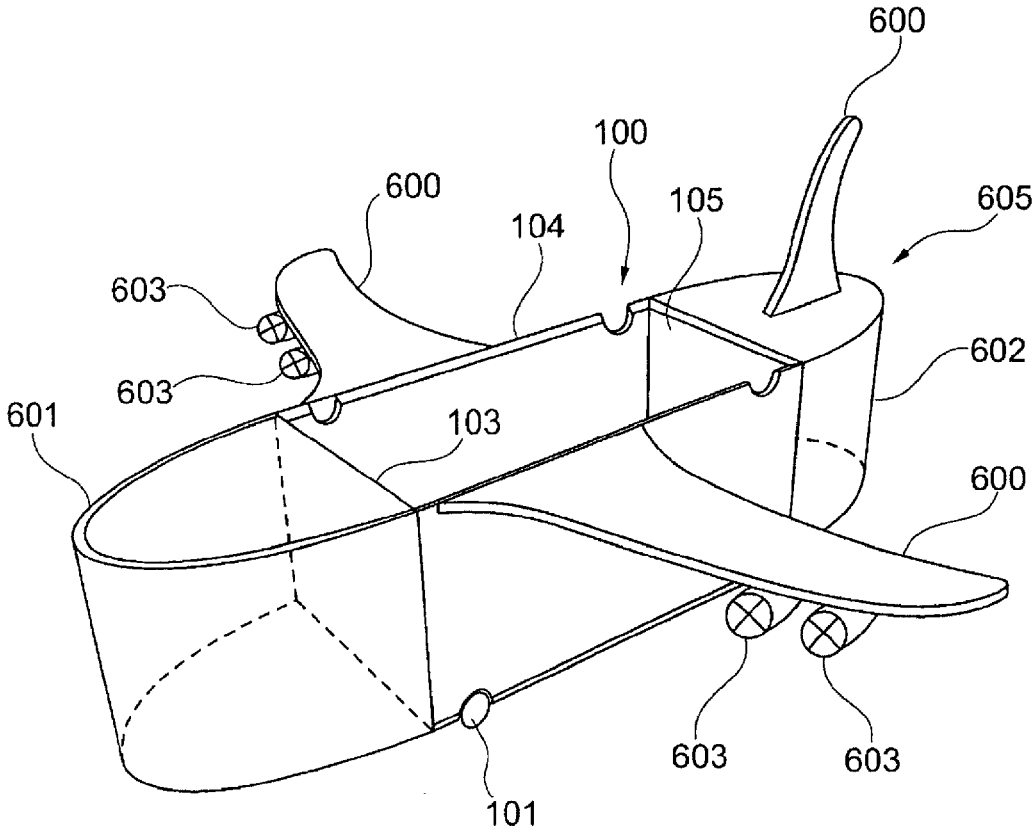
FIG. 6 shows a container apparatus with a shaping structure forming an airplane according to an exemplary embodiment of the present invention.

FIG. 6 shows a container apparatus 100 comprising different cladding apparatus comprising a three-dimensional forming structure 603. The cladding apparatus comprises the three-dimensional forming structure 603 and the three-dimensional structures 600, 601, 602. The three-dimensional structures 600 mounted on the left and right sidewalls 106, 104 form wings 600 of an airplane comprise a propeller 603.

On the front sidewall 103 of the container apparatus 100 a three-dimensional structure 601 is mounted. The three-dimensional structure 601 connected with the front sidewall 103 of the container apparatus 100 forms a bow 601 of an airplane.

On the back sidewall 105 by engaging the mating structure of the container apparatus 100 and of the three-dimensional structure 602 a tail of an airplane 602 is built.

By combining the container apparatus 100 and the three-dimensional structures 600, 601, 602 the airplane 605 is built hiding the rectangular structure of the container apparatus 100. In particular a model of a real object e.g. an airplane is built. Thus, the cladding apparatus amends the shape of the container apparatus 100 in order to mask or to hide the shape of the container apparatus 100.

Figure 7:
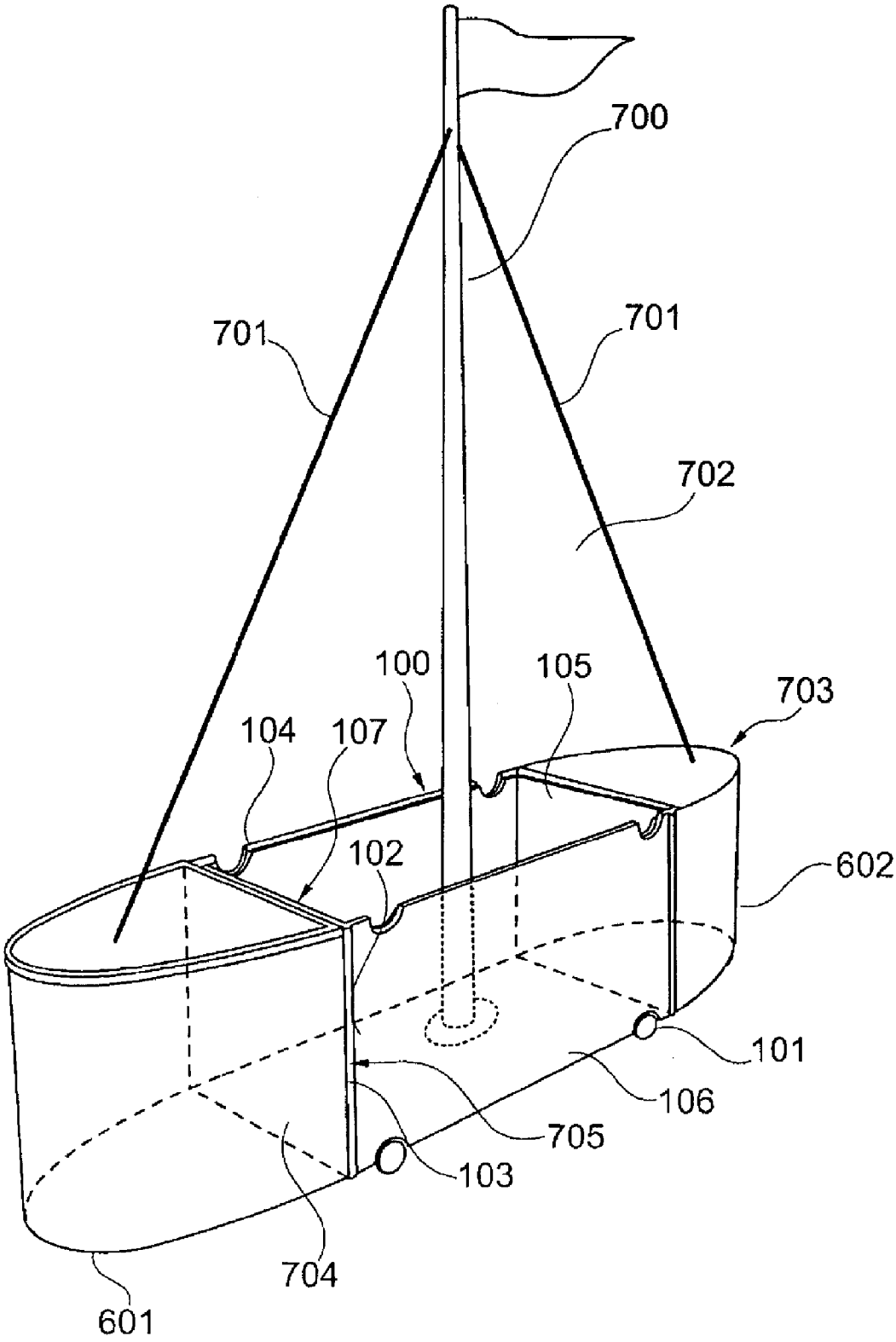
FIG. 7 shows a container apparatus comprising a plurality of shaping structures for forming a boat according to an exemplary embodiment of the present invention.

FIG. 7 shows the three-dimensional structures 601, 602 and the rod 700. Ropes 701 connect the top of rod 700 to the three-dimensional structure 601, 602. Attached to the ropes 701 the sail 702 is mounted. The sail 702 may be made of tissue. The container apparatus 100 in combination with the cladding structures 601, 602, 700 form a boat 703.

The three-dimensional structures 601, 602 may be the same used for building the airplane 605. Thus, painting the three-dimensional structures 601, 602 like an airplane or like a boat may distinguish between an airplane and a boat.

The three-dimensional structure 601, 602 may be particularly formed in order to more realistically rebuild the form of a boat bow and a boat stern. The sail 702 may be painted and designed by the children.

The rod 700 may be mated to one of the mating structure 107 of the sidewall 104, 103, 106, 105 or by a separate mating structure which may be positioned on the base plate 102, the mating structure is not shown in FIG. 7. Thus, a cladding apparatus 700 may extend perpendicular to the base plate 102 or floor 102 of the container apparatus.

The form of the front side 103 may be adapted to a corresponding side 704 of a three-dimensional structure 601. Thus a discontinuity on the contact surfaces 705 between the three-dimensional structure 601 and the container apparatus 100 may be prevented.

Figure 8:
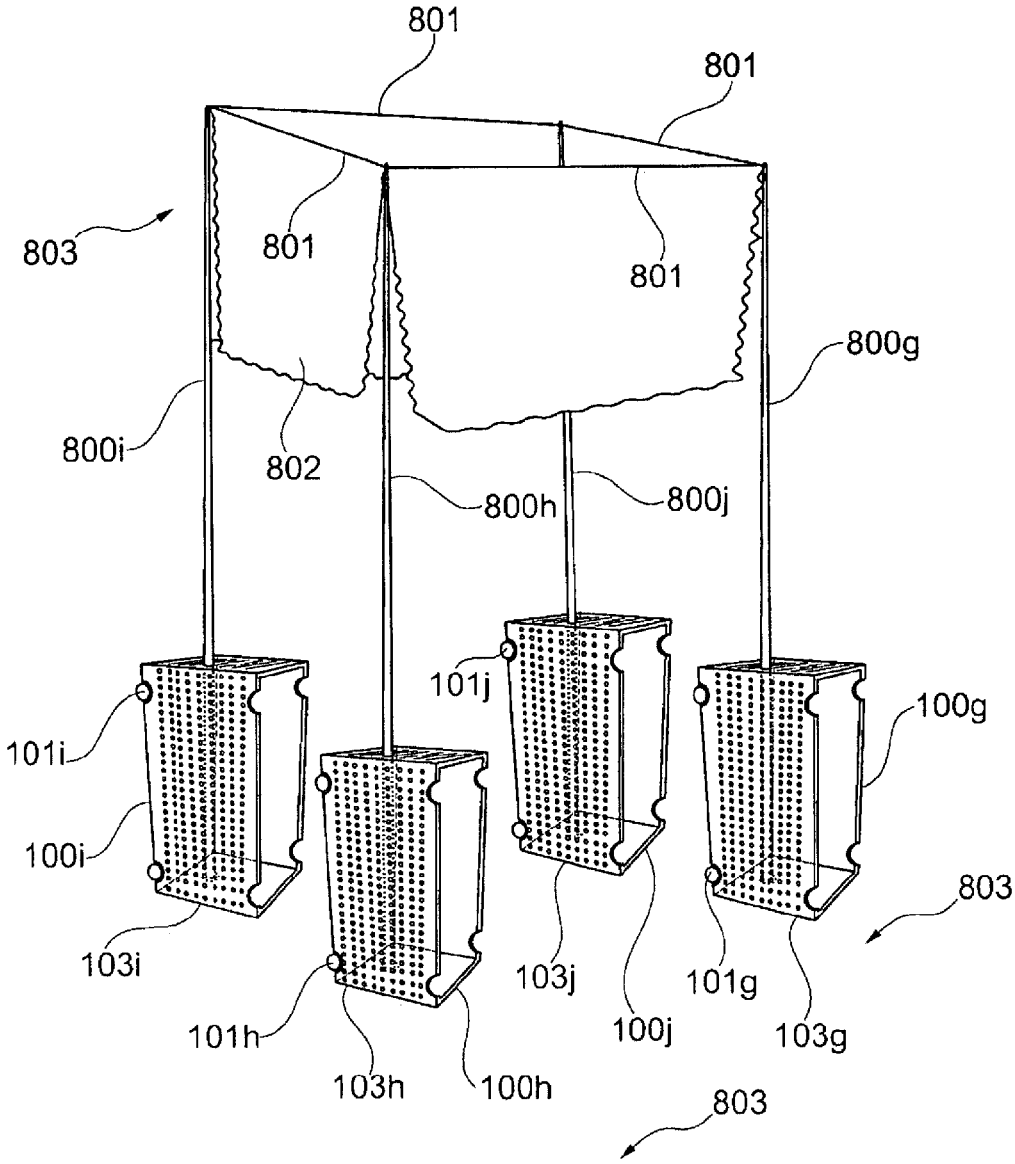
FIG. 8 shows four container apparatus each comprising a rod for mounting of sheets according to an exemplary embodiment of the present invention.

FIG. 8 shows four container apparatus 100*g*, 100*h*, 100*i*, 100*j* and four rods 800*g*, 800*h*, 800*i*, 800*j*. Any one of the rods 800*g*, 800*h*, 800*i*, 800*j* has two ends. One end is mounted to the container apparatus 100*g*, 100*h*, 100*i*, 100*j* in particular to an inner surface of a side wall 103*i*, 103*j*, 103*g*, 103*h*. The other end, which is a distant end of the rod 800*i*, 800*j*, 800*g*, 800*h* in relation to the container apparatus, is connected to ropes 801. On the ropes 801 the sheets 802 are mounted. The container apparatus 100*g*, 100*h*, 100*i*, 100*j* in combination with the rods 800*g*, 800*h*, 800*i*, 800*j* may form a skeleton or a frame work for a tea pavilion 803 or for a tent 803. The container apparatus 100*g*, 100*h*, 100*i*, 100*j* are positioned with the front side 103*g*, 103*h*, 103*i*, 103*j* on the ground 803. The front side of the container apparatus 100*g*, 100*h*, 100*i*, 100*j* may form a platform for the tea pavilion 803. Thus, the wheels 101*g*, 101*h*, 101*i*, 101*j* are not in direct contact with the ground 803.

Figure 9:
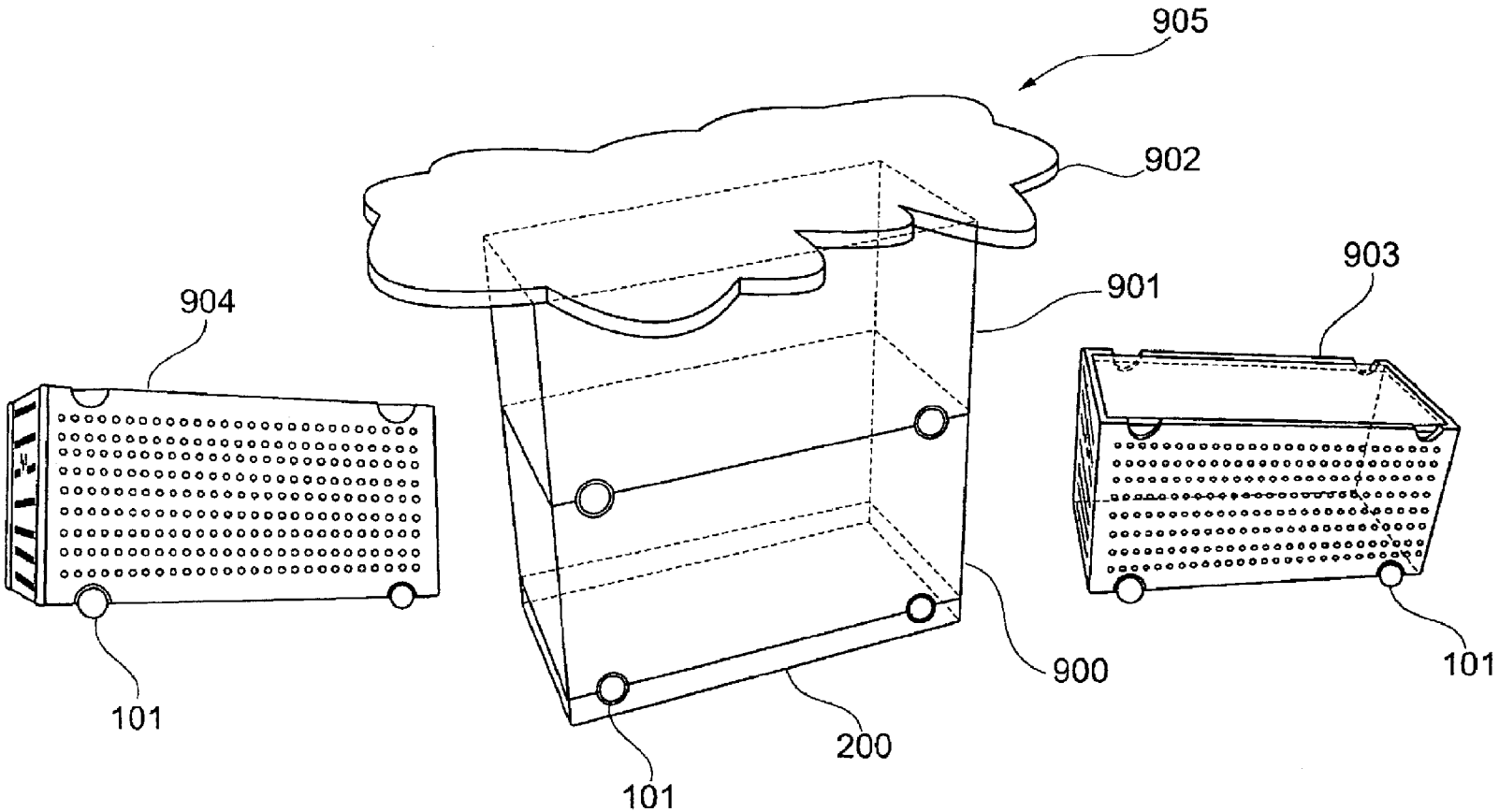
FIG. 9 shows a plurality of container apparatus and a lid forming a table and seats according to an exemplary embodiment of the present invention.

FIG. 9 shows a first container apparatus 900 and a second container apparatus 901 which form a stack. On top of the stack the table plate 902 or desk top 902 is positioned. The table plate 902 may be a lid 902, which extends over the sidewall of the container apparatus 900, 901.

Further container apparatus 903, 904 are provided as seats for sitting at the table 905. The container apparatus 903, 904 have solid lids, without any through holes. Thus, the lid covers the whole aperture. The form of the table plate 902 or lid 902 has the form of a flower or a cloud. The container apparatus 903, 904 comprise a lid 902 where a child can sit upon. For providing more comfort a cushion can be put on top of the container apparatus 903, 904.

Figure 10:
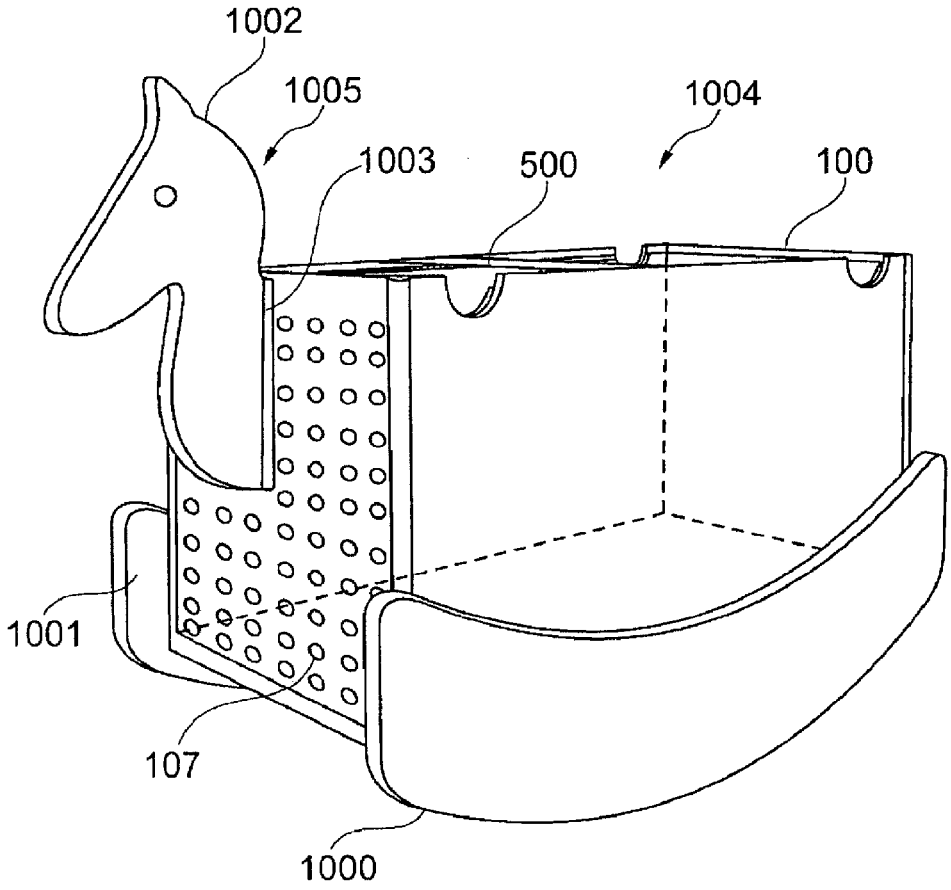
FIG. 10 shows a container apparatus comprising a plurality of forming structures and skids forming a rocking horse according to an exemplary embodiment of the present invention.

FIG. 10 shows the container apparatus 100 with mounted skids 1000, 1001 forming a rocker 1004. A rocking horse 1004 may be formed by providing a cladding apparatus 1005 comprising a shaping structure 1002 in the form of a horse face. The cladding apparatus 1005 is mated with the mating structure 1003 of the cladding apparatus 1005 to the mating structure 107 of the container apparatus 100. A child may sit on the lid 500. The wheels of the container apparatus are not visible. The wheels may be engaged with the skid 1000, 1001.

Figure 11:
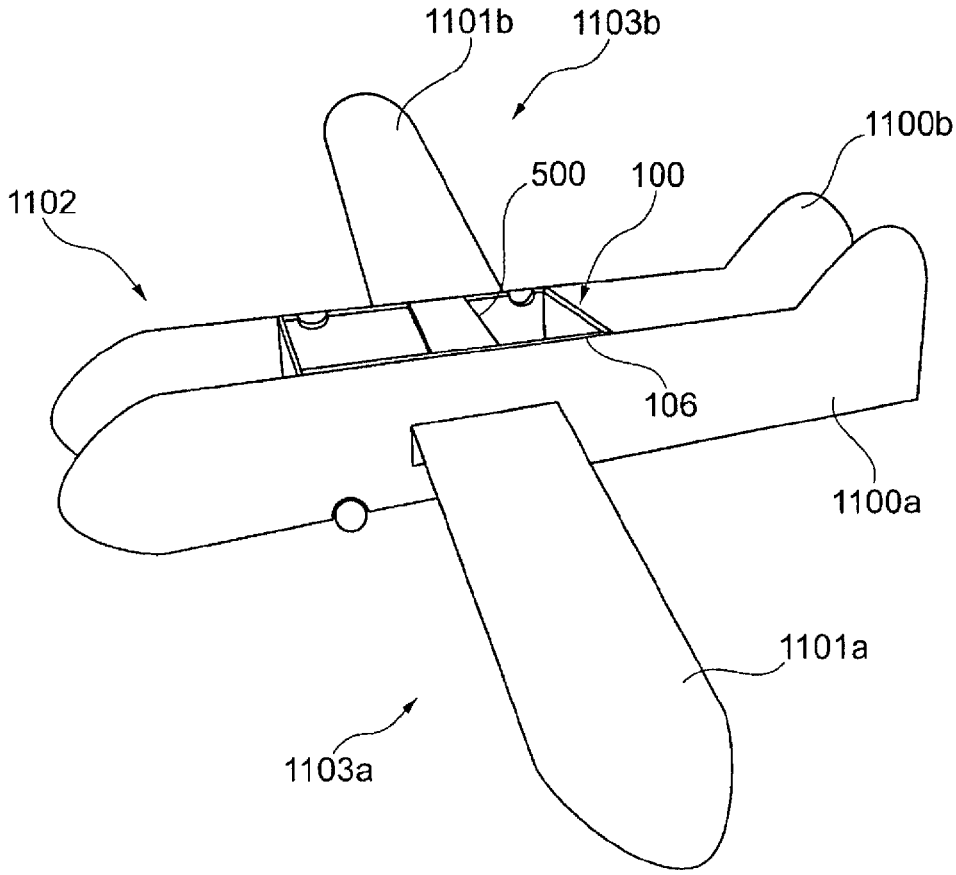
FIG. 11 shows a container apparatus comprising a plurality of shaping structures according to an exemplary embodiment of the present invention.

FIG. 11 shows a container apparatus 100 comprising a plurality of cladding apparatus having a two-dimensional shaping structure 1100*a*, 1100*b* and three-dimensional structure 1101*a*, 1101*b*. The shaping structure or the container apparatus may also comprise a plurality of ornaments. The shaping structure 1100*a*, 1100*b* may be a panel in the form of a side view of an airplane. Thus, the shaping structure 1100*a*, 1100*b* may be two-dimensional.

The container apparatus 100 on the sidewall 106 is connected to a cladding apparatus 1103*a*, 1103*b* having a shaping structure 1100*a*, 1100*b* in the form of an airplane. The shaping structure 1100*a*, 1100*b* is mounted on the sidewall 106 of the container apparatus 100 by mating a mating structure (not shown in FIG. 11) of the container apparatus 100 with the mating structure of the shaping structure 1100*a*, 1100*b*.

Furthermore, a cladding apparatus comprising a three-dimensional structure 1101*a*, 1101*b* in the form of a wing is shown. Symmetrically to the cladding apparatus 1103*a* comprising the structures 1100*a*, 1101*a* on the other sidewall 104 of the container apparatus 100 the corresponding cladding apparatus 1103*b* comprising the structures 1100*b*, 1101*b* is shown. By using the cladding structures 1103*a*, 1103*b* the form of the container apparatus 100 is hidden. Seen from a side view the cased container apparatus 1102 has the shape of an airplane. A child may sit on the lid 500 and be moved with the container apparatus 100.

Figure 12:
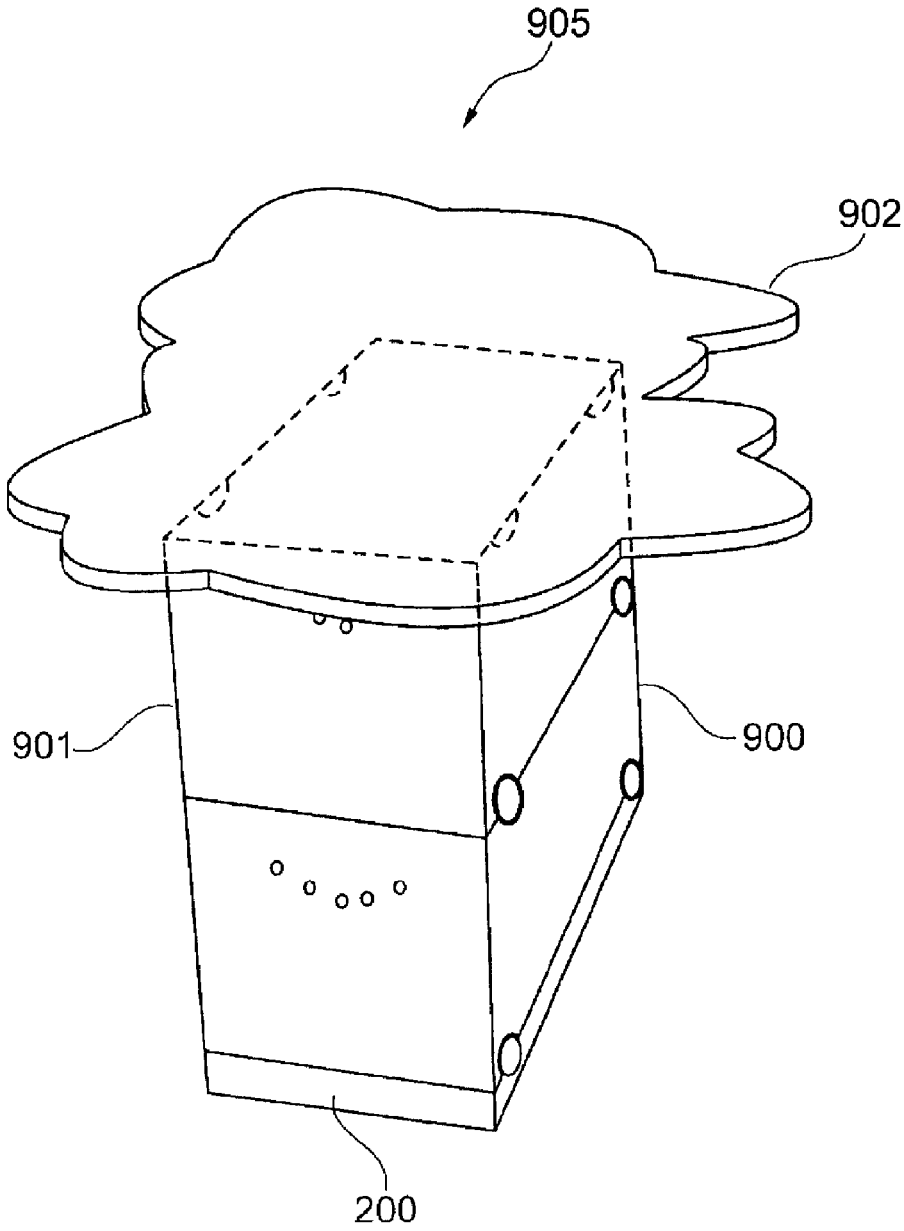
FIG. 12 shows a further perspective view of the table of FIG. 9 according to an exemplary embodiment of the present invention.

FIG. 12 shows a further perspective view of the table 905 of FIG. 9 according to an exemplary embodiment of the present invention.

Figure 13:
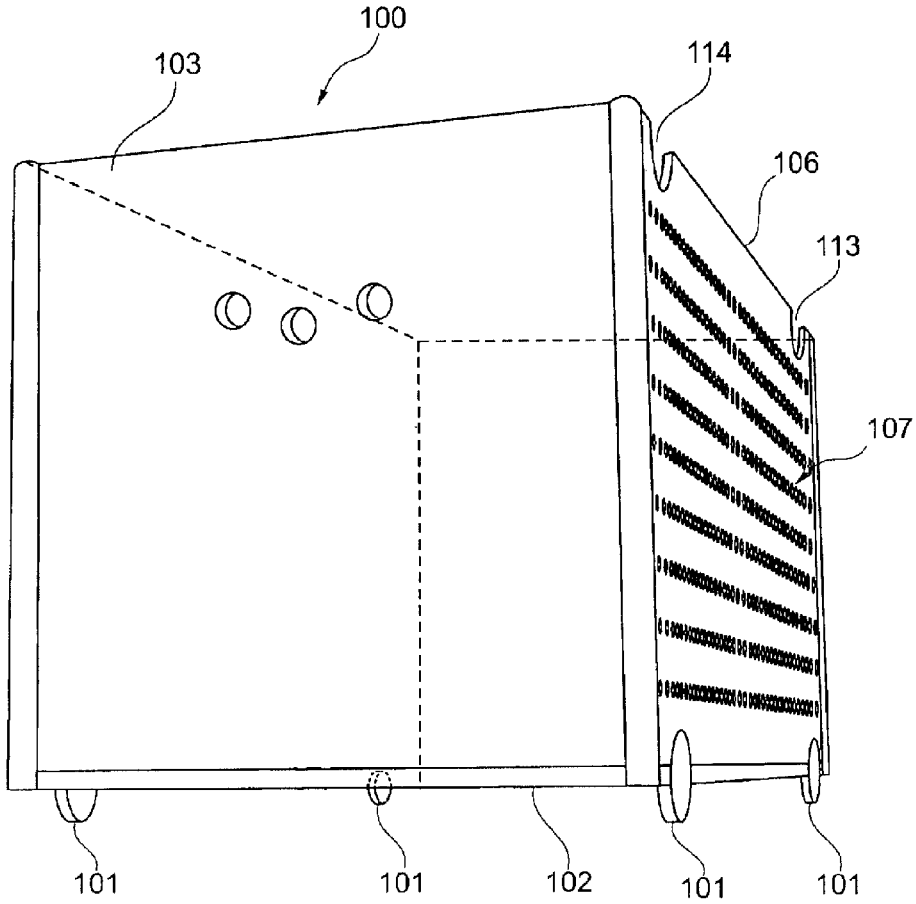
FIG. 13 shows a perspective front view of a container apparatus according to an exemplary embodiment of the present invention.

FIG. 13 shows a perspective front view of the container apparatus 100 according to an exemplary embodiment of the present invention. In FIG. 13 all the four wheels 101 are visible. Also the base plate 102 is shown, which has a thickness which may correspond to the weight of a child. The thickness may be dimensioned to carry a weight up to 10 kg, up to 15 kg, up to 20 kg, up to 30 kg or up to 50 kg. FIG. 13 also shows that only a selection the sidewalls comprise a mating structure 107. In FIG. 13, the left side wall 106 comprises the mating structure 107.

Figure 14:
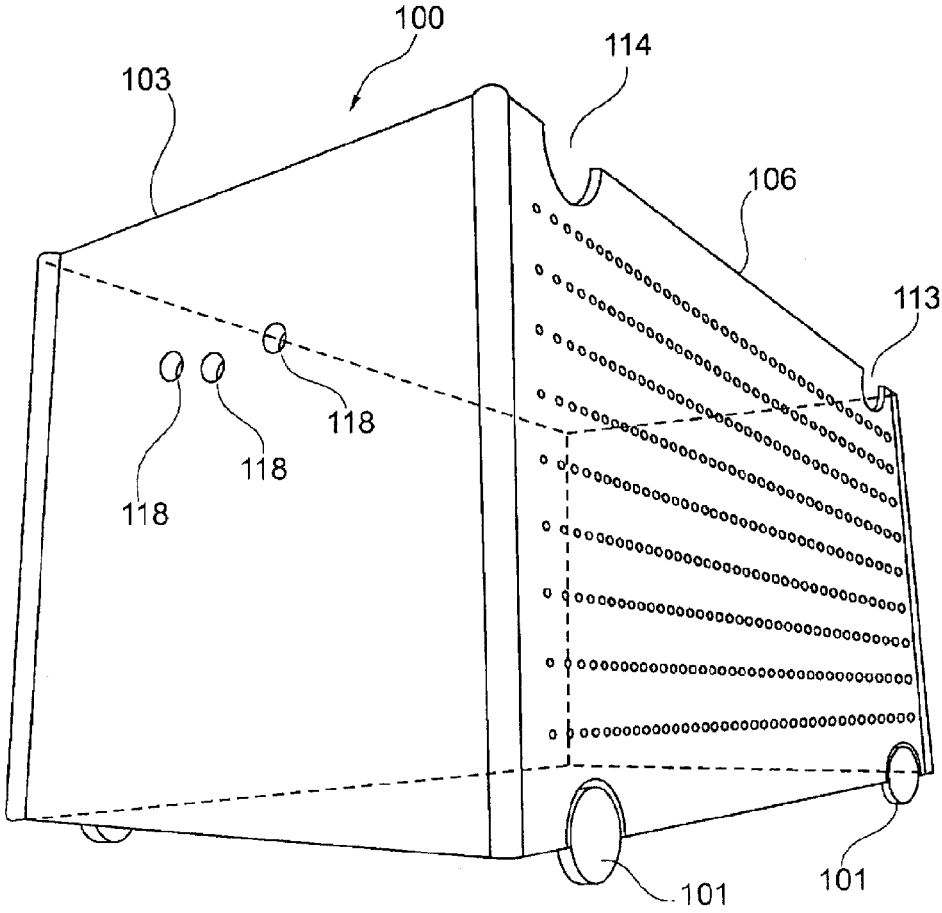
FIG. 14 shows a further perspective front view of a container apparatus according to an exemplary embodiment of the present invention.

FIG. 14 shows a further perspective front view of the container apparatus 100 according to an exemplary embodiment of the present invention.

Figure 15:
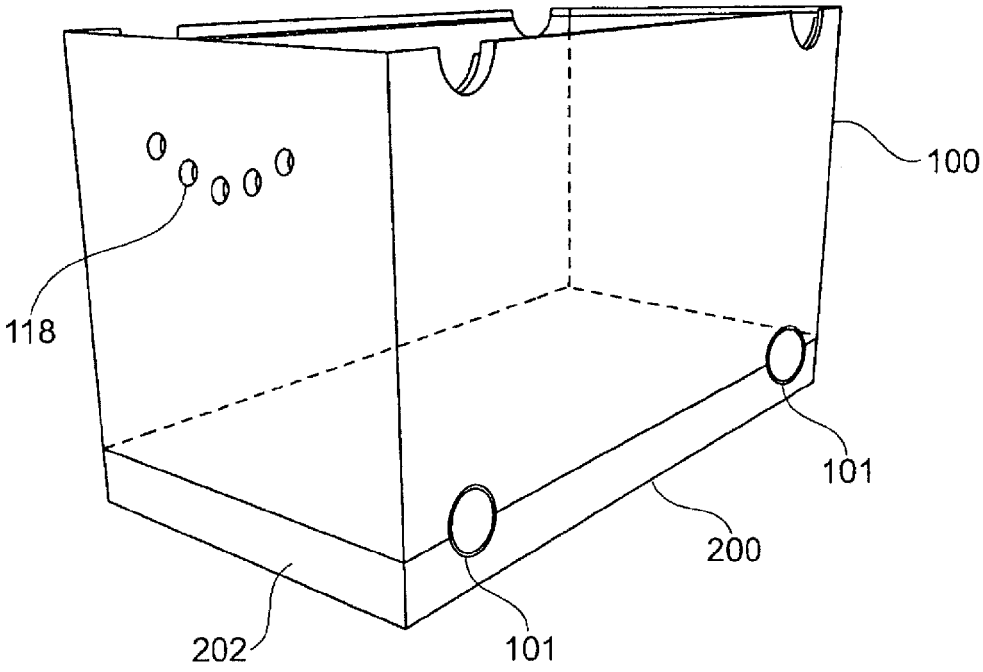
FIG. 15 shows a container apparatus without a lid mounted on a platform according to an exemplary embodiment of the present invention.

FIG. 15 shows a container apparatus 100 without a lid mounted on a platform 200 according to an exemplary embodiment of the present invention.

Figure 16:
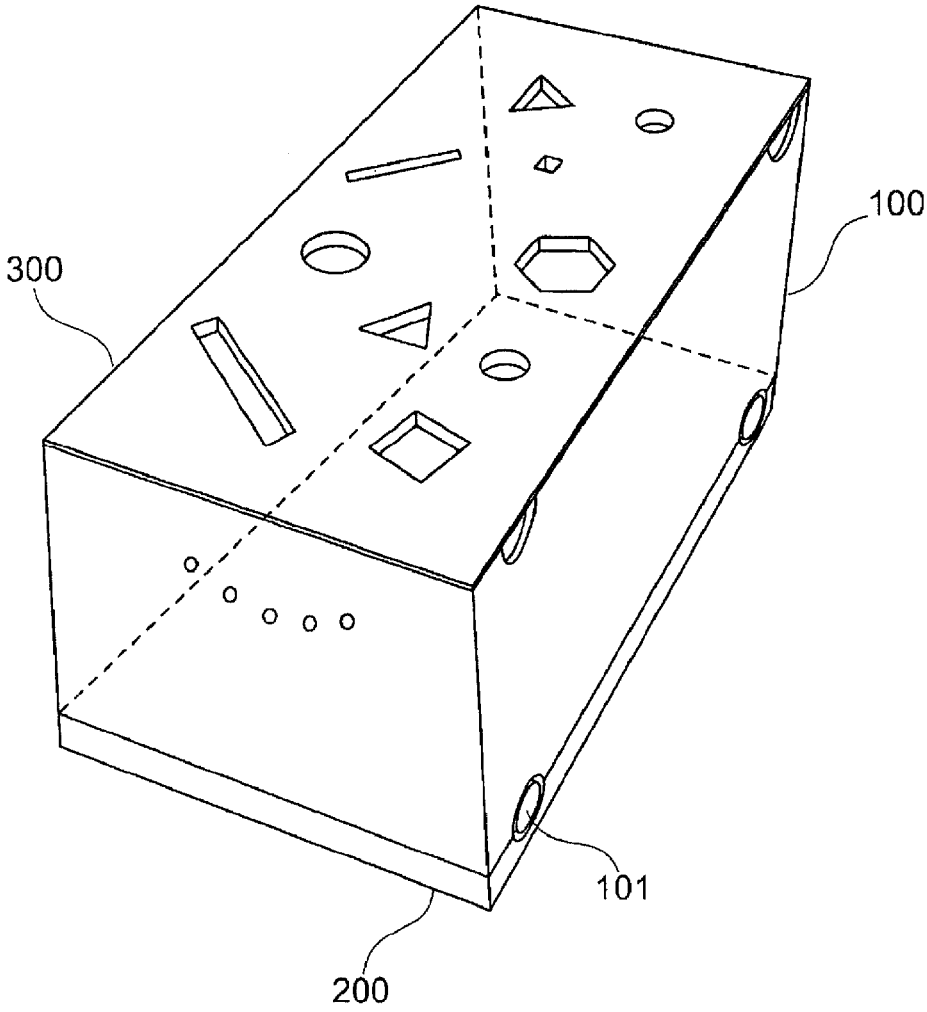
FIG. 16 shows a container apparatus covered by a lid having through holes according to an exemplary embodiment of the present invention.

FIG. 16 shows a container apparatus 100 covered by a lid 300 having through holes according to an exemplary embodiment of the present invention.

Figure 17:
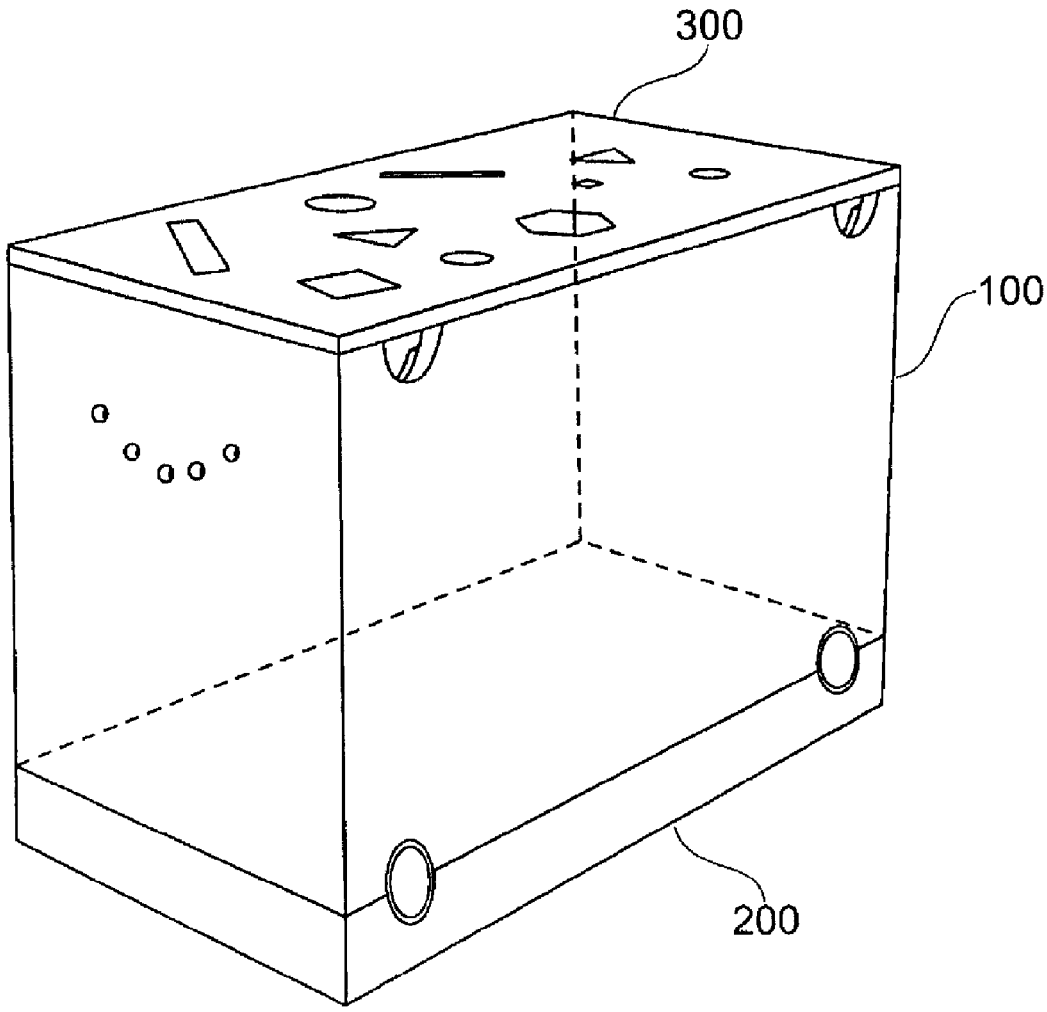
FIG. 17 shows a perspective side view of a container apparatus covered by a lid according to an exemplary embodiment of the present invention.

FIG. 17 shows a perspective side view of a container apparatus 100 covered by a lid 300 according to an exemplary embodiment of the present invention.

Figure 18:
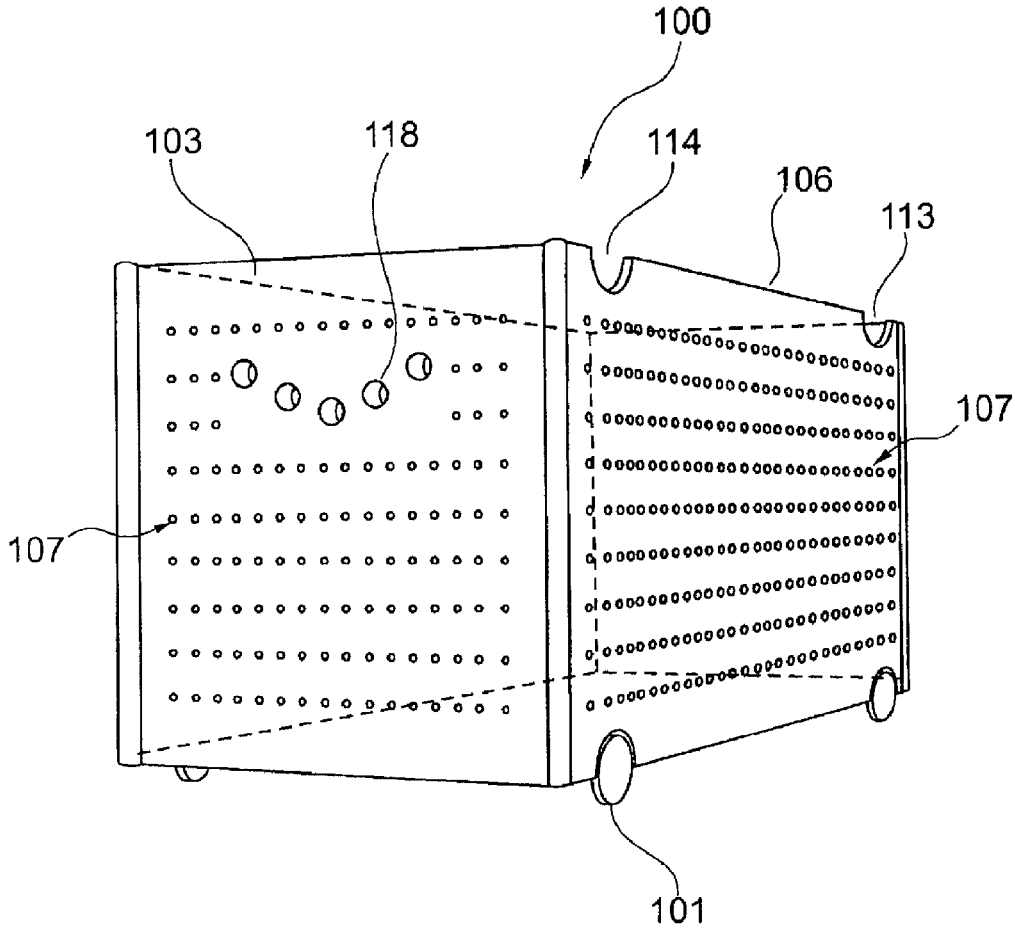
FIG. 18 shows a further perspective front view of a container apparatus with an open aperture according to an exemplary embodiment of the present invention.

FIG. 18 shows a further perspective front view of a container apparatus 100 with an open aperture according to an exemplary embodiment of the present invention.

Figure 19:
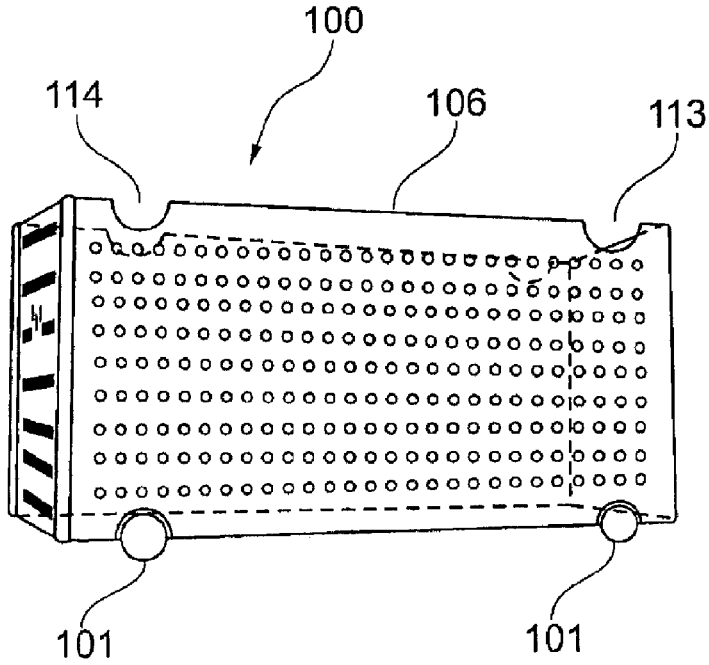
FIG. 19 shows a further perspective side view of a container apparatus according to an exemplary embodiment of the present invention.

FIG. 19 shows a further perspective side view of a container apparatus 100 according to an exemplary embodiment of the present invention.

Figure 20:
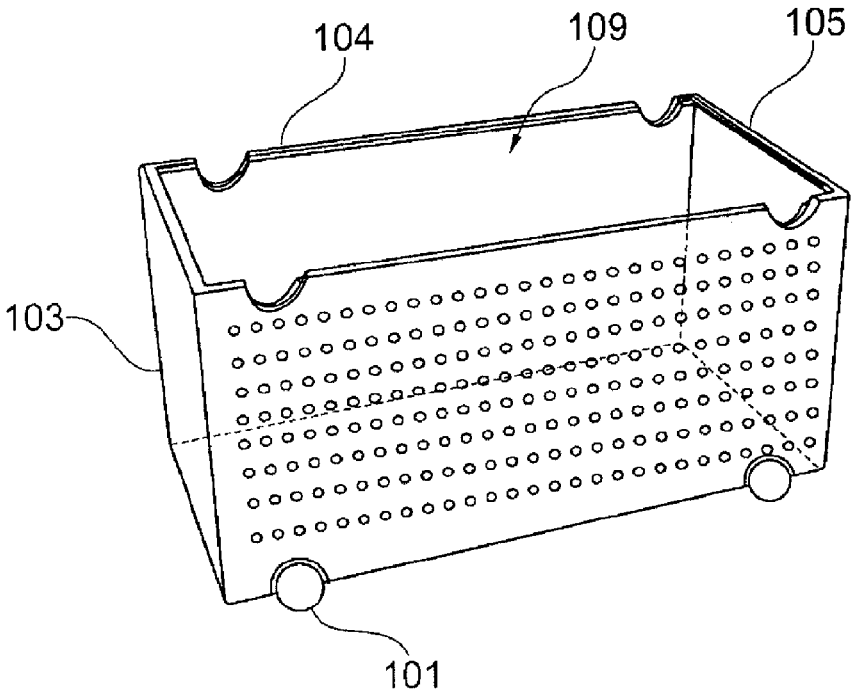
FIG. 20 shows a perspective top view of a container apparatus with an open aperture according to an exemplary embodiment of the present invention.

FIG. 20 shows a perspective top view of a container apparatus 100 with an open aperture 109 according to an exemplary embodiment of the present invention.

Figure 21:
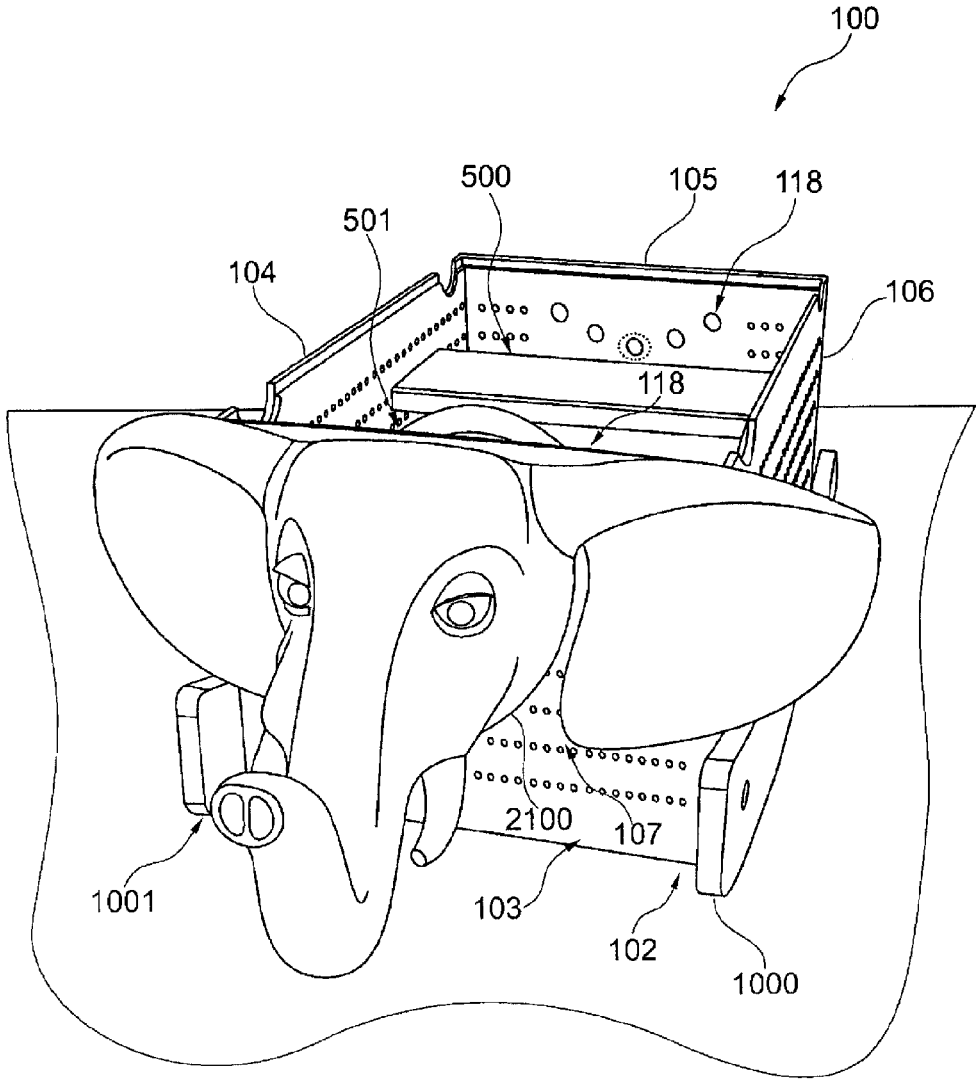
FIG. 21 shows a perspective front view of a container apparatus 100 with mounted skids forming a rocker according to an exemplary embodiment of the present invention.

FIG. 21 shows a perspective front view of a container apparatus 100 with mounted skids forming a rocker according to an exemplary embodiment of the present invention.

The skids 1000, 1001 may be mounted using the regular mating structure 107 of the container 100. The regular mating structure 107 may be installed on at least one of the front side wall 103, the base plate 102, the right side wall 104, the left side wall 106 and the back side wall 105.

In an example, the skids 1000, 1001 may be mounted on at least one wheel 101 of the wheels 101 of the container apparatus. In a further example, the skids 1000, 1001 may be mounted on the axis of the wheels 101, after removing the wheels. Therefore, the wheels may be mountable and/or removable to the axis by a snap fit closure. The wheels 101 and the axis are not shown in FIG. 21. In yet another example the skids 1000, 1001 may be mounted in the recesses 115 of the container apparatus 100. The recesses 115 are not shown in FIG. 21.

As further shown in FIG. 21 the lid 500 may be mounted on one of the mating structures 107 of the side walls 103, 104, 105, 106. The lid may be folded for mounting the lid 500 to the side wall. The lid 500 may have a mating structure on the surfaces which surfaces contact the sidewalls 104, 106. In another example the lid 500 may be mounted in a slot of the container apparatus. The lid may use for being mounted inside the container apparatus the combination of the slot and of the mating structure 107. This, combination of mounting facilities may increase the stability.

The cladding apparatus 501, for example a steering wheel 501 is mounted on the regular mating structure 107. However, the steering wheel 501 is mounted on that side of the sidewall 103, 104, 105, 106 facing to the interior of the container apparatus 100.

The steering wheel 501 can alternatively be mounted on the circularly arranged handholds 118, which in an example are through holes through the front side wall 103.

In an example the mating structure 107 and the handholds 118 are circular openings which may have different diameter. Thus, cladding apparatuses may exist configured to be mountable on the handholds 118 and other cladding apparatuses may exist configured to be mountable on the mating structure 107.

In another example the mating structure 107 in combination with the handholds 118 form the mating structure 107. Thus, the mating structure may comprise a regular mating structure and handholds.

In the example of FIG. 21 a cladding apparatus 2100, in particular the shaping structure of the cladding apparatus 2100, has the shape of an elephant head. The head may be a three dimensional shaping structure giving the impression for a child sitting in or riding on an elephant when the child sits in the container apparatus 100.

The mating structure of the cladding apparatus 2100 is not shown in FIG. 21. This mating structure is arranged on a flat backside of the cladding apparatus 2100. This flat backside faces in a mounted position to the outer side of the front side wall 103, such that the mating structure 107 of the front side wall can be engaged with the mating structure on the flat backside of the cladding apparatus 2100. The surface of the backside of the cladding apparatus 2100 is smaller than the surface of the front side wall 103. This may allow positioning the cladding apparatus at a plurality of positions of the front side wall 103. For example the cladding apparatus 2100 may be positioned in a mid position or in the middle position of the front side wall 103. For positioning the cladding apparatus 2100 in a mid position, the handholds may be utilized as a guide, as a mark or as a lead.

Figure 22:
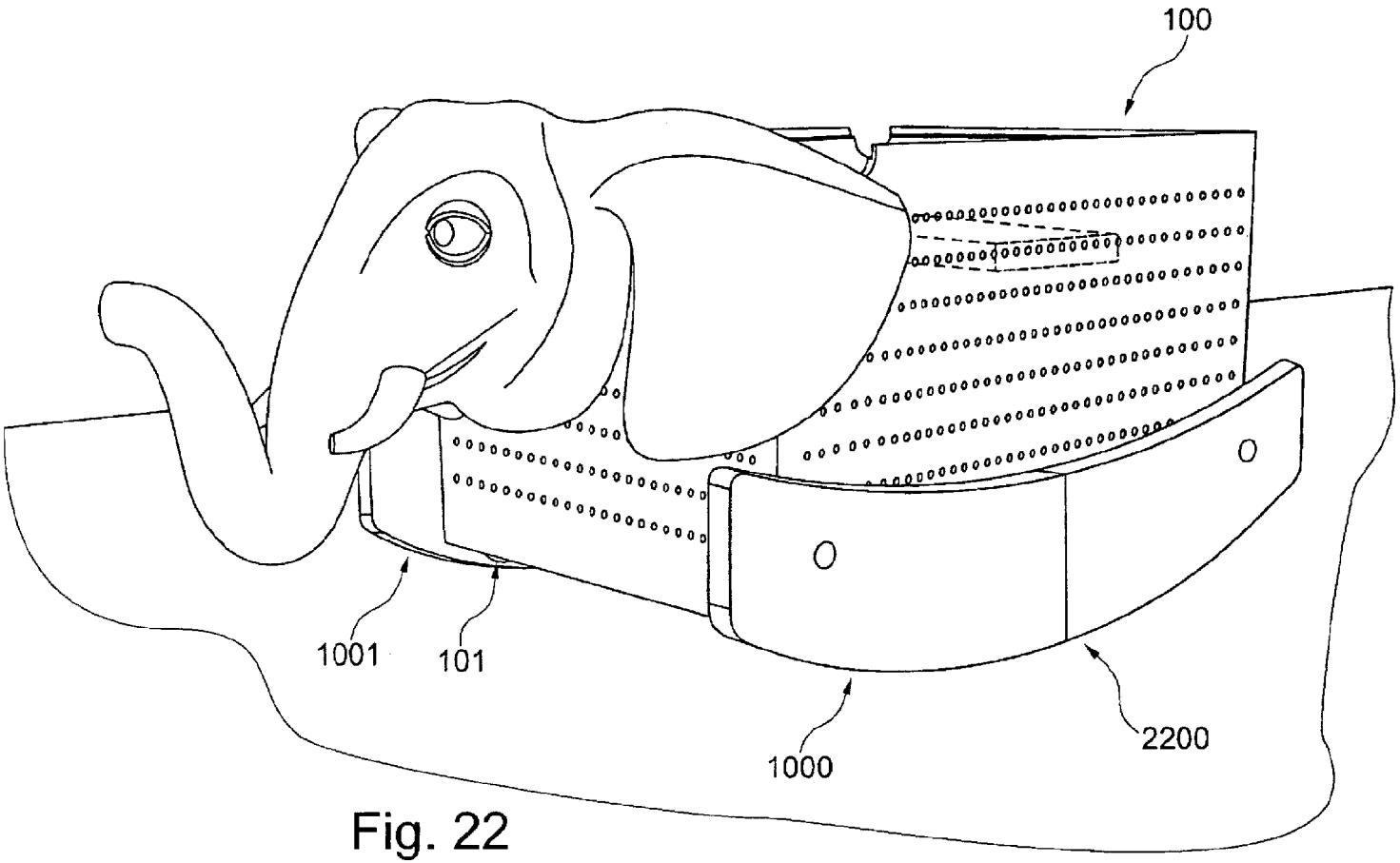
FIG. 22 shows a perspective side view of the container apparatus of FIG. 21 according to an exemplary embodiment of the present invention.

FIG. 22 shows a perspective side view of the container apparatus of FIG. 21 according to an exemplary embodiment of the present invention.

FIG. 22 shows how the skid 1001 is mounted to the wheel 101 of the container apparatus 100. The skid 1001, 1000 can be used to rock or to swing the container apparatus 100.

The skid 1001, 1000 may be separable or foldable at a joint 2200. The skid may have a hinge or a pivot in order to fold the skid 1001, 1000 at the joint. Folding the skid 1000, 1001 may allow placing the skid inside the container apparatus for stowing reasons. At the joint 2200 the skid may comprise the mating structure.

In an example the wheels 101 of the container apparatus 100 or the wheels of the cladding apparatus may be driven by a motor, e.g. by an electro motor. Such a drive may allow moving the container apparatus over the ground. The electromotor, in particular the wheels driven by the electromotor may be used to move a weight or a pendulum in a regular movement. This may allow driving the rocking horse or rocking or swinging the container apparatus 100. This may allow using the container apparatus 100 as a bassinet for a baby.

The drive can move the container apparatus back and forward over the ground. The drive may be remotely controlled, e.g. with the steering wheel or via buttons on the steering wheel 501. The steering wheel 501 may also be adapted to allow changing a direction of a movement of the container apparatus 100. For example by rotating the steering wheel the direction may be changed. For changing the direction of moving the container apparatus the wheels 101 may be driven in different rotation directions. For example the container apparatus may comprise a controller for controlling the direction of the rotation of the wheels 101. A controller and/or a power supply may be adapted to fit inside a base plate.

In an example the container apparatus may be moved between at least two end points or stop points automatically. In other words, the container apparatus may be moved in one direction for a certain duration of time and on arriving the stop point, the direction may be changed heading the second stop point. Once the second stop point may be reached the direction is changed again.

For driving the electromotor a battery may be mounted in the container apparatus 100. The battery can be used for driving the flashing indicator or the propeller 603 or other three-dimensional structures. In case a battery or another power supply is utilised, a conductive attaching device or a conductive mounting structure may be utilised in the mating structure 107. Thus, open cables may be prevented. In an example, the cables are integrated in the sidewall 103, 104, 105 and are led to the conductive attaching device, attachment device or mounting apparatus. E.g., a knop and a hole make a conductive contact.

Thus, at least one attaching device or at least one attachment device of the mating structure is made of conductive material.

Thus, the mating structure may be seen as a plug and a socket for electrical devices.

In another case, where the side walls may be made of transparent material, lights may be integrated inside the sidewalls. The lights may be driven by the power supply or battery. Different colours of lights may be utilised inside different sidewalls.

Figure 23:
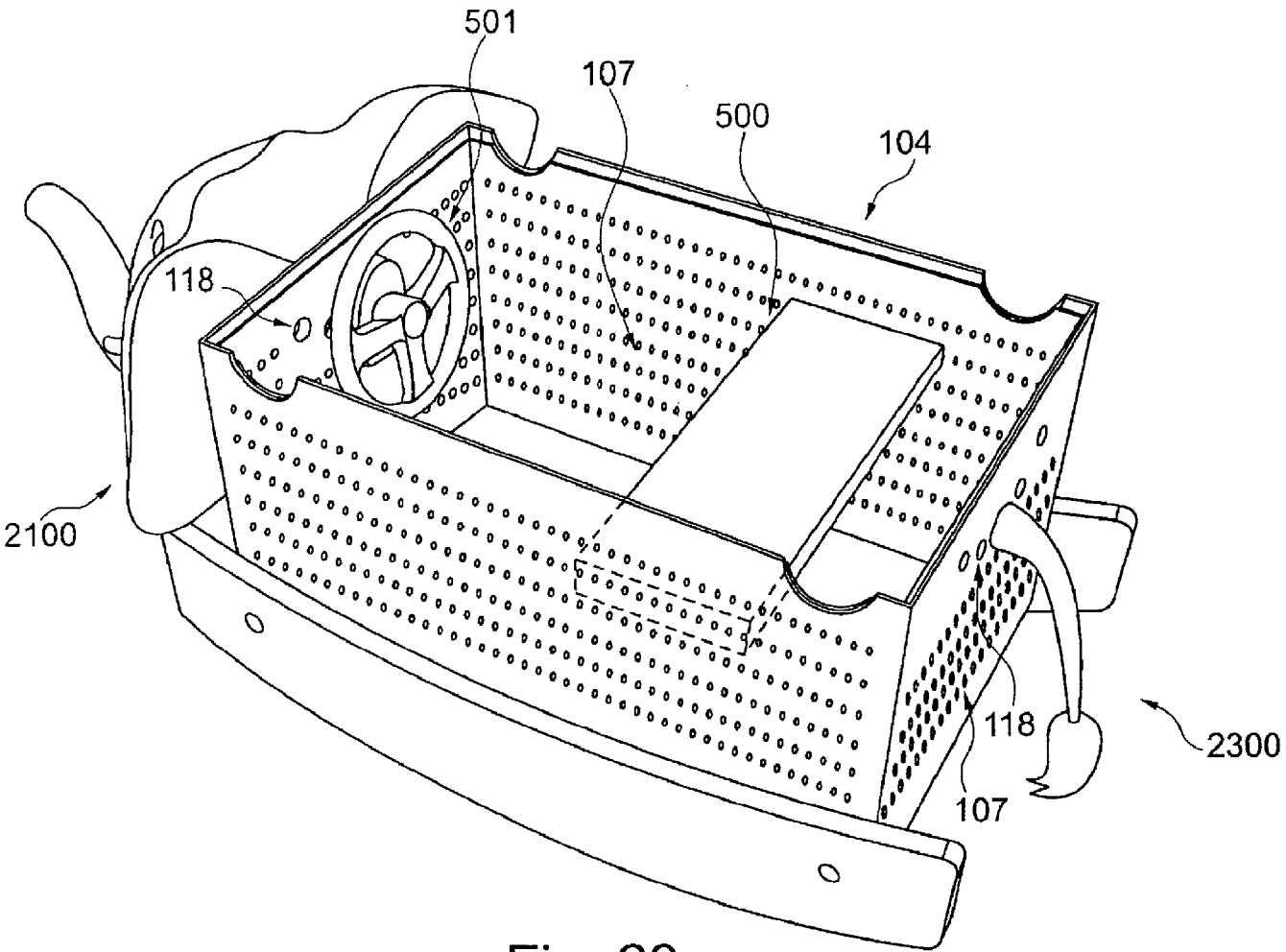
FIG. 23 shows a further perspective top view of the container apparatus of FIG. 21 according to an exemplary embodiment of the present invention.

FIG. 23 shows a further perspective top view of the container apparatus of FIG. 21 according to an exemplary embodiment of the present invention.

The lid 500 is mounted at the second row of through holes of the regular mating structure 107. The position of the lid is related to the edge of the sidewall 104 the edge opposite to the base plate 102 of the container apparatus 100.

The steering wheel 501 is mounted on the handholds 118, e.g. holes for the fingers of a user, on the back side of the cladding apparatus 2100. FIG. 23 furthermore shows another cladding structure 2300 mounted on the handholds 118 or on the mating structure 107. This cladding structure may have the form of a tail 2300, e.g. the tail 2300 of an elephant. The tail 2300 may be a three-dimensional forming structure or a shaping structure.

Figure 24:
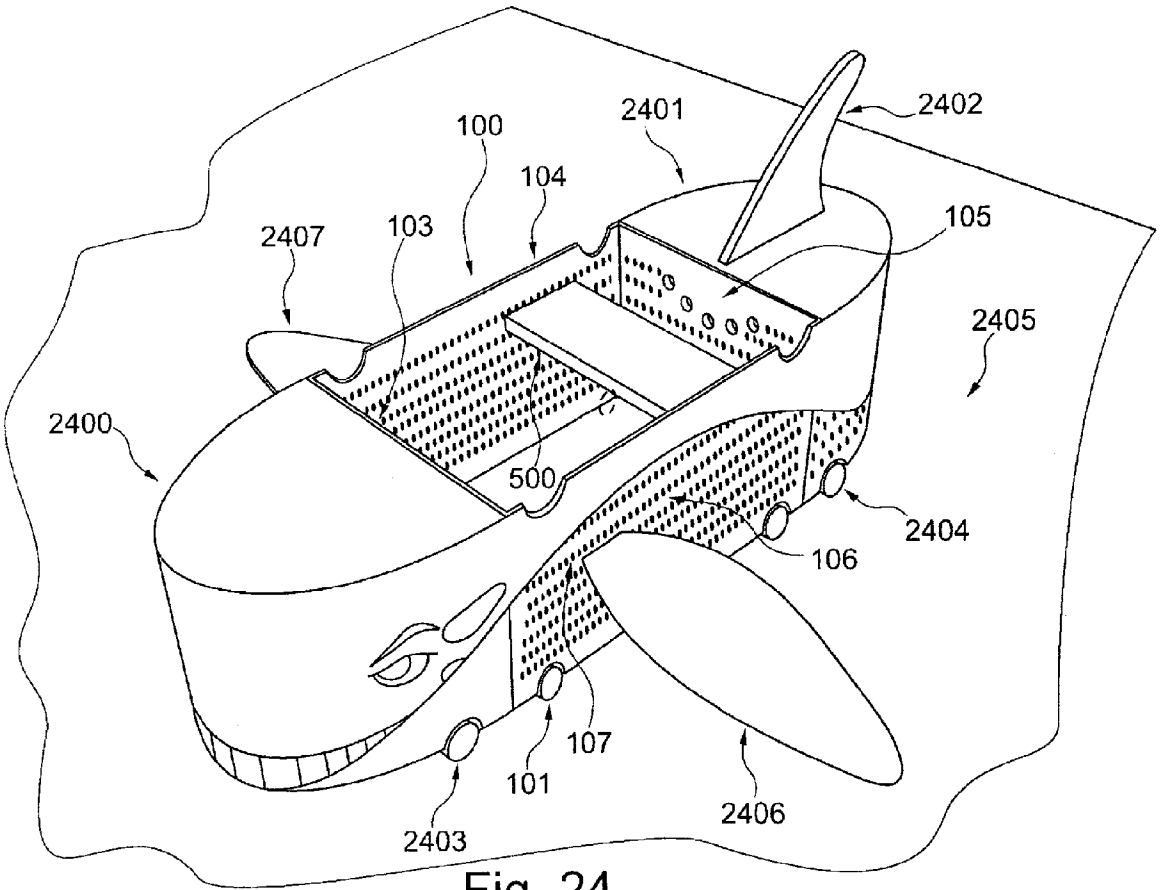
FIG. 24 shows a perspective top view of a container apparatus with two cladding apparatuses having wheels according to an exemplary embodiment of the present invention.

FIG. 24 shows a perspective top view of a container apparatus 100 with two cladding apparatuses having wheels according to an exemplary embodiment of the present invention.

A first cladding apparatus 2400 is mounted with the mating structure of the cladding apparatus to the container apparatus 100 using the mating structure 107 of the front sidewall 103 of the container apparatus 100. Furthermore, a second cladding apparatus 2401 is mounted to the container apparatus 100 using the mating structure of the back side wall 105.

The first cladding apparatus 2400 and the second cladding apparatus 2401 have substantially the same shape. Both cladding apparatuses 2400, 2401 have equal base bodies or shaping structures 2400, 2401. The second cladding apparatus 2401 furthermore comprise a flipper 2402 or a fin 2402.

The shaping structure 2400, 2401 of the first cladding apparatus 2400 and the shaping structure of the second cladding apparatus 2401 is substantially round. The shaping structure may be a half cylinder or it may have substantially elliptical form. The shaping structure may have a bended sidewall comprising the regular mating structure 107.

The cylinder 2400, 2401 may be solid body. In another example the cylinder 2400, 2401 may be a hollow body. Thus, the cladding apparatus 2400, 2401 can have a door or a flap which may allow putting things inside the cladding apparatus 2400, 2401.

The cladding apparatus 2400, 2401 may have a flat surface comprising a mating structure (not shown in FIG. 24) opposite to a bended side of the cladding apparatus 2400, 2401. The dimensions of the flat surface may correspond to the dimension of the side wall 103, 104, 105, 106, in particular to the front side wall 103 and/or to the back side wall 105. Thus, the cladding apparatus 2400, 2401 may substantially fit to the container apparatus 100 such that a substantially smooth transition or a substantially seamless transition from the surface of the cladding apparatus 2400, 2401 to the surface of a sidewall 106, 104 may be possible. Thus, the container apparatus 100 and the cladding apparatus 2400, 2401 form a unit.

The cladding structure 2400, 2401 may comprise at least one wheel 2403, 2404. The at least one wheel 2403, 2404 may correspond to a wheel 101 of the container apparatus. The wheel may be mounted on an axis between a base plate of the cladding apparatus and the ground 2405. Thus, the cladding apparatus 2400, 2401 comprise at least two wheels 2403, 2404. The wheels 2403, 2404 may help to hold the bottom of the cladding apparatus 2400, 2401 or the base plate 102 of the cladding apparatus 2400, 2401 on substantially the same distance from the ground 2405 as the wheels 101 of the container apparatus 100 keep the base plate 102 of the container apparatus 100. In an example the same wheels 101, 2403 used for the container apparatus are used for the cladding apparatus 2400, 2401. The same wheels may mean the same form of wheels.

The container apparatus 100 comprising the cladding apparatus 2400, 2401 may form a whale. The side fins 2406, 2407 may be formed by a three dimensional forming structure or a shaping structure, which may be mounted to the mating structure 107.

The mating structure 107 may form a grid which may allow changing the position of a cladding apparatus in regular distances. The grid 107 or raster 107 may be organised in rows and columns. In an example a side wall may comprise a grid of 34 attachement devices, e.g. holes, in a row and 8 attachment devices, e.g. holes, in a column. Instead of holes every support or attachment device, e.g. magnet or solenoid, a hook-and-loop fastener, a pin or a through hole may be arranged in such a regular structure.

Figure 25:
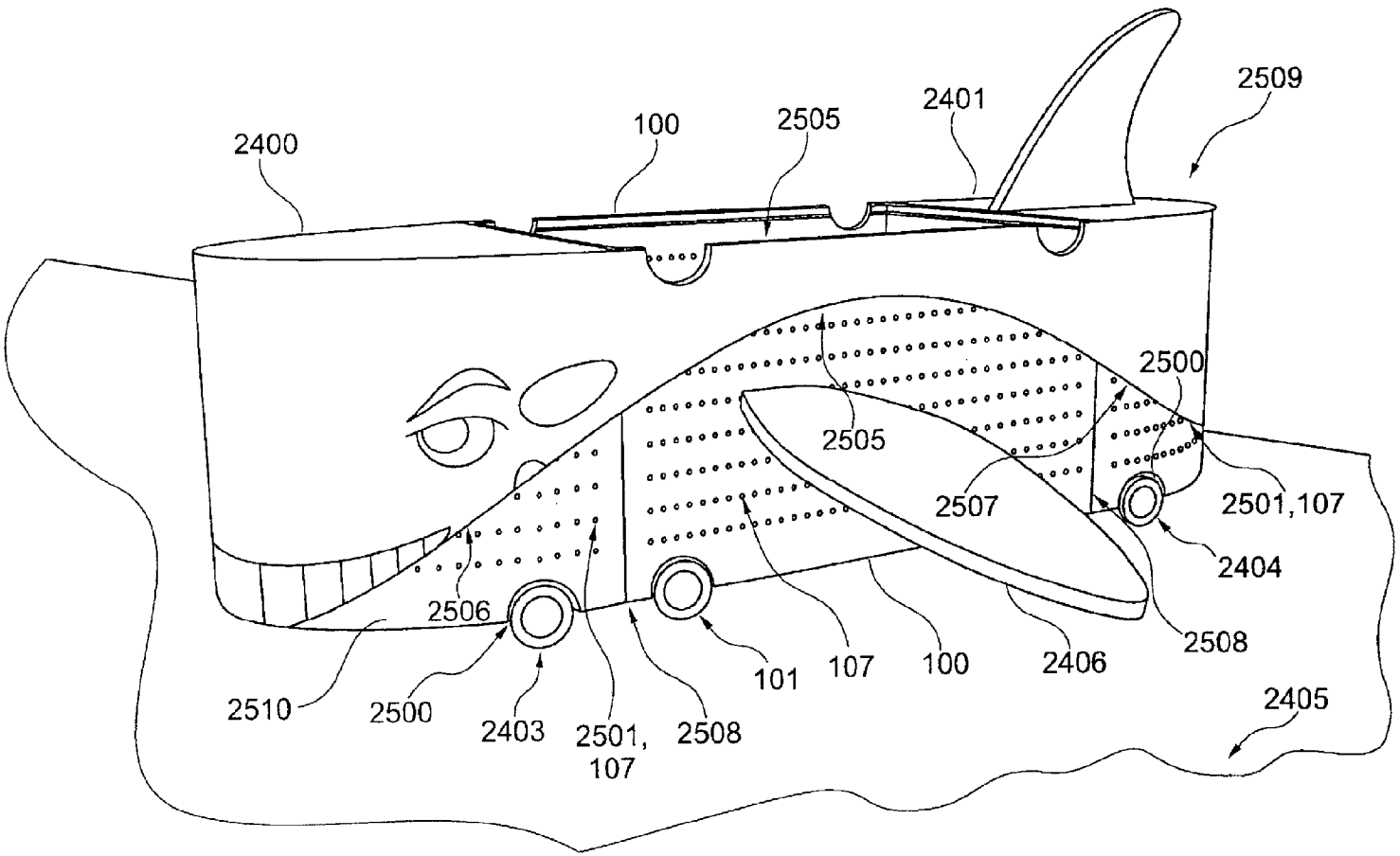
FIG. 25 shows a perspective side view of the container apparatus of FIG. 24 according to an exemplary embodiment of the present invention.

FIG. 25 shows a perspective side view of the container apparatus of FIG. 24 according to an exemplary embodiment of the present invention.

The wheel 2403, 2404 may be at least partially positioned inside a recess 2500. In FIG. 25, a half of the wheel 2403, 2404 may be positioned in the recess 2500. The wheel 2403, 2404 may be flushed with the side wall 2510 or the lateral surface 2510 of the cladding apparatus 2400, 2401. Thus, the wheel 101, 2403, 2404 may substantially not overlap the borders defined by the side walls of the container apparatus 100 and/or of the cladding apparatus 2400, 2401.

The cladding apparatus 2400, 2401 has a mating structure 2501. In an example, the mating structure 2501 of the cladding apparatus 2400, 2401 may be aligned with the mating structure 107 of the container apparatus. The rows of the mating structure may be in parallel to the base plate of the cladding apparatus 2400, 2401 and/or of the container apparatus 100. Thus, the rows of the mating structure 2501 surround the toy assembly 2509 and may be on the same level.

The container apparatus further has attached the panel 2505, which can provide to the container apparatus a shape. The cladding apparatus 2400, 2401 can comprise a panel 2506, 2507 which provides the shape of a whale to the container apparatus 100 and the cladding apparatus 2400, 2401. The panel may use the mating structure 2501, 107 to be fixed to the surface of the side walls of the container apparatus and the side wall 2510 of the cladding apparatus. The panel 2506, 2505, 2507 may be adapted to the form or to the shape of the container apparatus 100 and/or the cladding apparatus 2400, 2401.

In an example, the shape of the whale 2506, 2505, 2507 may be painted on the container apparatus and/or the cladding apparatus 2400, 2401.

The side view of FIG. 25 shows the joint 2508 where the cladding apparatus 2400 and the container apparatus 100 are mated together or joint together. The joint between the container apparatus and the cladding apparatus 2400 may comprise a gap. However, the surfaces of the cladding apparatus 2400, 2401 and the surface of the container apparatus 100 form continuity or may form a common surface for the assembly comprising the container apparatus 100 and the cladding apparatus 2400.

The regular mating structure may be a press cut (Durchstanzung). The base plate 102 of the container apparatus 100 and/or the base plate of the cladding apparatus may comprise the mating apparatus 107, 2501. Thus, the base plate may comprise at least one of a bore, a through hole, a hole, a press cut, a knop and a magnet.

The combination 2509 or assembly 2509 comprising at least one cladding apparatus 2400, 2401 and the container apparatus 100 may form a toy assembly 2509, which can be moved over the ground 2405 or over the floor 2405.

Figure 26:
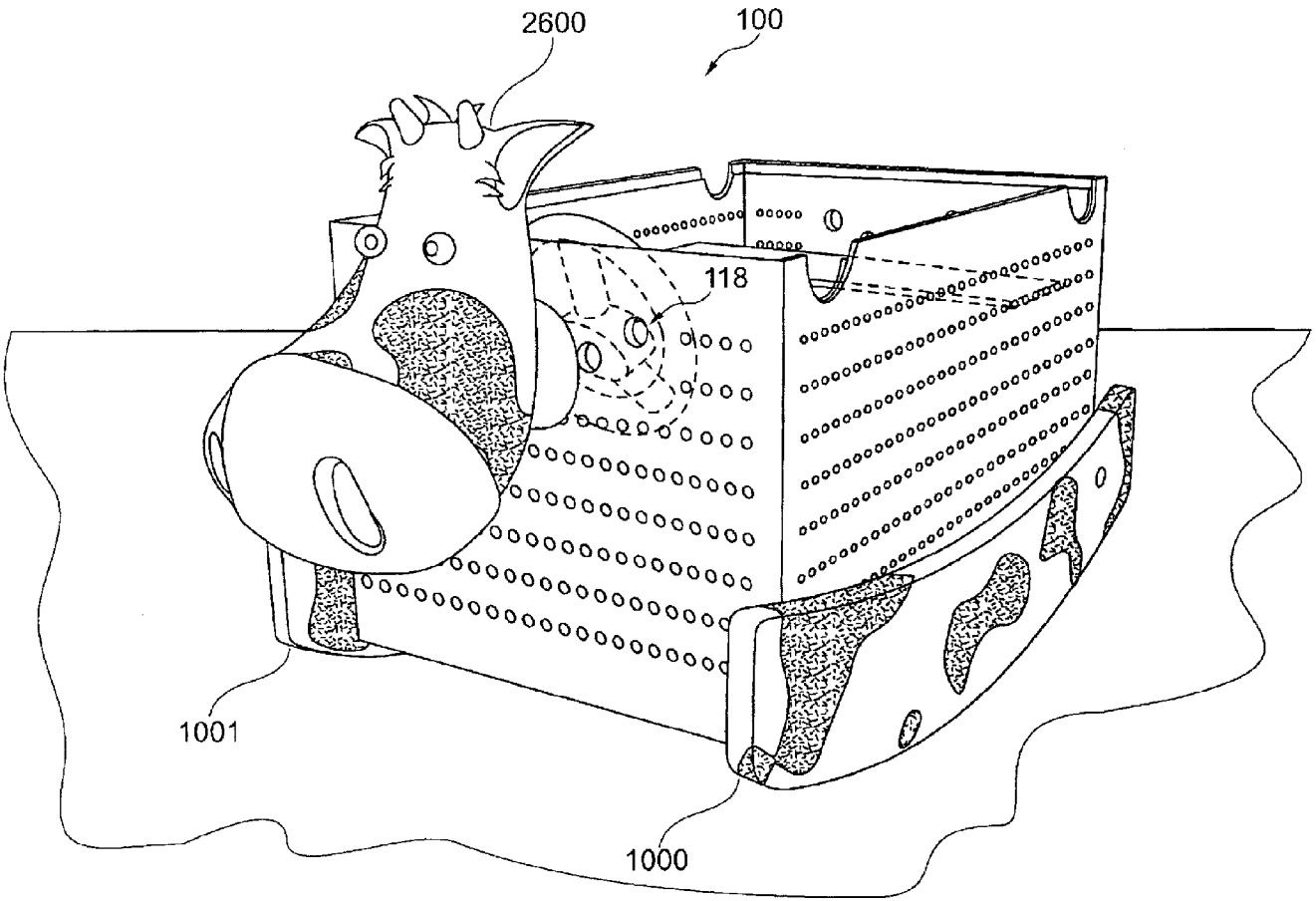
FIG. 26 shows a perspective front view of a container apparatus with a cladding apparatus according to an exemplary embodiment of the present invention.

FIG. 26 shows a perspective front view of a container apparatus with a cladding apparatus according to an exemplary embodiment of the present invention.

The container apparatus 100 comprises the cladding structure 2600, mounted on the handhold 118 or hand hole 118 of the container apparatus 100. The cladding structure 2600 or cladding apparatus 2600 comprises a shaping structure in the form of a cow head. The skids 100, 1001 may have a design according to the shaping structure, e.g. a cow pattern.

Figure 27:
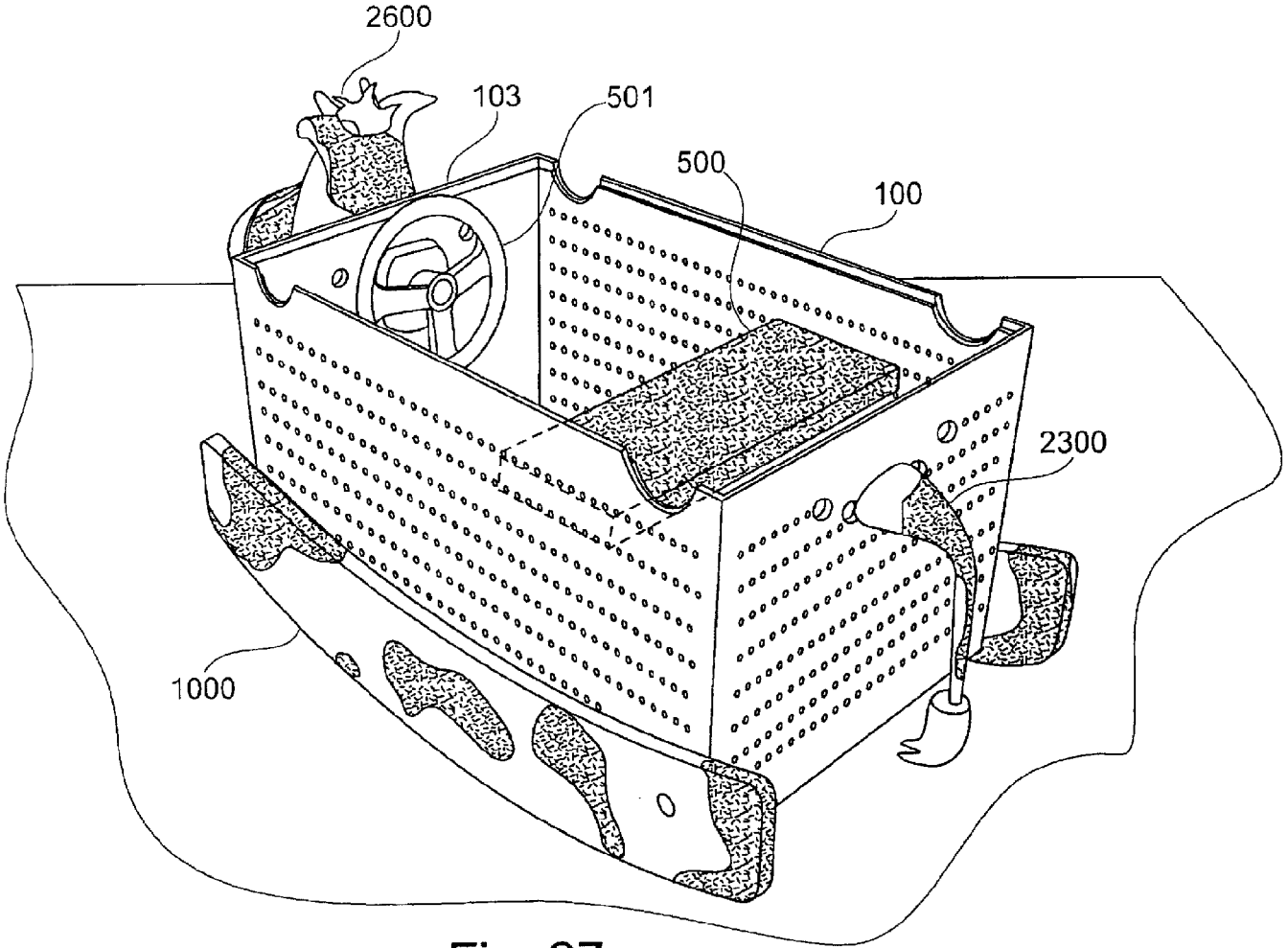
FIG. 27 shows a perspective top view of the container apparatus of FIG. 26 according to an exemplary embodiment of the present invention.

FIG. 27 shows a perspective top view of the container apparatus of FIG. 26 according to an exemplary embodiment of the present invention.

The cladding apparatus 2600 is mounted to the front side wall 103. Furthermore, the steering wheel 501 may be mounted to the front side wall 103. The steering wheel may comprise a horn or a buzzer. The horn may have a loudspeaker and a sound generator driven by the power supply. The loudspeaker and the sound generator may be integrated in a side wall or in the base plate of the container apparatus and/or of the cladding apparatus. The cladding apparatus 2600 and the steering wheel 501, which may also be a cladding apparatus, may be mounted on different sides of the front side wall 103. In an example, the steering wheel 501 may be utilized in order to mount or to fix the cladding apparatus 2600. Thus, a first cladding apparatus 501 may be utilized to fix a second cladding apparatus 2600. The cladding apparatus 2600 may have a shaping structure in the form of a head of a cow.

Figure 28:
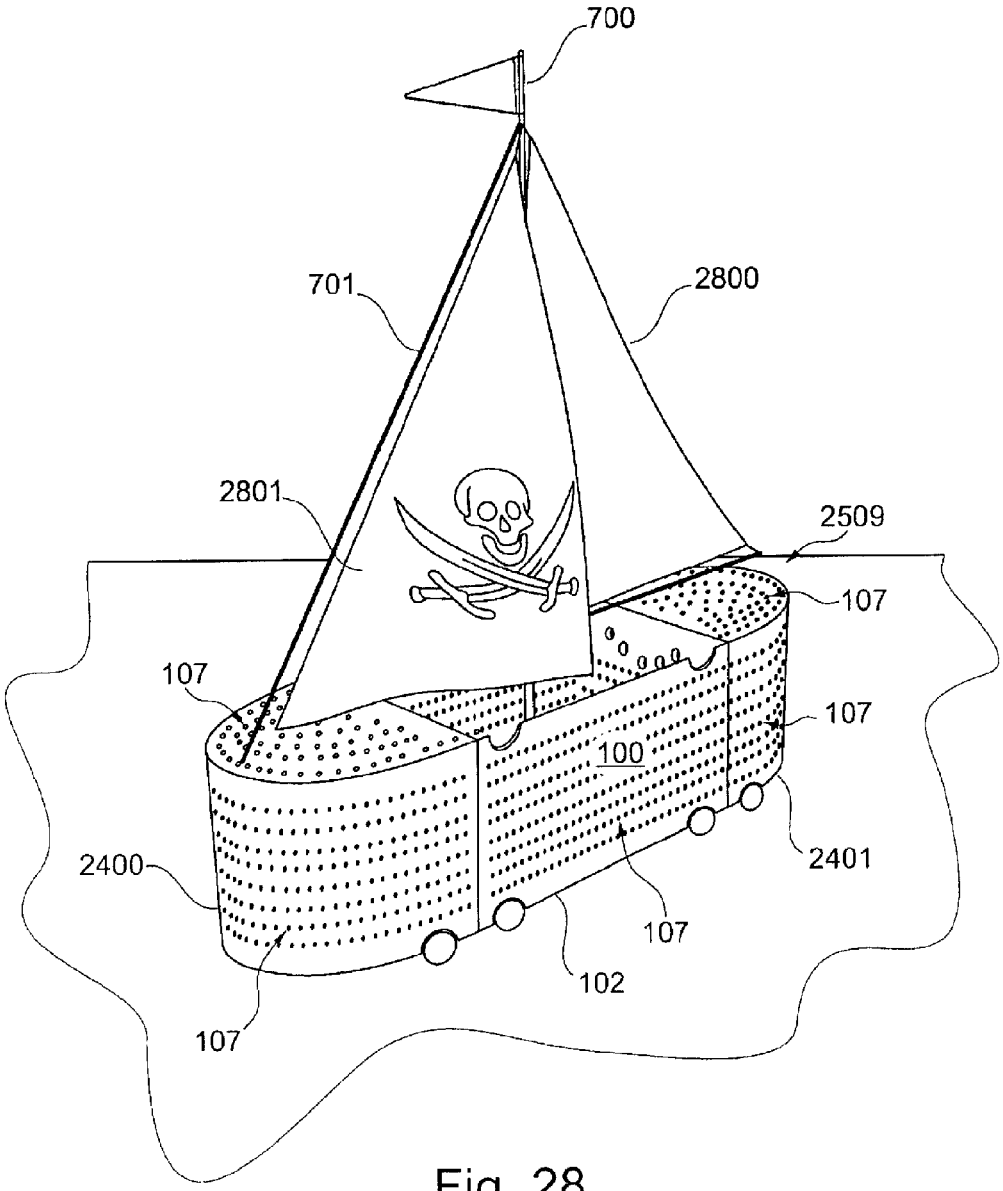
FIG. 28 shows a perspective top view of a sail boat formed by a container apparatus and a cladding structure according to an exemplary embodiment of the present invention.

FIG. 28 shows a perspective top view of a sail boat formed by a container apparatus and a cladding structure according to an exemplary embodiment of the present invention.

The sail boat comprises the toy assembly 2509 of FIG. 25 without the panel 2506, 2505, 2507 and without the fin 2402. The sail boat further comprises the rod 700, which is mounted on the base plate of the container apparatus 100. For mounting the rod 700, the mating structure of the base plate may be utilized. The rod may be foldable, separable or telescopically resizable in order to fit inside the container apparatus, e.g. in a laying position. The sidewalls and/or the base plate 102 of container apparatus 100 comprise the same mating structure 107. In an example the grid of the mating structure may be the same on a side wall and on the base plate. Thus, a cladding structure having the same regular mating structure can be mounted on any other mating structure.

The rope 701 helps fixing the rod 700 on the cladding structure 2400. The surface of the cladding apparatus 2400, 2401 and/or the surface of the container apparatus 100 can comprise the mating structure 107. Thus, corresponding cladding apparatuses having the same mating structure can be mounted on the surface of the container apparatus 100 and/or of the cladding apparatus 2400, 2401.

Thus, the toy assembly 2509, in particular the complete surface of the toy assembly 2509 comprise the mating structure 107. For example, the rope 701 can be mounted on a mating structure 107 of the cladding apparatus 2400.

The sails 2800, 2801 are made of tissue.

Figure 29:
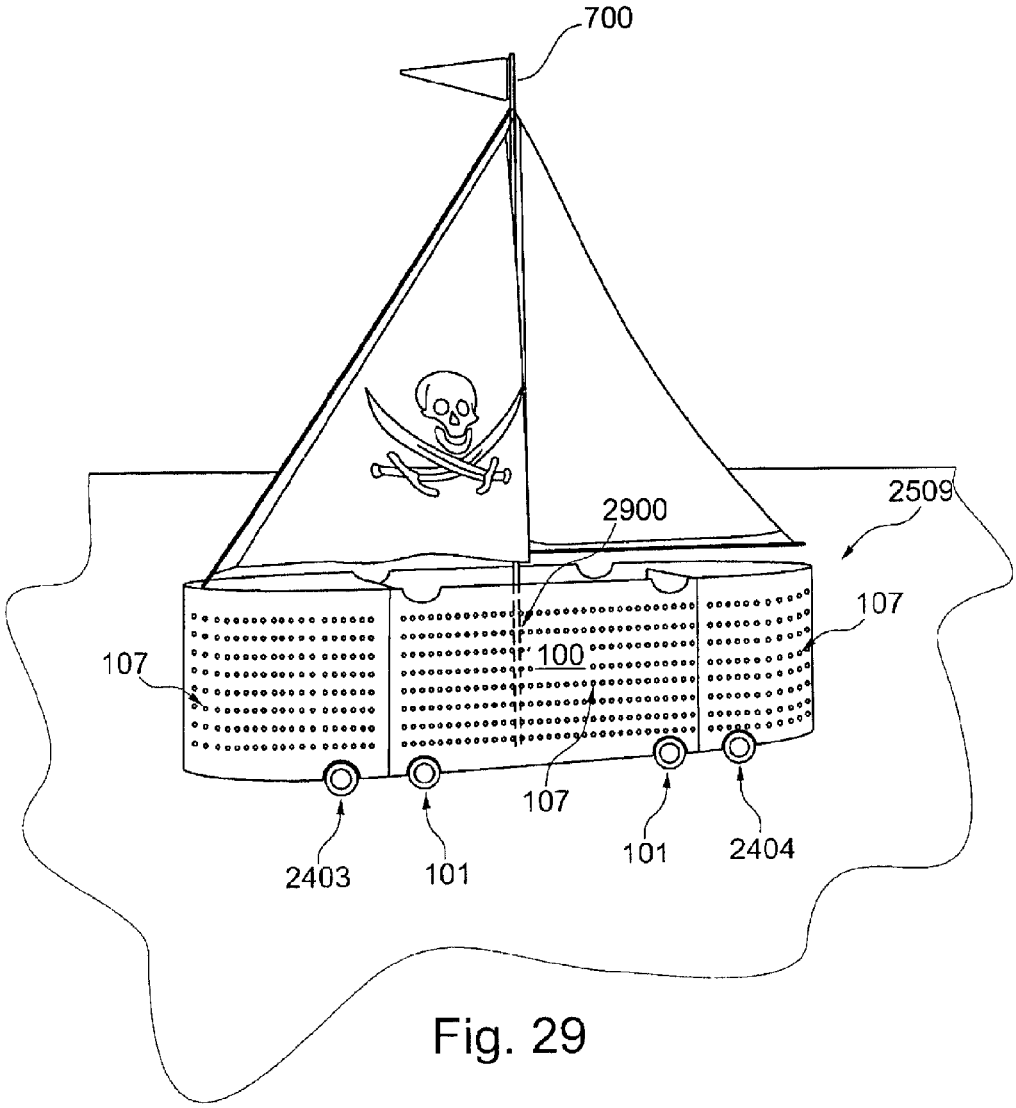
FIG. 29 shows a perspective side view of the sail boat of FIG. 28 according to an exemplary embodiment of the present invention.

FIG. 29 shows a perspective side view of the sail boat of FIG. 28 according to an exemplary embodiment of the present invention.

The container apparatus 100 of the toy assembly 2509 shows in the area 2900 that the mating structure 107 comprises through holes. In the area 2900, the rod 700 is visible through the through holes.

Figure 30:
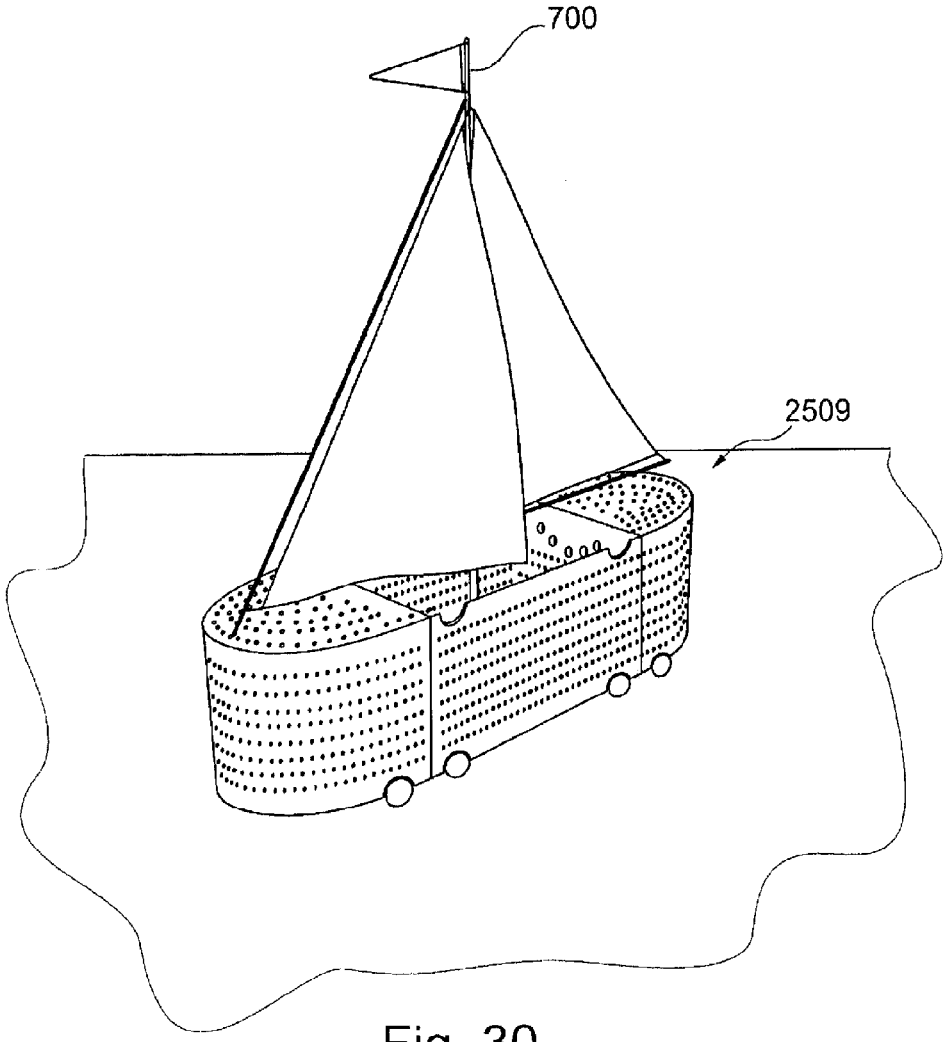
FIG. 30 shows a further perspective top view of a sail boat according an exemplary embodiment of the present invention.

FIG. 30 shows a further perspective top view of a sail boat according an exemplary embodiment of the present invention.

Figure 31:
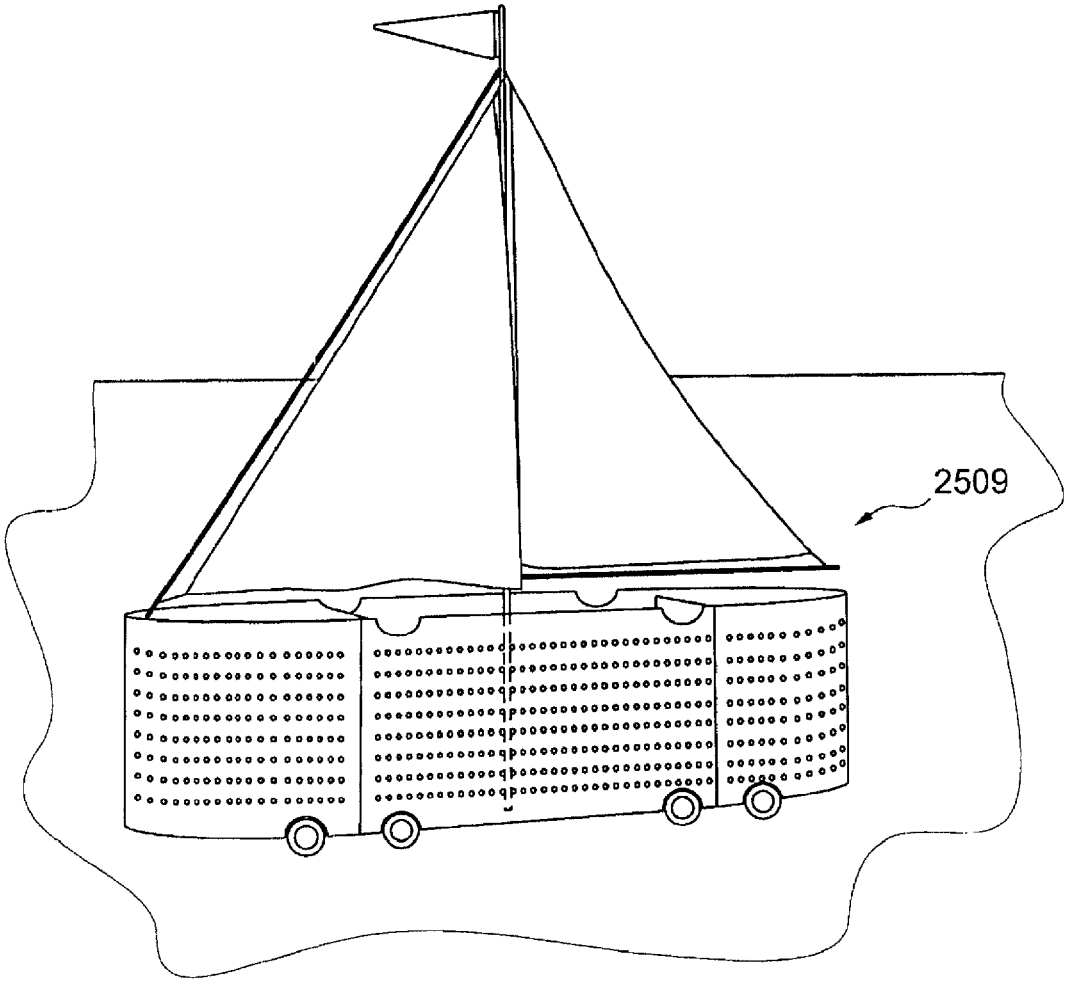
FIG. 31 shows a further perspective side view of a sail boat according an exemplary embodiment of the present invention.

FIG. 31 shows a further perspective side view of a sail boat according an exemplary embodiment of the present invention.

Figure 32:
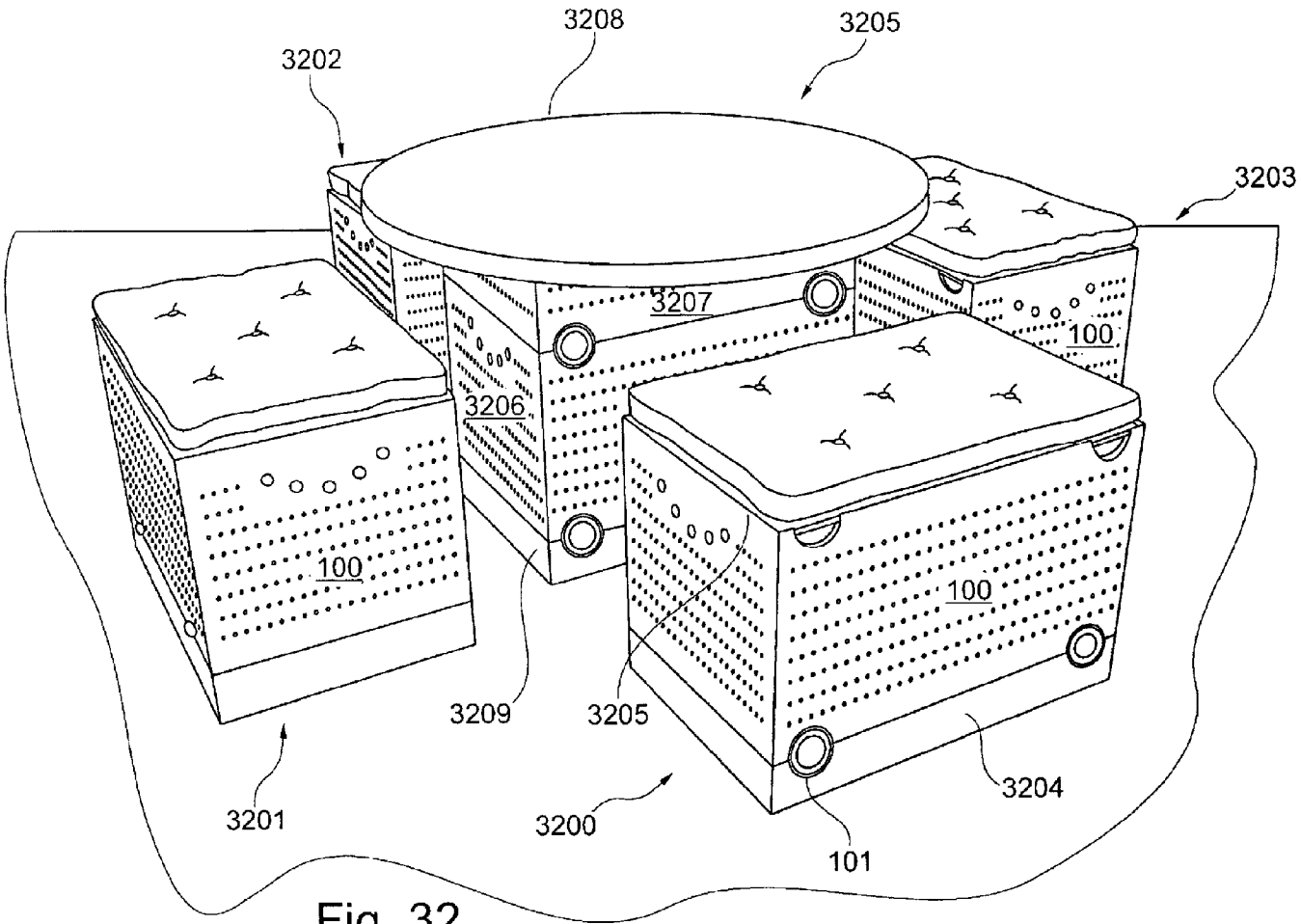
FIG. 32 shows desk and chairs formed by a container apparatus according to an exemplary embodiment of the present invention.

FIG. 32 shows desk and chairs formed by a container apparatus according to an exemplary embodiment of the present invention.

FIG. 32 shows 4 chairs 3200, 3201, 3202, 3203 each formed by an assembly comprising a platform structure 3204, a container apparatus 100 and a lid 3205 comprising a cushion. The lid 3205 covers the aperture of the container apparatus 100. The container apparatus 100 is positioned over platform structure 3204. The platform structure 3204 engages with the wheels 101 of the container apparatus 100 for preventing a movement of the container apparatus.

The table 3205 is built by a container assembly comprising the first container apparatus 3206, the second container apparatus 3207 and the table plate 3208. The first container apparatus 3206 is positioned over the platform structure 3209. The platform structure 3209 may substantially prevent movement of the desk 3205.

The table plate 3208 extends over the extension of the first container apparatus 3206 and the second container apparatus 3207.

The first container apparatus 3206 and the second container apparatus 3207 can have different heights.

Figure 33:
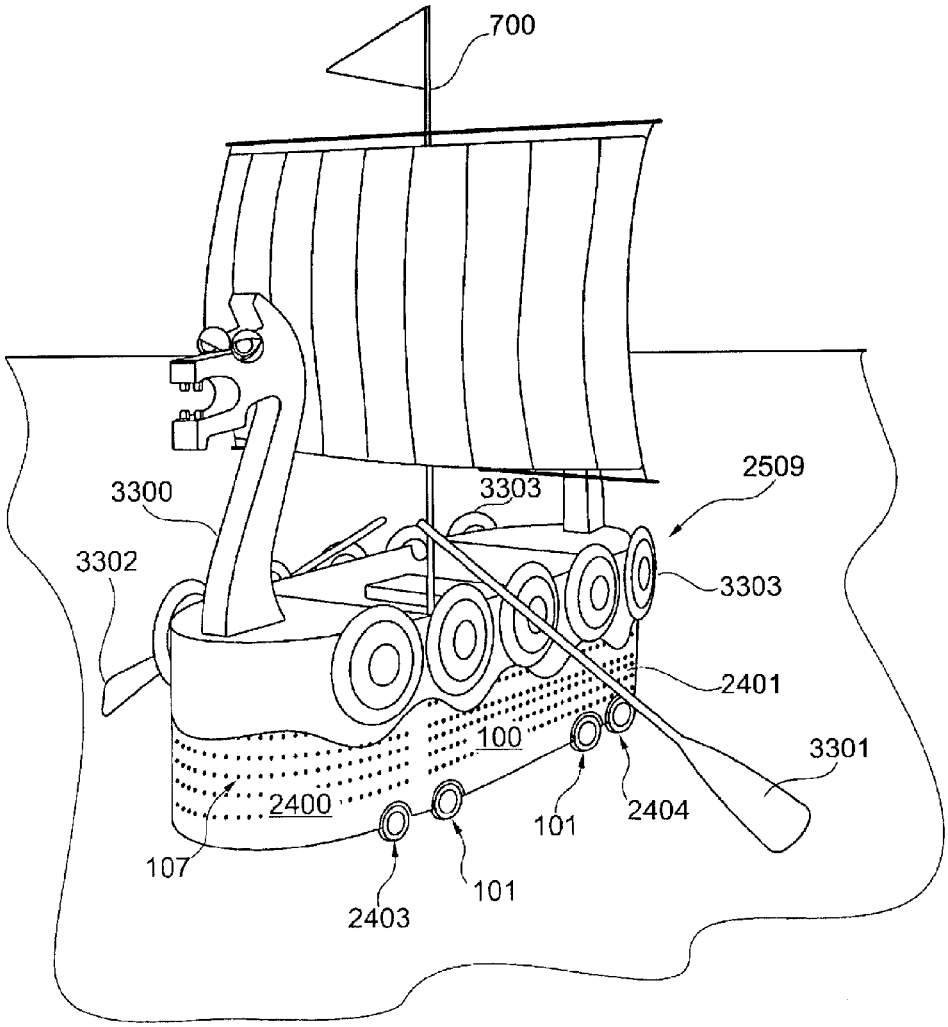
FIG. 33 shows a further perspective front view of a container apparatus comprising a cladding apparatus according to an exemplary embodiment of the present invention.

FIG. 33 shows a further perspective front view of a container apparatus comprising a cladding apparatus according to an exemplary embodiment of the present invention.

The toy assembly 2509 can be transformed in a sail boat whose shape may be defined by a cladding apparatus. In addition to the cladding apparatus 2400 and in addition to the cladding apparatus 2401, the front cladding apparatus 3300 may be used to amend the form of the toy assembly 2509. In FIG. 33 for example the three dimensional forming structure 3300 can be attached to the mating structure 107. In an example the three dimensional forming structure 3300 may have the form of a part of a Vikings boat. For example the part of the Viking boat may be a throat or a figurehead in form of a horse head.

Furthermore, paddles 3301, 3302 can be used as a further three-dimensional forming structure or as a shaping structure. As shown in FIG. 33 buckler 3303 may also be a three-dimensional forming structure which may be attached to the container apparatus 100, the cladding apparatus 2400, 2401 and/or cladding apparatus 3300 or to the encasement 3300.

The wheels 2403, 101, 2404 can be used to move the encased toy arrangement 2509 over the ground. The arrangement may be encased by the cladding apparatus 3300. Thus, a cladding apparatus may extend over the size of a cladding apparatus 2400, 2401 or over the size of a container apparatus 100.

The container apparatus may further comprise the rod 700 as still a further shaping structure of a cladding structure.

The cladding apparatus 3300, 700 may be adapted such that the cladding apparatus 3300, 700 can be placed or stowed inside the container apparatus 100 if the toy assembly 2509 may not be used.

In an example the cladding apparatus 3300 may extend over the dimensions of the container apparatus 100. In order to allow putting the cladding apparatus 3300, 3302, 3301, 700 inside the container apparatus 100, the cladding apparatus may be foldable. In an example the cladding apparatus comprise a further mating structure, which allow separating and joining the different parts of the cladding apparatus 3300, 3302, 3301, 700. In another example, the cladding apparatus 3300 comprise at least a joint, for folding the cladding apparatus.

Figure 34:
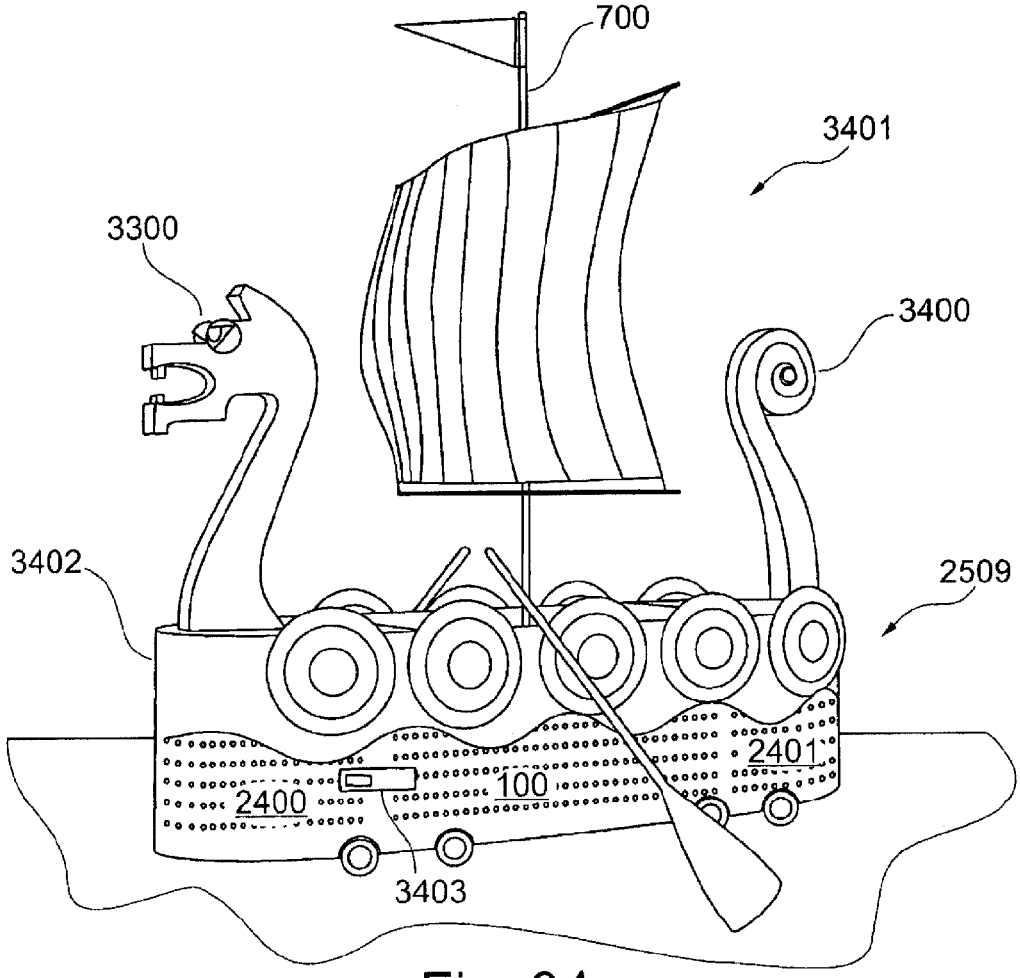
FIG. 34 shows a perspective side view of the container apparatus of FIG. 33 according to an exemplary embodiment of the present invention.

FIG. 34 shows a perspective side view of the container apparatus of FIG. 33 according to an exemplary embodiment of the present invention.

FIG. 34 shows different three-dimensional forming structures 3300, 3400 used as cladding apparatus for the Viking boat 3401.

The assembly 3401 may comprise a single piece cladding apparatus 3402, 3300 which may encases the complete toy assembly 2509. Since the cladding apparatus 3402, 3300 is made from one piece, the cladding apparatus 3402 may belt or keep together the cladding apparatus 2400, 2401 and the container apparatus 100, like a clip, fastener or bracket. In another example, the cladding apparatus 2400, 2401 and the container apparatus can use a closure 3403 or clamping-fixture 3403, which may allow joining the cladding apparatus 2400, 2401 and the container apparatus 100. The closure 3403 may be part of a cladding structure and may comprise a mating structure to be mounted to the container apparatus 100 and/or to the cladding apparatus 2400, 2401. The closure 3403 can be mounted on the mating structure 107. Therefore, the closure 3403 comprise the mating structure.

Increasing the number of closure 3403, which may bridge the joint between container apparatus 100 and cladding apparatus 2400, 2401, may increase the stability of the toy assembly 2509.

Figure 35:
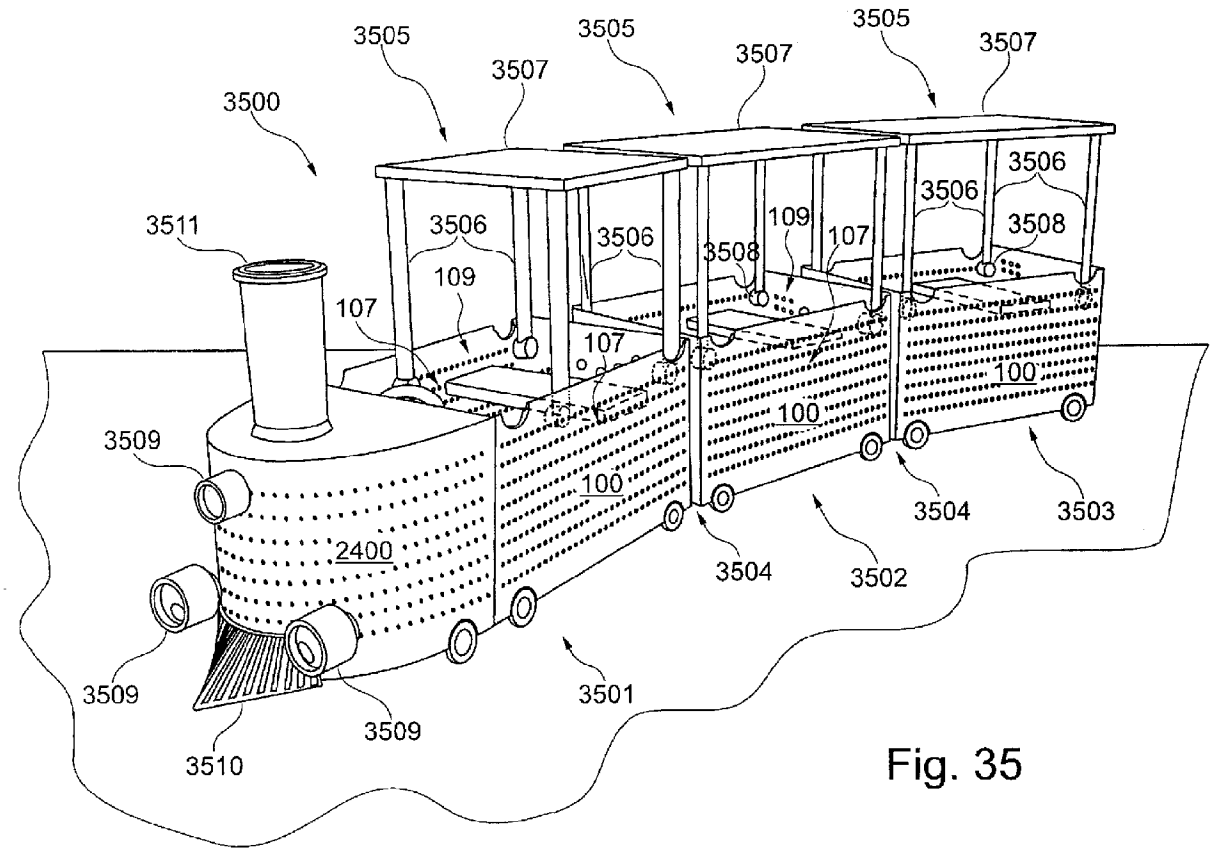
FIG. 35 shows a perspective view of a train formed by a plurality of container apparatuses according to an exemplary embodiment of the present invention.

FIG. 35 shows a perspective view of a train formed by a plurality of container apparatuses according to an exemplary embodiment of the present invention.

The train 3500 comprise the locomotive 3501 and two wagons 3502, 3503. The wagons 3502, 3503 are coupled using a coupler 3504 or trailer coupling 3504, not shown in FIG. 35. The coupler 3504 comprise the mating structure and can be mounted with the mating structure to a side wall of the container apparatus 100.

The locomotive 3501 and the wagons 3502, 3503 comprise a cladding structure 3505 forming a roof 3505. The roof 3505 comprises the shaping structure 3506 or the rod 3506 which supports mounting the plate 3507 over the aperture 109 of the container apparatus 100.

The roof may be used as a lid for the container apparatus 3501. The roof 3505 may comprise the mating structure for fixing or mounting the rods 3506.

On one end the rod 3506 holding the plate 3507 or panel 3507 comprise the mating structure 3508 fitting to the mating structure 107 of the container apparatus 100. The rod 3506 may be mounted on the interior of a side wall of the container apparatus 100.

The locomotive 3501 can comprise further cladding structures 3509, 3510, 3511 forming a smoke pipe 3511, a front lamp 3509 or a bumper 3510.

The smoke pipe 3511, the front lamp 3509 or the bumper 3510 may be electrically driven and may comprise a loudspeaker or a lamp. Power may be supplied via a conductive attachment device like a knop or knob being part of the mating structure.

Figure 36:
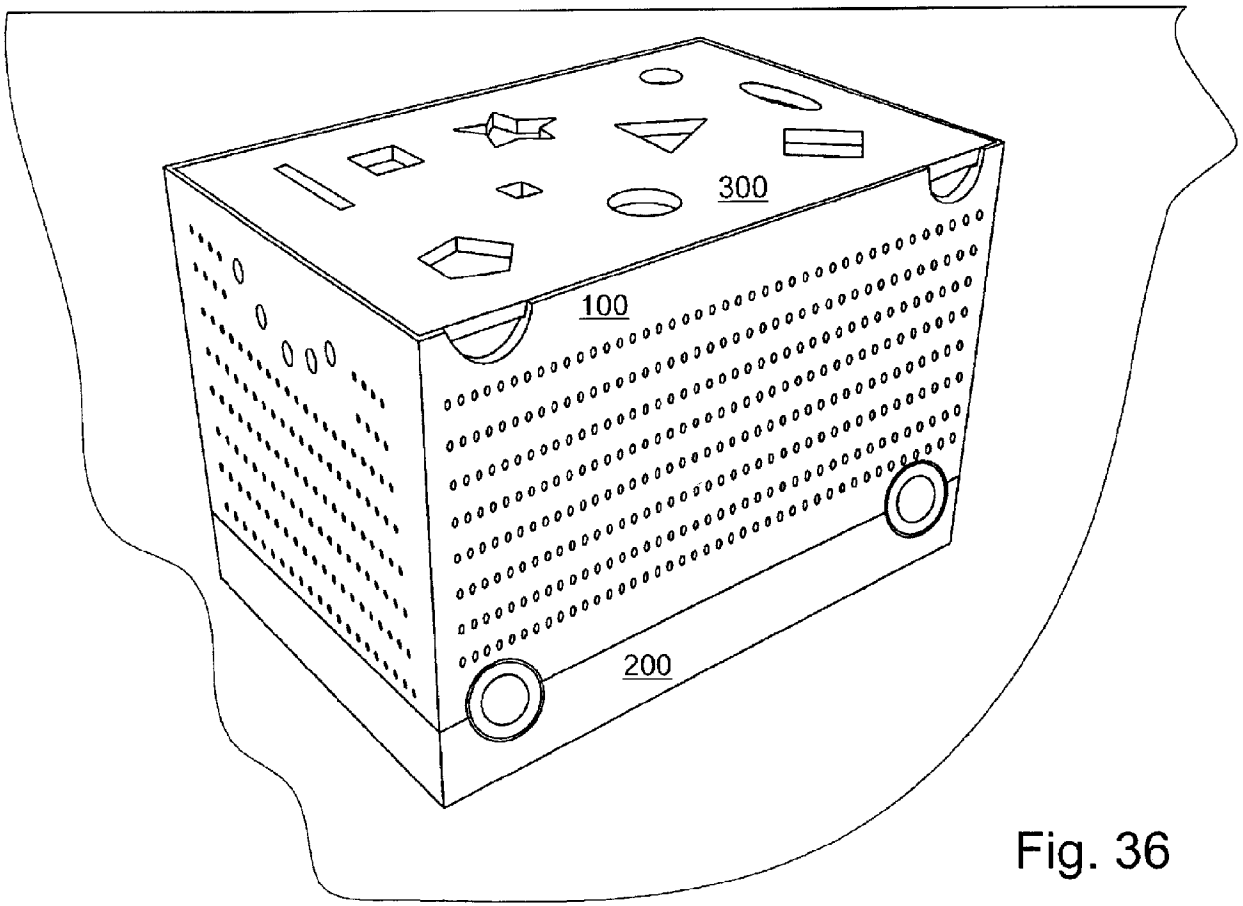
FIG. 36 shows a further perspective front view of a container apparatus with a lid according to an exemplary embodiment of the present invention.

FIG. 36 shows a further perspective front view of a container apparatus with a lid according to an exemplary embodiment of the present invention.

Figure 37:
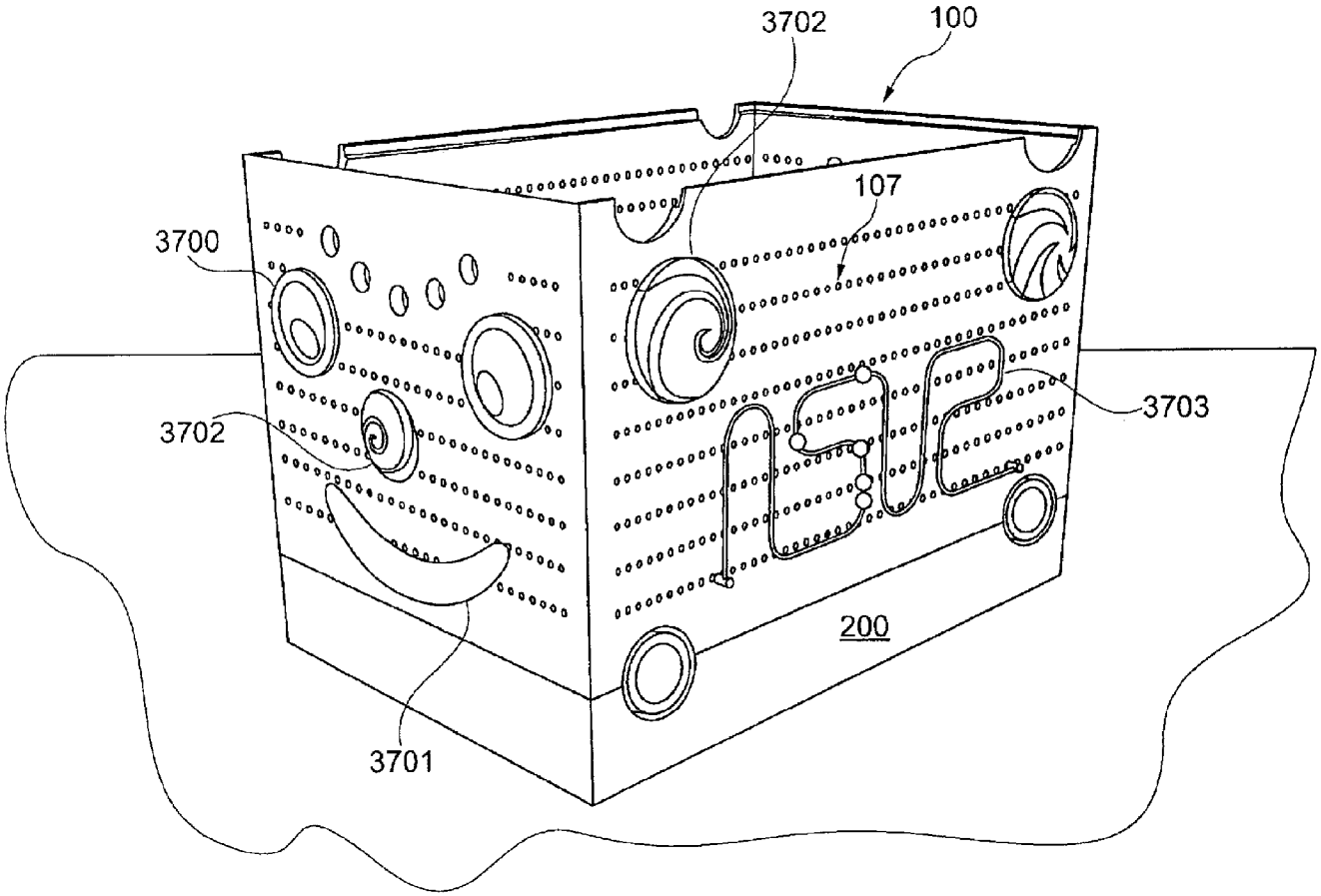
FIG. 37 shows a container apparatus with different cladding apparatuses for playing according to an exemplary embodiment of the present invention.

FIG. 37 shows a container apparatus with different cladding apparatuses for playing according to an exemplary embodiment of the present invention.

The container apparatus 100 is mounted on top of a platform structure 200.

Different cladding apparatuses 3700, 3702, 3701, 3703 are mated to the regular mating structure 107 of the container apparatus 100. Power may be supplied to the cladding apparatuses via a conductive attachment device.

In an example the shaping structure 3700 of a cladding apparatus may have the form of an eye 3700. In another example the three dimensional forming structure may have the form of a half ball 3702. In yet another example, the three dimensional forming structure 3701 has the form of a half circle 3701. The eyes may be electrically movable and the half circle may be adapted to amend the shape by providing electrical energy. The half ball may be driven by the power supply in order to spin.

The winding shaping structure 3703 may form a labyrinth and comprises pearls which can be moved along the labyrinth.

Figure 38:
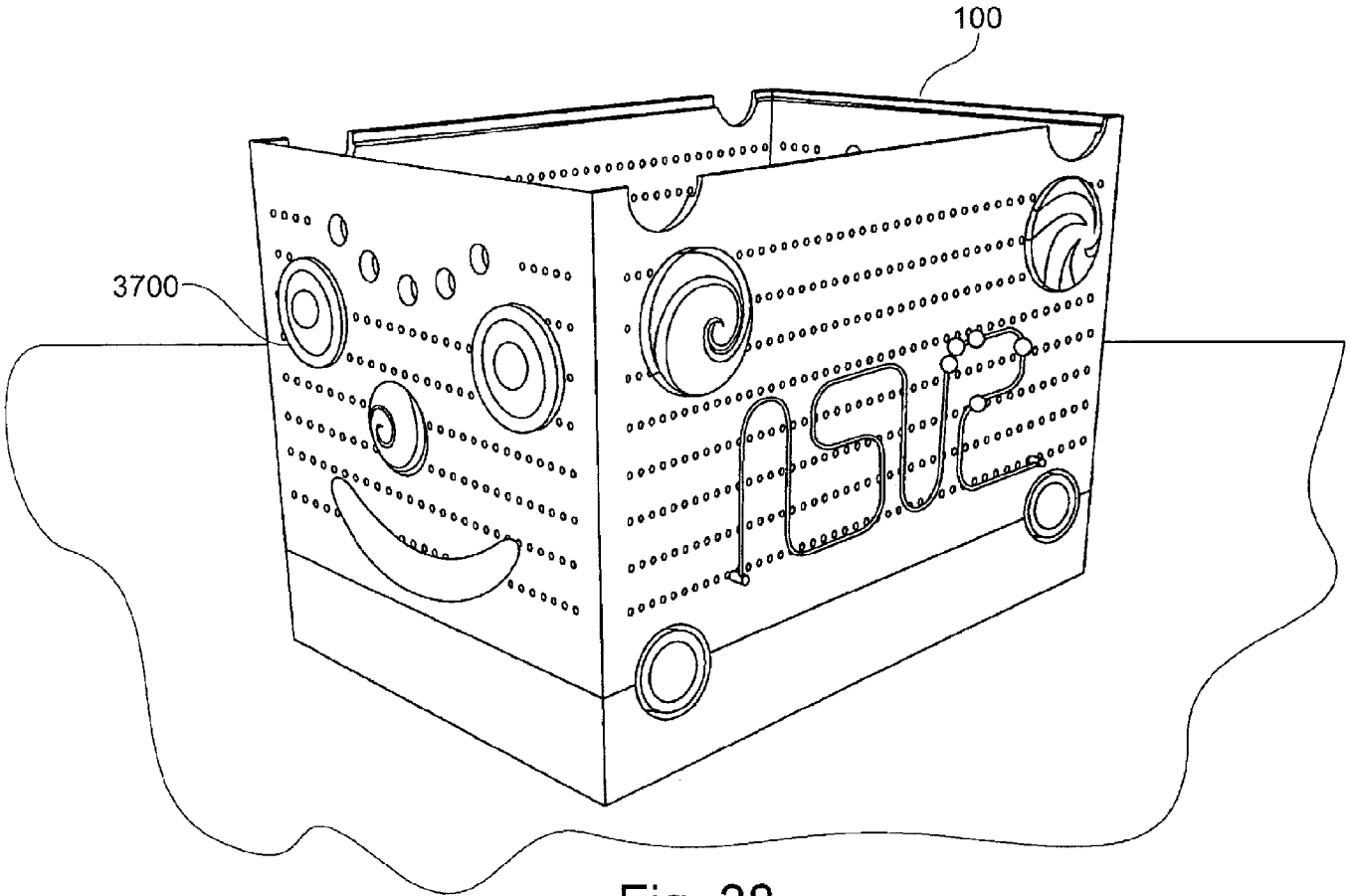
FIG. 38 shows a further container apparatus with different cladding apparatuses for playing according to an exemplary embodiment of the present invention.

FIG. 38 shows a further container apparatus with different cladding apparatuses for playing according to an exemplary embodiment of the present invention. The exes 3700 are spun in an up position.

Figure 39:
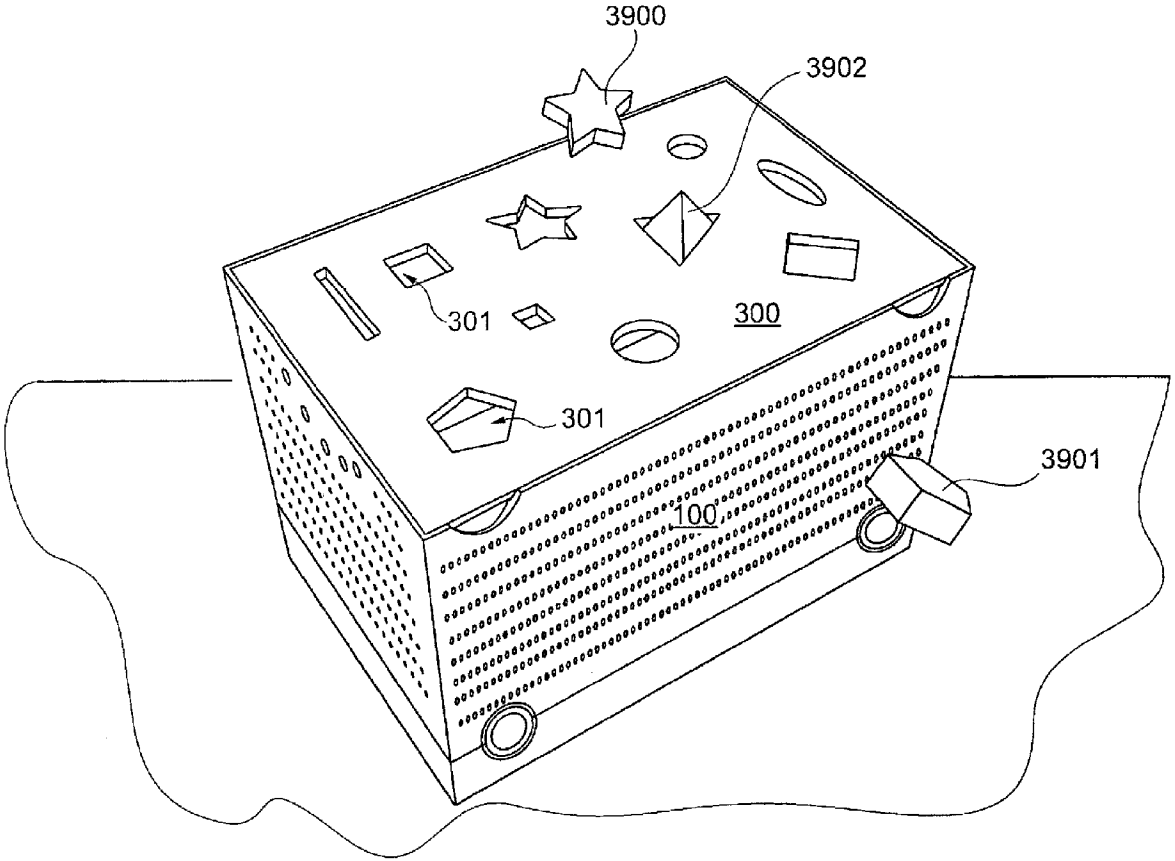
FIG. 39 shows a perspective top view of a container apparatus covered by a lid with through holes according to an exemplary embodiment of the present invention.

FIG. 39 shows a perspective top view of a container apparatus covered by a lid with through holes according to an exemplary embodiment of the present invention.

The lid 300 covers an aperture of the container apparatus 100. The lid 300 comprises through holes 301 of different shapes allowing corresponding building blocks 3900, 3901, 3902 to be put through the corresponding through hole. The building blocks may have a star form 3900, a pyramid form 3902 or a rectangular form 3901.

Figure 40:
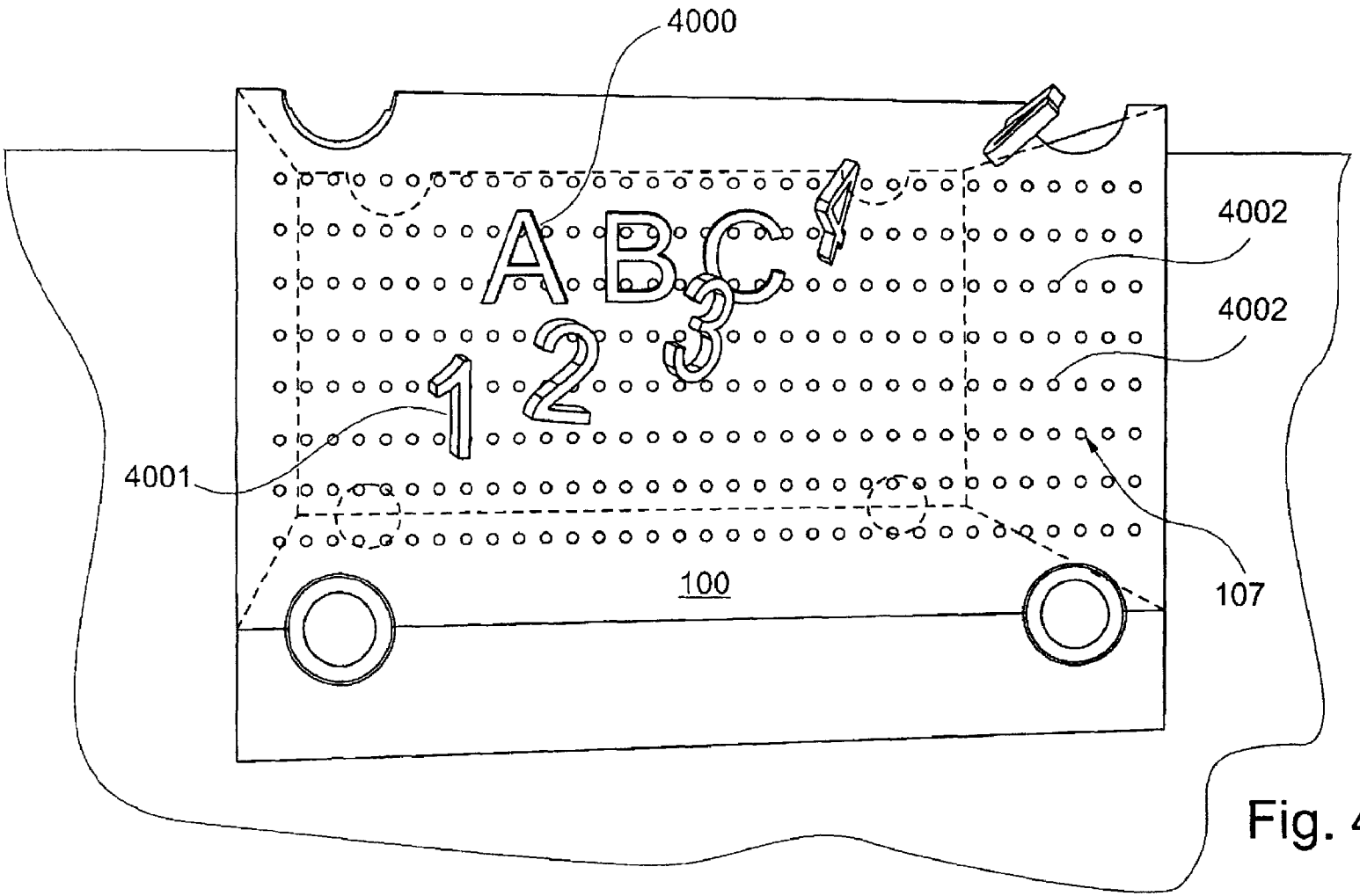
FIG. 40 shows a side view of a container apparatus according to an exemplary embodiment of the present invention.

FIG. 40 shows a side view of a container apparatus according to an exemplary embodiment of the present invention.

The mating structure 107 may comprise a plurality of mounting apparatuses 4002 or attachment devices 4002. The mating structure 107 can be used to attach a cladding apparatus, e.g. a panel 4000, 4001, a shaping structure 4000, 4001 or a three-dimensional forming structure 4000, 4001 to the container apparatus 100. The cladding structure 400, 4001 may have the form of a letter or a number and may be attached directly to the mating structure 107. The cladding apparatus may have a corresponding mating structure. In an example each letter or number 4000, 4001 may comprise a trigger device, a sound generator and a loud speaker, configured such that on triggering the trigger device the corresponding letter or number can be heard. Hearing the pronunciation of the letter or number may help learning the numbers or letters.

Figure 41:
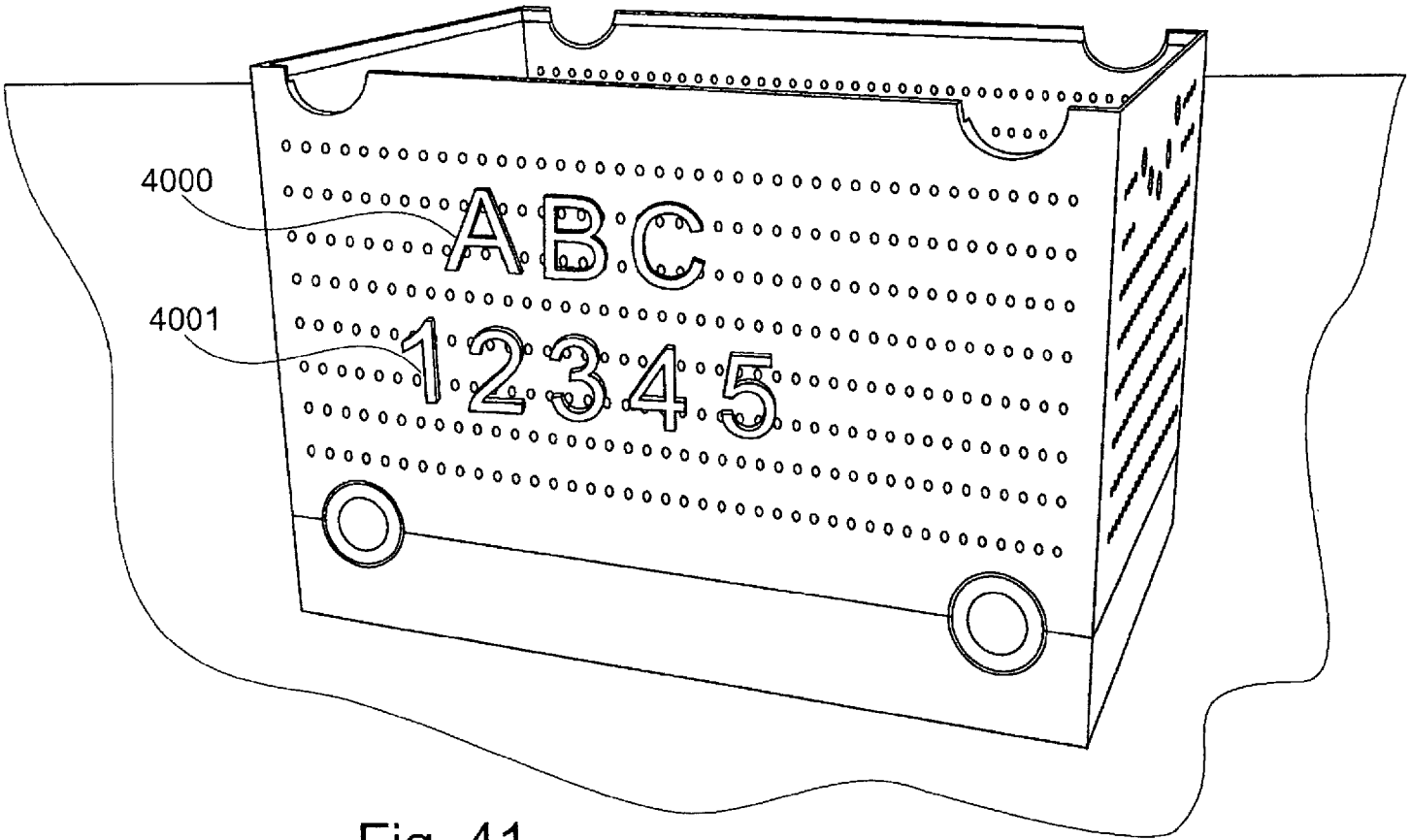
FIG. 41 shows a perspective side view of a container apparatus according to an exemplary embodiment of the present invention.

FIG. 41 shows a perspective side view of a container apparatus according to an exemplary embodiment of the present invention.

Figure 42:
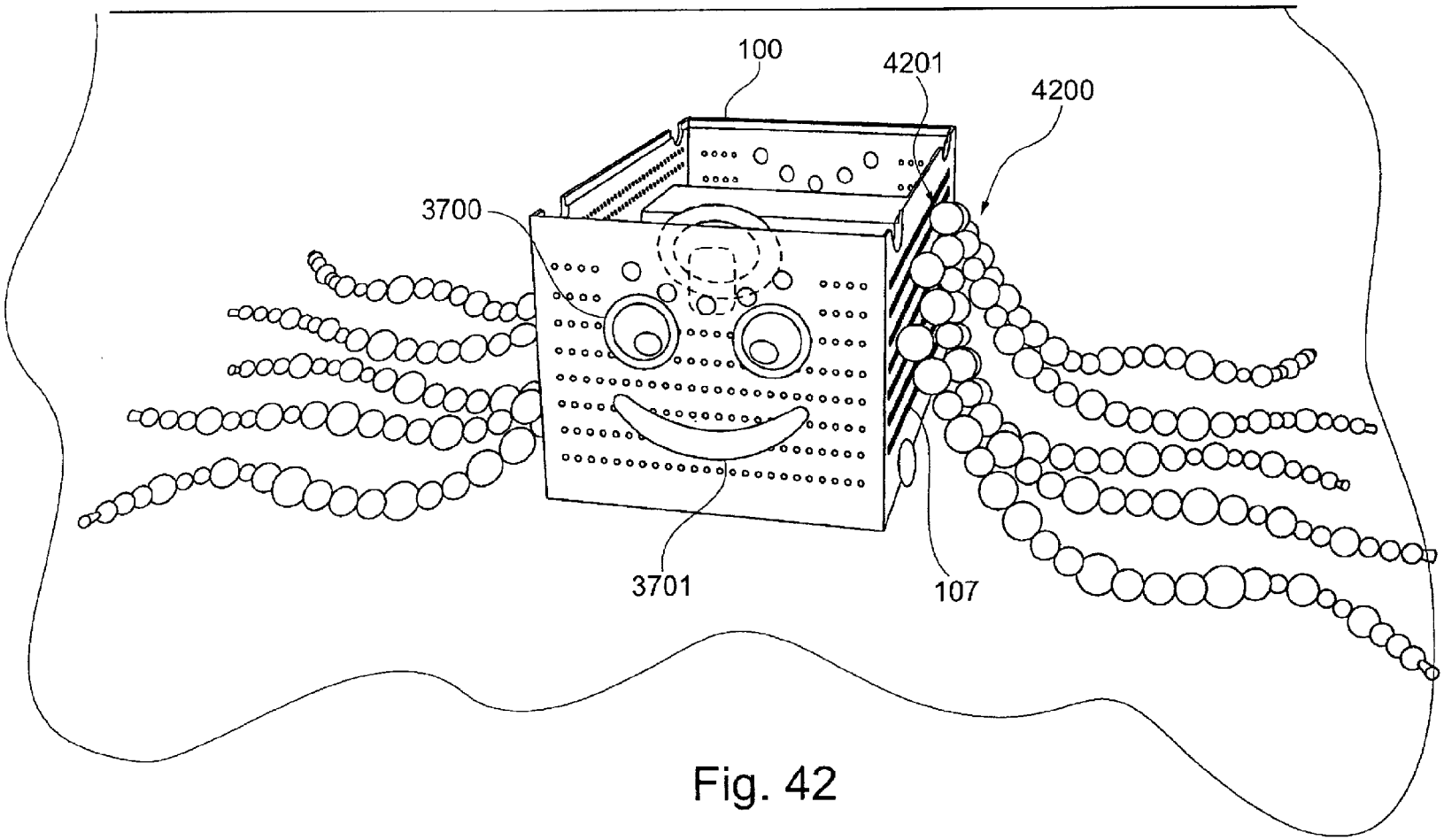
FIG. 42 shows a further perspective front view of a container apparatus according to an exemplary embodiment of the present invention.

FIG. 42 shows a further perspective front view of a container apparatus according to an exemplary embodiment of the present invention.

FIG. 42 shows a shaping structure 4200 or cladding apparatus 4200 which is directly mountable to the container apparatus 100. In particular, a three dimensional structure 4200 or a shaping structure 4200 in the form of tentacles 4200 is shown, which comprise on one end 4201 a mating structure, which can be engaged with the mating structure 107 of the container apparatus. The end of the shaping structure 4200 may be a ball having the corresponding mating structure.

In an example, the mating structure 107, 4201 is a hook-and-loop fastner or a hook-and-pile fastner 107, 4201.

The tentacle 4200 may be formed by a thread of balls or balls on a thread, wherein the diameter of the balls substantially decreases or varies in the direction from the fastner 4201 to a distant end. The balls may be made of foam, cellular material, styrofoam or polystyrene.

Figure 43:
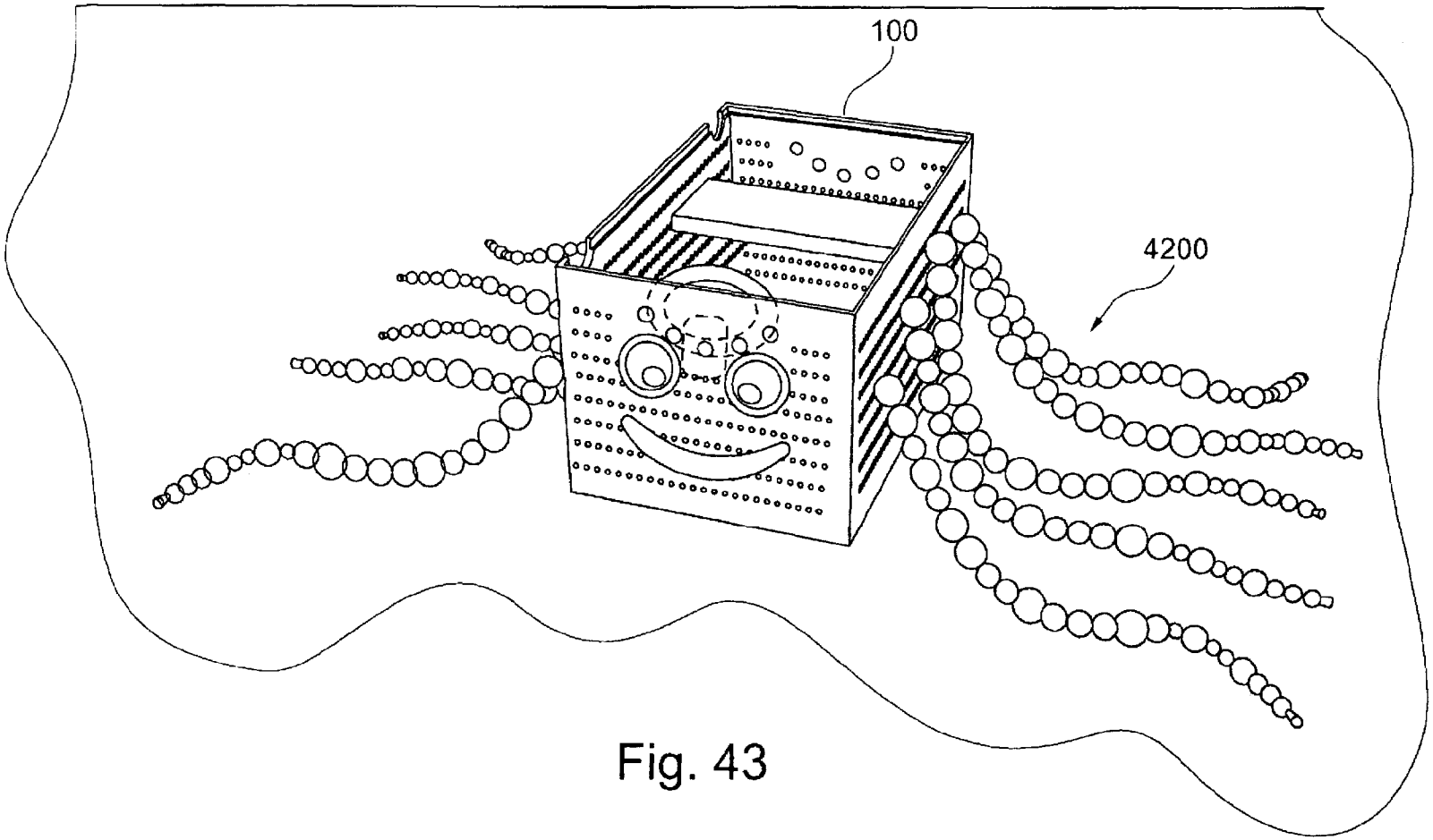
FIG. 43 shows a perspective top view of a container apparatus having a shaping structure in the form of tentacles.

FIG. 43 shows a perspective top view of a container apparatus having a shaping structure in the form of tentacles.

Figure 44:
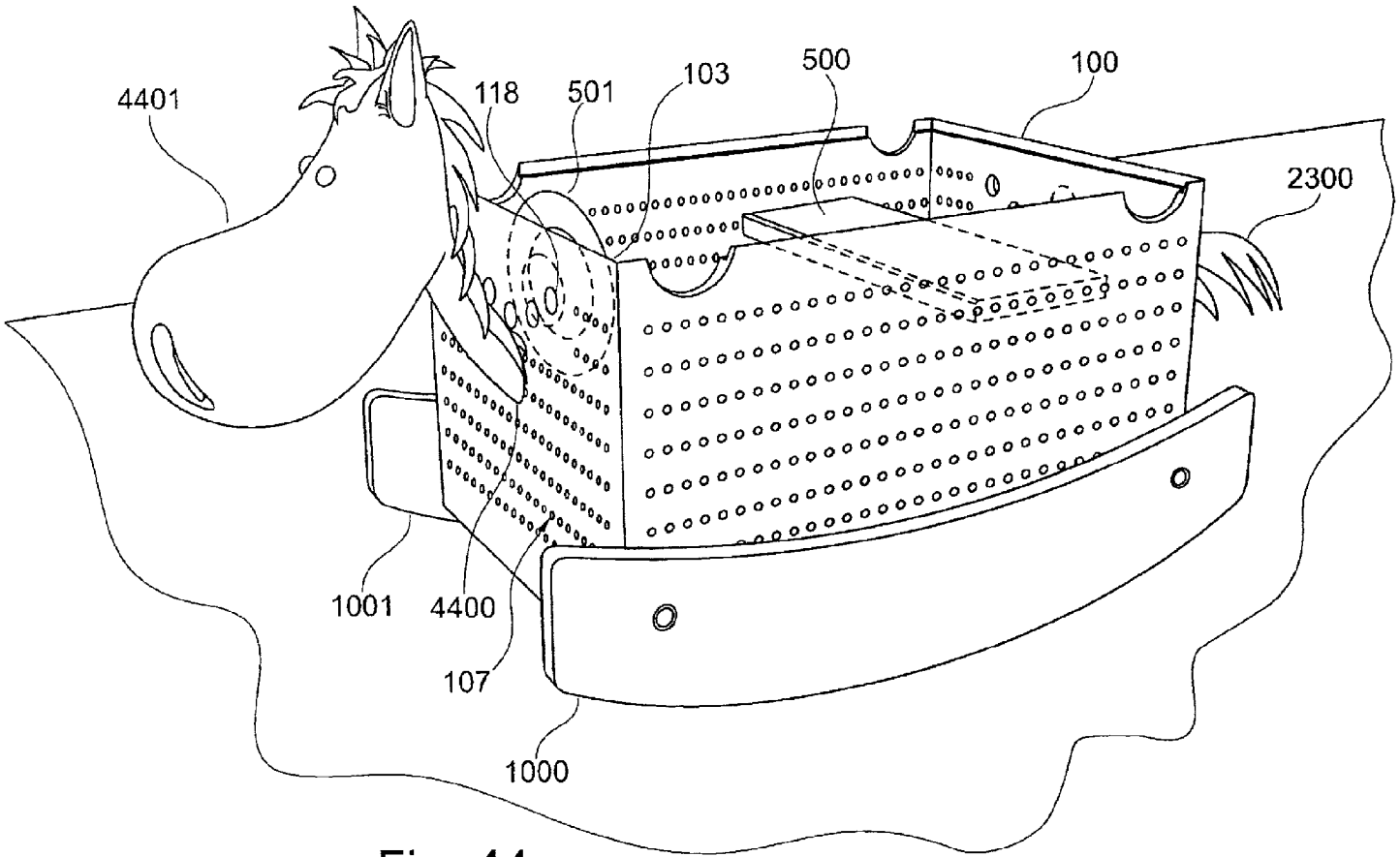
FIG. 44 shows a perspective side view of a container apparatus having a cladding apparatus forming a rocking horse according to an exemplary embodiment of the present invention.

FIG. 44 shows a perspective side view of a container apparatus having a cladding apparatus forming a rocking horse according to an exemplary embodiment of the present invention.

The container apparatus 100 comprises the skids 1000, 1001 and a cladding apparatus 4401 in the form of a horse head. The cladding apparatus 4401 comprises the mating structure 4400 which is attached to the mating structure 107 of the container apparatus 100. The mating structure 107, 4400 may allow positioning the cladding apparatus in a central position of the front side wall 103 of the container apparatus 100. The skids in an example are made of one piece.

In another example foots or pedestal can be mounted on the container apparatus.

Figure 45:
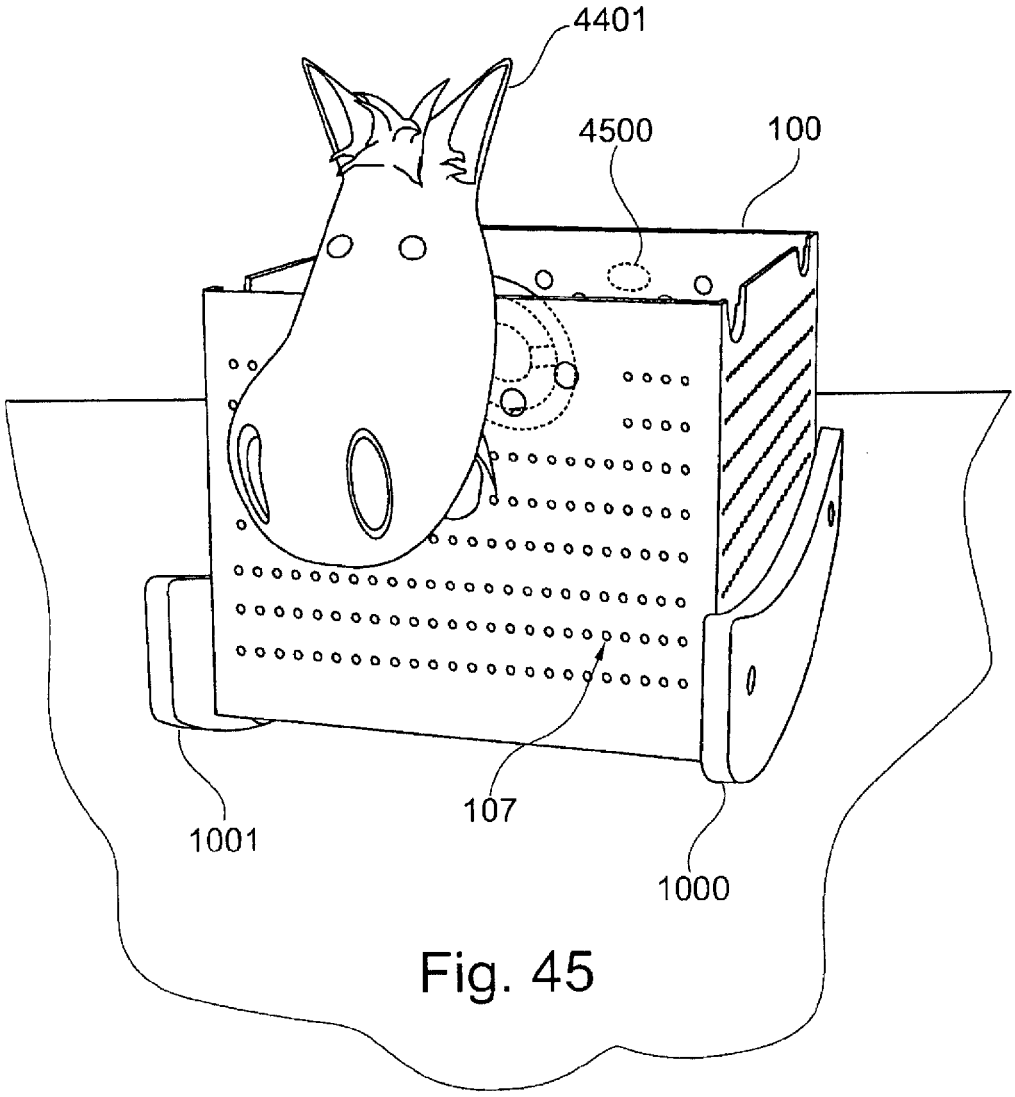
FIG. 45 shows a perspective front view of the container apparatus of FIG. 44 according to an exemplary embodiment of the present invention.

FIG. 45 shows a perspective front view of the container apparatus of FIG. 44 according to an exemplary embodiment of the present invention.

FIG. 45 shows the attachment 4500 of tail 2300 using the mating structure through the transparent back side wall.

Figure 46:
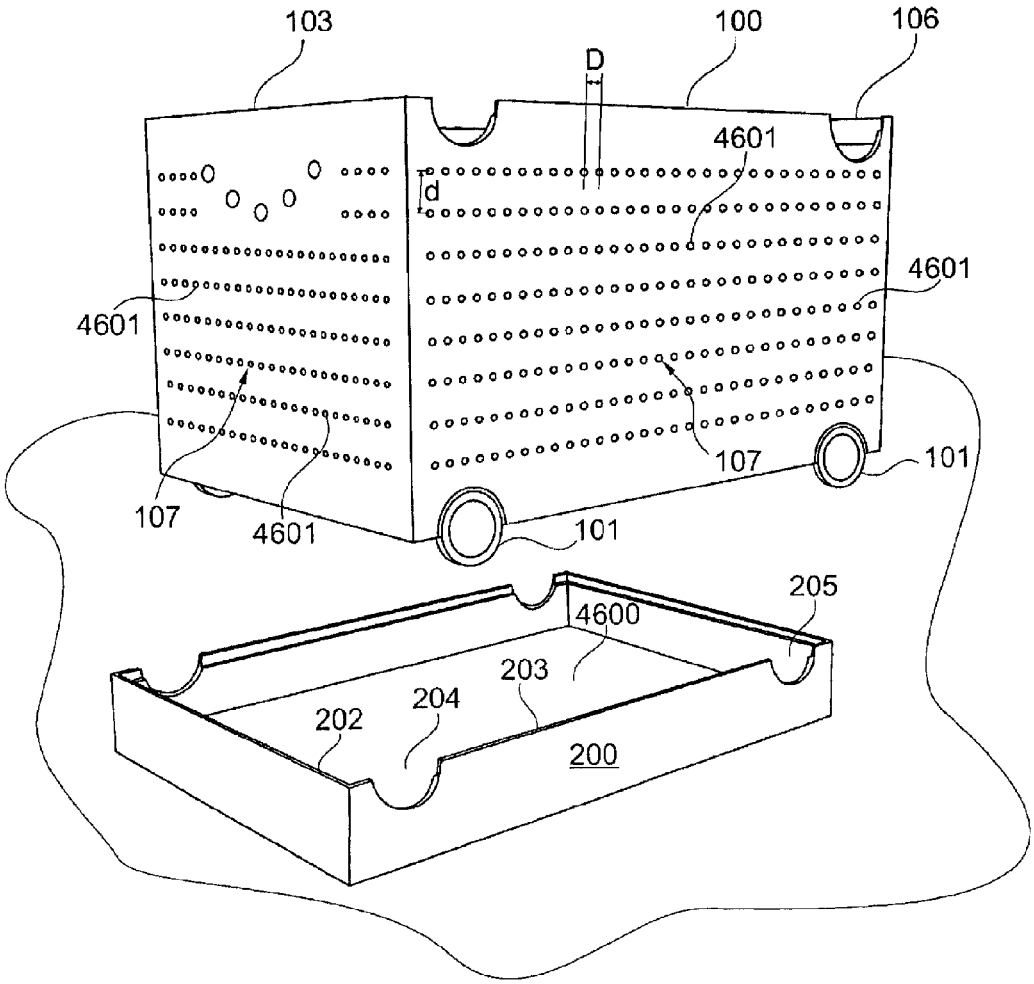
FIG. 46 shows a container apparatus and a platform structure according to an exemplary embodiment of the present inventions.

FIG. 46 shows a container apparatus and a platform structure according to an exemplary embodiment of the present inventions.

FIG. 46 shows that different fixing elements 4601 or attachment devices 4601 of the mating structure 107 on each side wall 103, 106 are on the same level.

The container apparatus 100 can be mounted on the platform structure 200 by engaging the wheels 101 of the container apparatus 100 with the upper side recesses 204, 205 of the platform structure 200. The platform structure 200 comprises the base plate 4600, which allows for stability.

Figures 47, 48, 49:
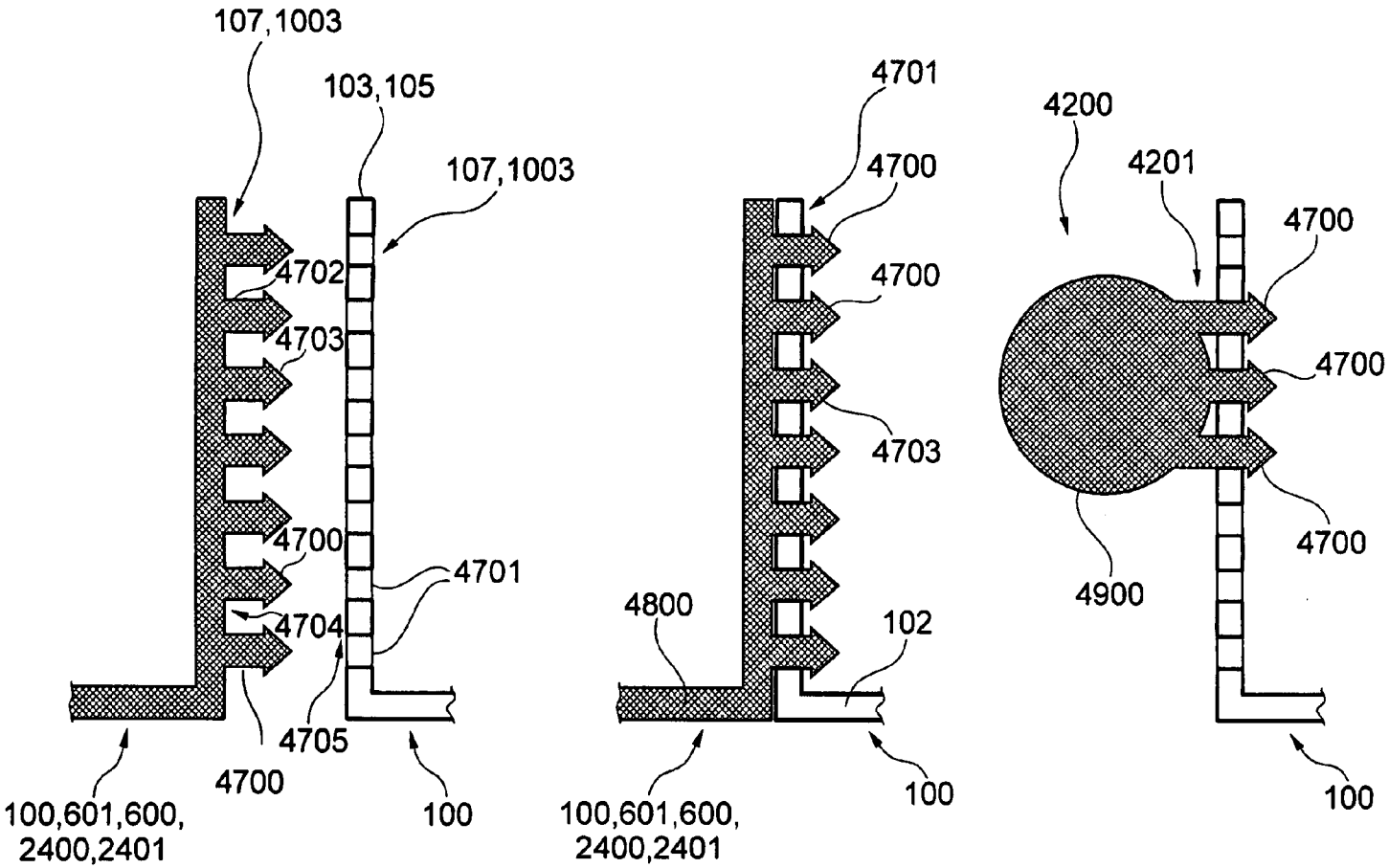
FIG. 47 shows a container apparatus and a cladding apparatus in an uncoupled state according to an exemplary embodiment of the present invention.
FIG. 48 shows a container apparatus and a cladding apparatus in a coupled state according to an exemplary embodiment of the present invention.
FIG. 49 shows a container apparatus and a further cladding apparatus in a coupled state according to an exemplary embodiment of the present invention.

FIG. 47 shows a container apparatus and a cladding apparatus in an uncoupled state according to an exemplary embodiment of the present invention.

The FIG. 47 shows the cladding apparatus 600, 601, 2400, 2401, which for example can comprise a three-dimensional structure 600, 601 or shaping structure 600, 601. This cladding apparatus may have to be coupled to the container apparatus 100. In another example, at least two container apparatuses 100 may have to be coupled together. Therefore, from a coupling perspective in an example a container apparatus 100 can be seen as a cladding apparatus 600, 601, 2400, 2401.

The cladding apparatus 100, 601, 600, 2400 and the container apparatus may have corresponding mating structures 107, 1003. In other words, the corresponding mating structures may work according to the plug and socket principle.

The cladding apparatus 601, 600, 2400, in particular the shaping structure, the three-dimensional structure, the three-dimensional forming structure or the panel, comprise a first attachment device 4700 and the container apparatus 100 comprise a second attachment device 4701. The first attachment device 4700 and/or the second attachment device 4701 are selected from the group of attachment devices consisting of a knop, a magnet, a pin, a through hole, a hook-and-loop fastener, a screw, a hook, an eye, a button, a zipper, a buckle and a clasp.

The mating structure 107, 1003 can comprise at least two different attachment devices, working according to different attachment principles. For example, knop and magnet may be regularly combined or knop and hook-and-loop fastener.

In the example, the mating structure 1003 of the cladding apparatus 601, 600, 2400 comprises at least one knop 4700. The knop 4700 can be engaged with one of the at least one through holes 4701 of the mating structure 107 of the container apparatus 100.

A knop 4700 or knob 4700 comprises a cylindrical shaft 4702 and a head 4703. The head in FIG. 47 is shown as an arrowhead. In another example the head may be of round shape, e.g. a ball or a ball with a hollow body. Thus, the head can be pressed together in order to fit through the hole 4701. The shaft 4702 has a first diameter and the head 4703 has a second diameter. The through hole 4701 on the opposite side of the knop 4700 has a third diameter. The first diameter is smaller than the third diameter, wherein the second diameter is greater than third diameter. This may allow engaging of the knop 4700 with the hole 4701. The head 4703 of the knop 4700 may be made of flexible material such as rubber or soft plastic. This selection of material may allow pushing the head 4703 through the hole 4701 even if the diameter of the head may be greater than the diameter of the hole 4701. However, the diameter of the head 4703 which is greater or broader than the diameter of the through hole 4701, may substantially prevent that the head easily, not intentionally or involuntarily releases from the through hole 4701. This may be the snap fit principle. In other words, a force generated by the engaged mating structures may be such strong that involuntary releasing of the container apparatus and the cladding apparatus may be prevented. However, if the container apparatus and the cladding apparatus may intentional shall be released, the force of a child may be sufficient to release an engaged mating structure 107.

The density of the knops may be increased, i.e. the distance between the knops or attachment devices may be decreased, in order to increase the force which substantially keeps the cladding apparatus and the container apparatus together.

In another example, the mating structure in addition to the knops may comprise a different attachment device. In an example, the mating structure 107, 1003 may comprise in addition to the knops 4700 magnets 4704, 4705. The polarity of the magnets may be different on the cladding apparatus 601, 600, 2400 and on the container apparatus. In an example, the polarity of the magnet on the cladding apparatus may be north 4704, whereas, the corresponding polarity 4705 on the container apparatus 100 may be south. Thus, by the additional attachment device an additional force may be generated in order to mate the cladding apparatus and the container apparatus together. The magnets 4704, 4705 may be arranged between the regular mating structure 107, 1003 or may be part of the regular mating structure. Thus, the additional attachment devices may also be regularly arranged, e.g. according to a grid or raster.

The number of attachment devices 4700, 4701 may depend on the weight of the cladding apparatus 601, 2400 and/or of the weight of the container apparatus 100. The weight may be reduced by employing wheels 101, 2403. In an example, the cumulated sum of forces generated by each individual attaching device 4700, 4704 multiplied by the number of attachment devices substantially equal to the weight of the cladding apparatus 601, 600, 2400.

FIG. 48 shows a container apparatus and a cladding apparatus in a coupled state or in an engaged state according to an exemplary embodiment of the present invention.

After pushing the knops 4700 through the through holes 4701, the cladding apparatus 601, 600, 2400 is mounted by the head 4703 of the knop 4700. Thus, the container apparatus 100 and the cladding apparatus 601, 600, 2400 are engaged.

In this engaged state, the base plate 102 of the container apparatus 100 and the base plate 4800 of the cladding apparatus are substantially aligned or on the same level. Thus, the base plate of the container apparatus 100 and the base plate 4800 of the cladding apparatus may have substantially the same distance from a ground.

FIG. 49 shows a container apparatus and a further cladding apparatus in a coupled state according to an exemplary embodiment of the present invention.

The cladding apparatus 4200 may comprise a ball 4900 which may be part of a shaping structure 4200, for example part of a tentacle 4200. The tentacle may be formed by balls of different sizes, which are not shown in FIG. 49. The ball 4900 comprises at least on a portion the attachment devices 4700, for example the knops 4700. Since the ball has a round surface or lateral area, the knops 4700 can have different lengths. In an example, the shafts 4702 of the knops 4700 have different sizes or different lengths.

By using knops of different length attaching of bodies or cladding apparatuses having round surfaces to a flat side wall may be possible.

A lid 500, which may be attached using the mating structure 107 may have a joint or a pivoting element in order to allow mounting or engaging the mating structure of the lid 500 and the mating structure of the container apparatus.

Figure 50:
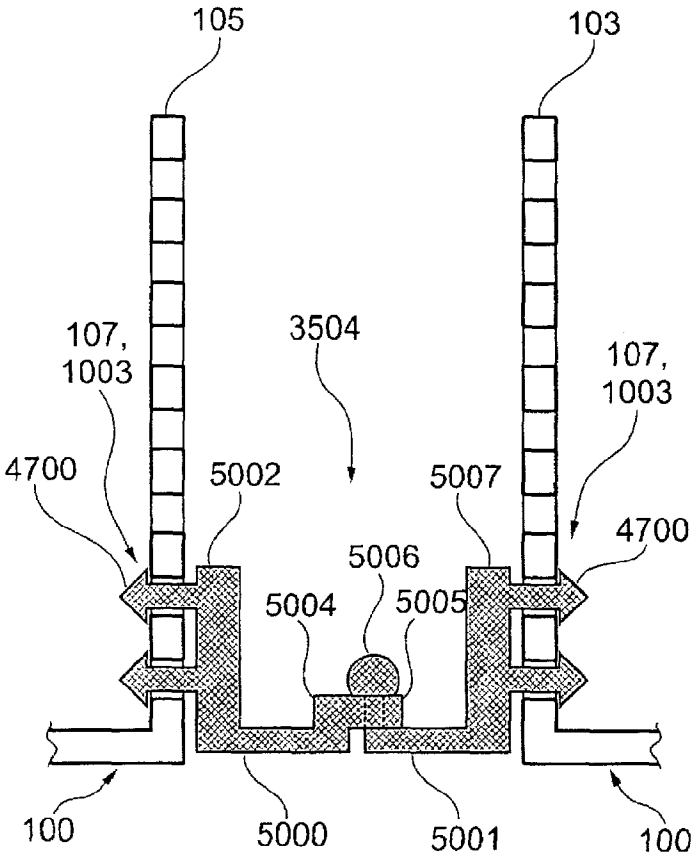
FIG. 50 shows a coupler according to an exemplary embodiment of the present invention.

FIG. 50 shows a coupler according to an exemplary embodiment of the present invention.

A coupler 3504 can be used to couple at least two container apparatuses 100. The coupler comprises the first coupling device 5000 and the second coupling device 5001. The first coupling device 5000 and the second coupling device 5001 may be implemented as a cladding apparatus 3504 or as a shaping structure of a cladding apparatus.

The first coupling device 5000 comprises the first base plate 5002 on which the mating structure 107, 1003, e.g. the knops 4700 are mounted. The first coupling device 5000 further comprises a first hook device 5004 with an eye device 5005. The eye device 5005 is adapted to loosely couple with a second hook device 5006.

The second hook device 5006 is included in the second coupling device 5001. The second coupling device 5001 further comprises the second base plate 5007 on which the mating structure 107, 1003 is mounted, e.g. the knops 4700.

The coupler 3504 may allow coupling two container apparatuses 100 in order to generate a train.

Figure 51:
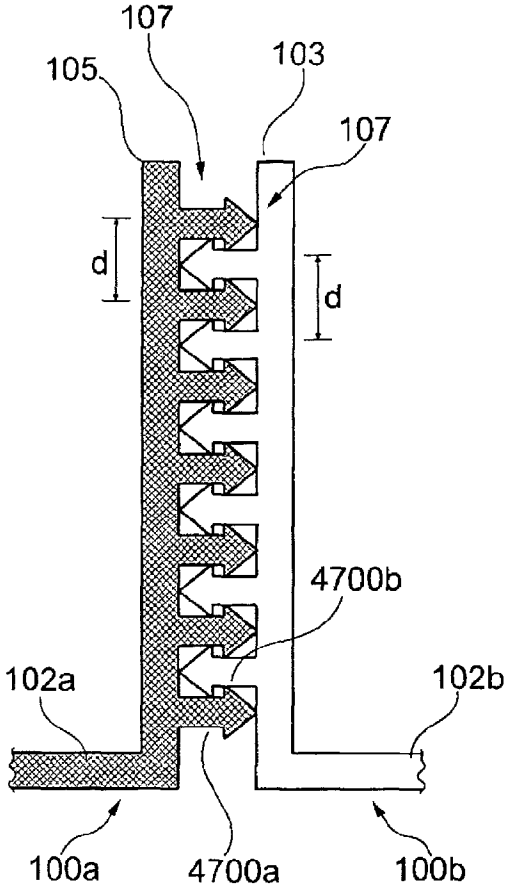
FIG. 51 shows two container apparatuses in an engaged state according to an exemplary embodiment of the present invention.

FIG. 51 shows two container apparatuses in an engaged state according to an exemplary embodiment of the present invention.

In order to engage two container apparatuses having the same type of attaching devices or attachment devices, the attaching devices can be displaced according to the raster or to the grid. In FIG. 51 the knops 4700*a* of the back side wall 105 engage with the knops 4700*b* of the front side wall 103. The container apparatus 100*a* comprises the back side wall 105. The container apparatus 100*b* comprises the front side wall 103.

The distance d between the knops 4700*a*, 4700*b* is the same. The plurality of knops 4700*a* as shown in FIG. 51 form a column of attachment devices, which have the distance d or the raster d. Not shown in FIG. 51 is a row of attaching elements, which row may be parallel to the base plate 102*a*, 102*b* of a container apparatus 100*a*, 100*b*. The attaching elements or attachement devices of the row may have the distance D or raster D, wherein D may differ from d or may be equal to d. The distances d and D are shown in FIG. 46.

Figure 52:
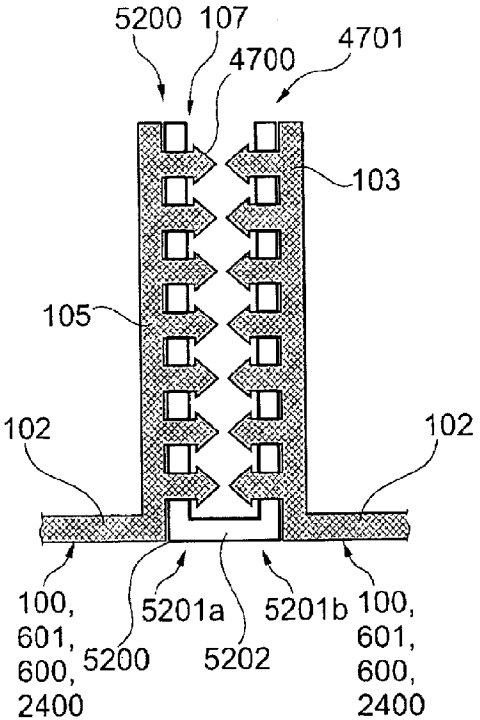
FIG. 52 shows an adapter according to an exemplary embodiment of the present invention.

FIG. 52 shows an adapter according to an exemplary embodiment of the present invention.

A cladding apparatus 5200 adapted to join at least two cladding apparatuses and or two container apparatuses may be provided. The adapter 5200 or adaptor 5200 may be configured to allow coupling of at least two container apparatuses and/or cladding apparatuses having similar mating structures 107 or having the same mating structures 107. Thus, at least two apparatuses of the same type can be coupled. For example two container apparatuses 100 and/or two cladding apparatuses 600, 601, 2400 can be coupled. The adapter 5200 comprises the mating structure corresponding to the mating structure 107 on two sides 5201*a*, 5201*b*. Thus, the adapter may have the same mating structures 4701 symmetrically arranged. Thus, substantially no displacement of the knops 4700 may be necessary if two apparatuses of the same type may have to be coupled. The adapter 5200 of FIG. 52 has a U-form and the holes 4701 of both brackets 5201*a*, 5201*b* are on substantially the same height. The base plate 5202 of the adapter 5200 and the base plates 102 container apparatuses 100 are substantially on the same height. Thus, the brackets 5201*a* and 5201*b* may have substantially the same height as the height of the side walls 103, 105 of the container apparatuses to be coupled. In another example the height of the brackets 5201*a*, 5201*b* may be smaller than the height of the side walls 103, 105 of the container apparatuses to be coupled. Or in other words, the number of attachment devices 4701 of the adapter 5200 may be smaller than the number of attachment devices 4700 of the mating structure 107 of the side walls 103, 105, wherein the density of attachment devices 4701, 4700 may be the same.

Figure 53:
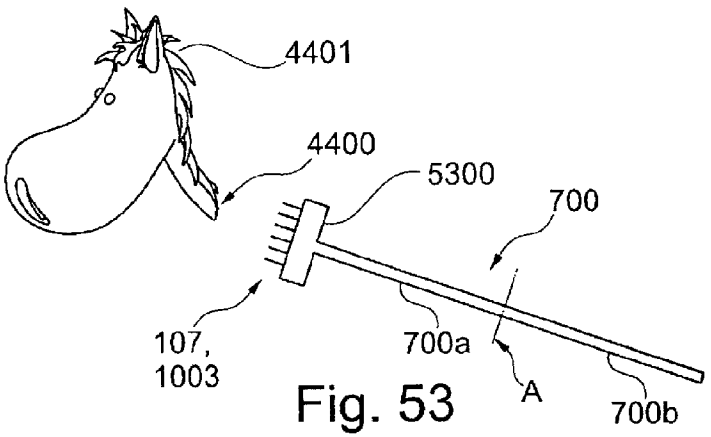
FIG. 53 shows two cladding apparatuses in an uncoupled state according to an exemplary embodiment of the present invention.

FIG. 53 shows two cladding apparatuses in an uncoupled state according to an exemplary embodiment of the present invention.

The first cladding apparatus 4401, e.g. the head of a horse 4401, has the first mating structure 4400. The second cladding apparatus 700, e.g. the rod 700, may have the second mating structure 107, 1003. The base plate 5300 comprises the second mating structure 107, 1003. The base plate 5300 is perpendicularly arranged on the rod 700.

The cladding apparatus 700 or rod 700 comprises the first rod part 700*a* and the second rod part 700*b*. The first rod part 700*a* and the second rod part 700*b* are joint together at the joint A. Thus, the first rod part 700*a* and the second rod part 700*b* can be separated, e.g. in order to stow the rod 700 in a container apparatus. The joint A may comprise a hinge or a pivot device which may allow folding the rod 700, e.g. in order to stow the rod in the container apparatus (not shown in FIG. 53).

Figure 54:
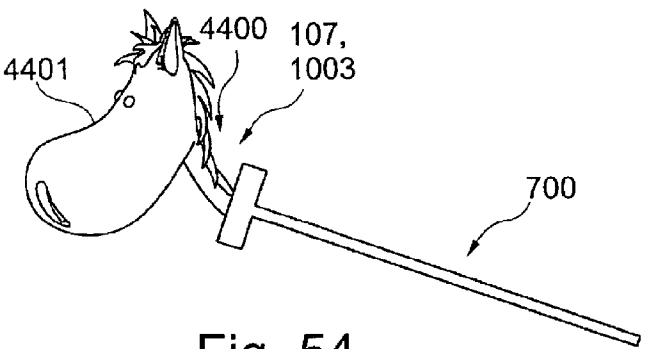
FIG. 54 shows two cladding apparatuses in a coupled state according to an exemplary embodiment of the present invention.

FIG. 54 shows two cladding apparatuses in a coupled state according to an exemplary embodiment of the present invention.

The mating structures 4400, 107, 1003 allow coupling or mating the two cladding apparatuses 4401, 700, e.g. the horse head 4401 and the rod 700. In an example a hobby horse may be built by coupling the cladding apparatuses. FIG. 54 shows the horse head 4401 and the rod 700 in a coupled state. In order to adapt the mating structures 4400, 107, 1003 one another an adapter 5200 may be used. The height of the adapter may be fit to the size of the corresponding mating structure.

It should be noted that the term "comprising" does not exclude other elements or steps and the "a" or "an" does not exclude a plurality. Also elements described in association with different embodiments may be combined.

It should also be noted that reference signs in the claims shall not be construed as limiting the scope of the claims.

The invention claimed is:

1. A container apparatus, comprising:

a base plate having a first side and a second side;

a sidewall arranged on the first side such that the base plate and the sidewall form a room, the room having an aperture opposite to the base plate, the sidewall substantially following a shape of the base plate, the sidewall including a mating structure which comprises a plurality of attachment devices; and at least three wheels arranged on the second side opposite to the sidewall;

wherein at least two attachment devices of the plurality of attachment devices are different, the at least two attachment devices being regularly arranged according to a grid, one of the at least two attachment devices being selected from a group consisting of a hole, a bore, a knop, a magnet, a pin, a hook-and-loop fastener, a screw, a hook, an eye, a button, a zipper, a buckle and a clasp; one of the at least two attachment devices being selected from the group consisting of a knop, a magnet, a pin, a hook-and-loop fastener, a screw, a hook, a button, a zipper, a buckle and a clasp.

2. The container apparatus of claim 1, wherein, if one of the at least two attachment devices is selected as a bore, the bore comprises a thread for allowing a screw to be directly screwed inside the sidewall.

3. The container apparatus of claim 1, wherein the mating structure comprises a part of a snap-fit closure.

4. The container apparatus of claim 1, wherein the sidewall has at least one recess which is configured to receive at least a portion of at least one further wheel of a further container apparatus.

5. The container apparatus of claim 4, wherein the recess is further configured to receive the at least one portion of the at least one further wheel such that a further base plate of the further container apparatus acts as a lid for the further container apparatus.

6. The container apparatus of claim 1, wherein the sidewall comprises a slot which is configured to receive a lid, the slot being further configured such that when the lid is received by the slot, the slot allows to position the lid substantially parallel to the base plate.

7. The container apparatus of claim 1, wherein the sidewall comprises a flange which is configured to receive a lid, the flange being further configured such that when the lid is mounted on the flange, the flange allows to position the lid substantially parallel to the base plate.

8. The container apparatus of claim 1, further comprising:

a lid, wherein a size of the lid is adapted to cover at least partially a size of the aperture.

9. The container apparatus of claim 8, wherein the lid is positioned in one of the slot and the flange such that the lid is movable in parallel to the base plate.

10. The container apparatus of claim 1, further comprising:

a lid at least partially extending over the sidewall.

11. The container apparatus of claim 1, further comprising:

a partition wall arranged inside the room such that the room is divided into a partition of the room.

12. The container apparatus of claim 1, wherein the sidewall further includes a closure element which is configured to engage with a corresponding closure element of a further container apparatus.

13. A cladding apparatus for a container apparatus, comprising:

a shaping structure having a mating structure, wherein the mating structure is configured to be mated with a mating structure of the container apparatus, the mating structure including a plurality of attachment devices, at least two attachment devices of the plurality of attachment devices being different, the at least two attachment devices being regularly arranged according to a grid, one of the at least two attachment devices being selected from a group consisting of a hole, a bore, a knop, a magnet, a pin, a hook-and-loop fastener, a screw, a hook, an eye, a button, a zipper, a buckle and a clasp, one of the at least two attachment devices being selected from a group consisting of a knop, a magnet, a pin, a hook-and-loop fastener, a screw, a hook, a button, a zipper, a buckle and a clasp and wherein the shaping structure is configured to allow amending the shape of the container apparatus when the cladding apparatus is mated with the container apparatus.

14. The cladding apparatus of claim 13, wherein the shaping structure is a panel which has a shape selected from a group of shapes consisting of a side view shape of an animal, the side view shape of a transport facility and the side view shape of a building.

15. The cladding apparatus of claim 14, wherein the shaping structure further includes a three-dimensional forming structure which is attachable to the shaping structure.

16. The cladding apparatus of claim 13, wherein the shaping structure includes a three-dimensional structure.

17. The cladding apparatus of claim 13, wherein the mating structure is configured to fit to a size of at least a portion of a sidewall of the container apparatus.

18. The cladding apparatus of claim 13, wherein the shaping structure further includes a skid.

19. A container assembly, comprising:

a first container apparatus; and a second container apparatus, wherein each of the first and second apparatuses includes (a) a base plate having a first side and a second side; (b) a sidewall arranged on the first side such that the base plate and the sidewall form a room, the room having an aperture opposite to the base plate, a shape of the sidewall substantially following a shape of the base plate, the sidewall including a mating structure which comprises a plurality of attachment devices; and (c) at least three wheels arranged on the second side opposite to the sidewall, wherein at least two attachment devices of the plurality of attachment devices are different, the at least two attachment devices being regularly arranged according to a grid, one of the at least two attachment devices being selected from a group consisting of a hole, a bore, a knop, a magnet, a pin, a hook-and-loop fastener, a screw, a hook, an eye, a button, a zipper, a buckle and a clasp; one of the at least two attachment devices being selected from the group consisting of a knop, a magnet, a pin, a hook-and-loop fastener, a screw, a hook, a button, a zipper, a buckle and a clasp, and wherein the second container apparatus is positioned over the first container apparatus such that the base plate of the second container apparatus allows substantially covering the aperture of the first container apparatus.

20. The container assembly of claim 19, further comprising:

a cladding structure including a matting structure which is mated with at least one mating structure selected from a group of the first container apparatus' mating structure and the second apparatus' mating structure.

* * * * *